US009795857B2

(12) United States Patent
Nelson et al.

(10) Patent No.: US 9,795,857 B2
(45) Date of Patent: Oct. 24, 2017

(54) COLLAPSIBLE NET APPARATUS

(71) Applicant: Triad Sports, Inc., Camarillo, CA (US)

(72) Inventors: David Nelson, Camarillo, CA (US); John Lucas, Camarillo, CA (US)

(73) Assignee: TRIAD SPORTS, INC., Camarillo, CA (US)

( * ) Notice: Subject to any disclaimer, the term of this patent is extended or adjusted under 35 U.S.C. 154(b) by 0 days.

(21) Appl. No.: 15/396,242

(22) Filed: Dec. 30, 2016

(65) Prior Publication Data

US 2017/0106266 A1 Apr. 20, 2017

Related U.S. Application Data

(63) Continuation-in-part of application No. 15/068,354, filed on Mar. 11, 2016, which is a continuation of (Continued)

(51) Int. Cl.

*A63B 61/00* (2006.01)
*A63B 69/00* (2006.01)

(Continued)

(52) U.S. Cl.

CPC ..... *A63B 71/022* (2013.01); *A63B 63/00* (2013.01); *A63B 69/00* (2013.01); *A63B 69/002* (2013.01);

(Continued)

(58) Field of Classification Search

CPC . A63B 63/04; A63B 2210/50; A63B 2210/52; A63B 2210/54; A63B 61/02; A63B 61/04; A63B 63/00; A63B 63/004

(Continued)

(56) References Cited

U.S. PATENT DOCUMENTS

| | | | |
|---|---|---|---|
| 4,274,632 | A | 6/1981 | Jacobs |
| 5,269,533 | A | 12/1993 | Kellams |

(Continued)

FOREIGN PATENT DOCUMENTS

| | | |
|---|---|---|
| JP | 3100716 | 5/2004 |
| JP | 2011024660 | 2/2011 |
| KR | 920008138 | 11/1992 |

OTHER PUBLICATIONS

International Preliminary Report and Written Opinion from PCT/US2012/040557, dated Dec. 12, 2013.

(Continued)

*Primary Examiner* — Mark Graham

(74) *Attorney, Agent, or Firm* — Koppel, Patrick, Heybl & Philpott

(57) ABSTRACT

A ball net structure arranged to be portable, collapsible, and provide the required structural support to receive or capture a projectile, such as but not limited to a soccer ball or baseball. The ball net structure comprises a support portion, first and second extensions, a first bracket pivotally coupling the first extension to the support portion, a second bracket pivotally coupling the second extension to the support portion, first and second flexible rods removably coupled to the support portion, and a net received by at least the first and second extensions and received by at least the first and second flexible rods. The net is configured to bend the first and second flexible rods from a linear state to an arcuate state, such that a net tension holds the net upright.

2 Claims, 24 Drawing Sheets

Related U.S. Application Data application No. 13/485,775, filed on May 31, 2012, now Pat. No. 9,283,455, application No. 15/396,242, which is a continuation-in-part of application No. 15/230,210, filed on Aug. 5, 2016.

(60) Provisional application No. 61/492,010, filed on Jun. 1, 2011, provisional application No. 62/287,356, filed on Jan. 26, 2016, provisional application No. 62/377,267, filed on Aug. 19, 2016.

(51) Int. Cl.
*A63B 63/00* (2006.01)
*A63B 71/02* (2006.01)
*A63B 102/18* (2015.01)

(52) U.S. Cl.
CPC ..... *A63B 69/0002* (2013.01); *A63B 71/023* (2013.01); *A63B 2069/0004* (2013.01); *A63B 2069/0008* (2013.01); *A63B 2071/026* (2013.01); *A63B 2102/18* (2015.10); *A63B 2102/182* (2015.10); *A63B 2209/00* (2013.01); *A63B 2209/02* (2013.01); *A63B 2210/50* (2013.01); *A63B 2243/007* (2013.01); *A63B 2243/0025* (2013.01)

(58) Field of Classification Search
USPC ..... 273/398–402, 395, 396; 473/478, 434, 473/435, 490, 492–495
See application file for complete search history.

(56) References Cited

U.S. PATENT DOCUMENTS

| | | | | |
|---|---|---|---|---|
| 5,539,957 | A | 7/1996 | Schmidt | |
| 5,562,288 | A * | 10/1996 | Erkebaev | A63B 69/0097 273/396 |
| 5,690,339 | A * | 11/1997 | Chen | A63B 63/004 273/400 |
| 5,816,956 | A | 10/1998 | Ellis et al. | |
| 5,839,733 | A | 11/1998 | Meeks et al. | |
| 6,371,873 | B1 | 4/2002 | Wang | |
| 6,511,390 | B2 | 1/2003 | Kim | |
| 6,716,123 | B1 | 4/2004 | Chen | |
| 7,371,195 | B2 | 5/2008 | Stevens | |
| 8,216,092 | B2 | 7/2012 | Wennesland | |
| 8,216,093 | B2 | 7/2012 | Chen | |
| 8,246,496 | B2 | 8/2012 | Holland et al. | |
| 8,579,737 | B2 | 11/2013 | Holland et al. | |
| 9,162,127 | B2 | 10/2015 | Holland et al. | |
| 9,283,455 | B2 | 3/2016 | Nelson | |
| 9,480,894 | B2 * | 11/2016 | Holland | A63B 63/004 |
| 2003/0153412 | A1 | 8/2003 | Duba et al. | |
| 2004/0036222 | A1 | 2/2004 | Chou | |
| 2007/0087869 | A1 | 4/2007 | Lin | |
| 2007/0281805 | A1 | 12/2007 | Hsiao | |
| 2010/0184538 | A1 * | 7/2010 | Reeves | A63B 63/004 473/478 |
| 2010/0304902 | A1 | 12/2010 | Holland et al. | |
| 2011/0074111 | A1 | 3/2011 | Jackson | |
| 2011/0230284 | A1 | 9/2011 | Simon | |
| 2011/0287872 | A1 | 11/2011 | Lynch | |
| 2015/0148152 | A1 | 5/2015 | Holland | |
| 2015/0151179 | A1 | 6/2015 | Holland et al. | |
| 2016/0023072 | A1 | 1/2016 | Holland et al. | |

OTHER PUBLICATIONS

PCT Notification of the International search Report and the Written Opinion for Appl. No. PCT/US2012/040557, dated Dec. 14, 2012.

* cited by examiner

FIG. 2c
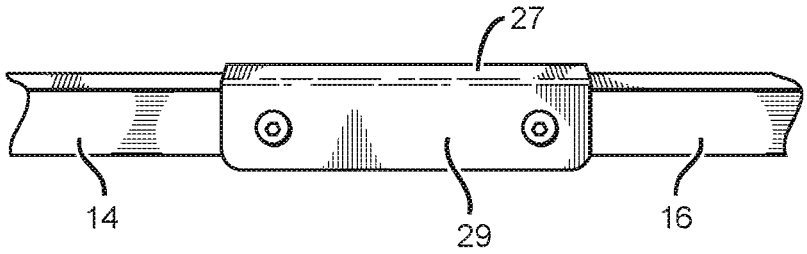
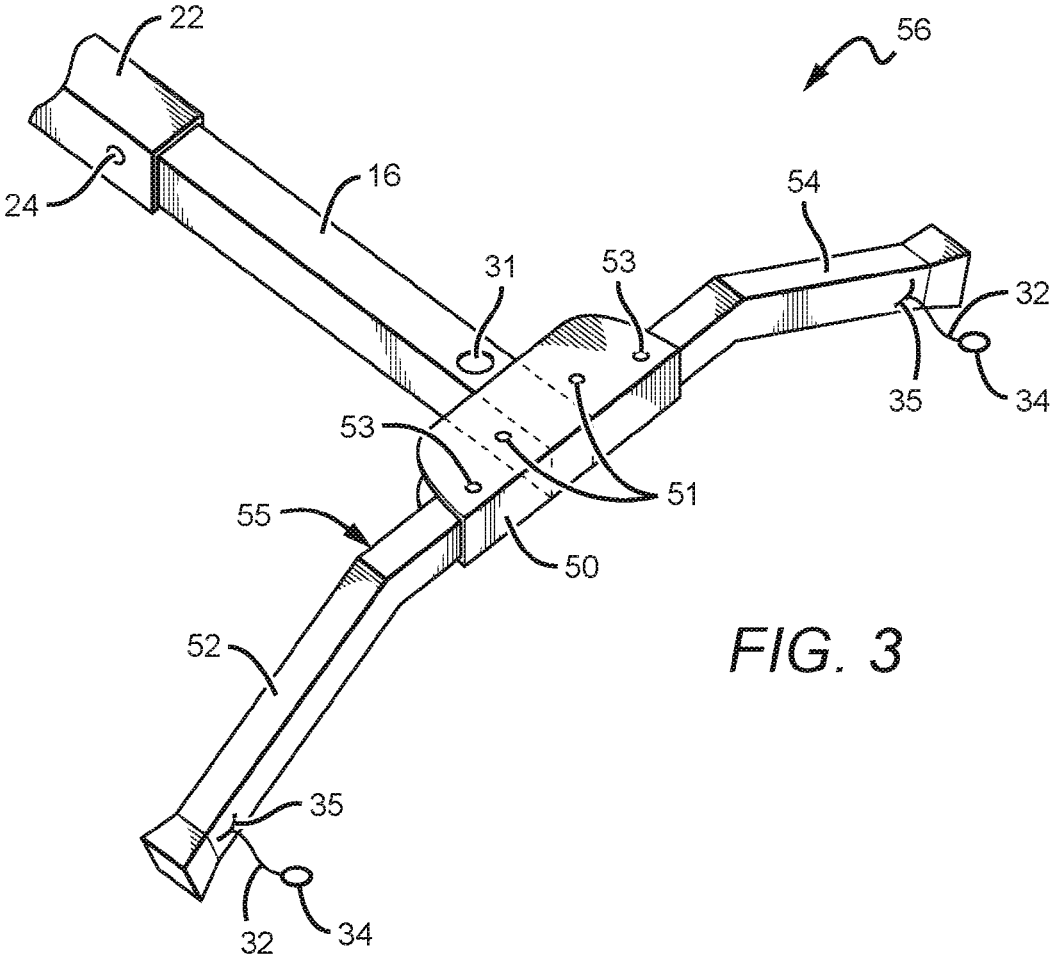
FIG. 3

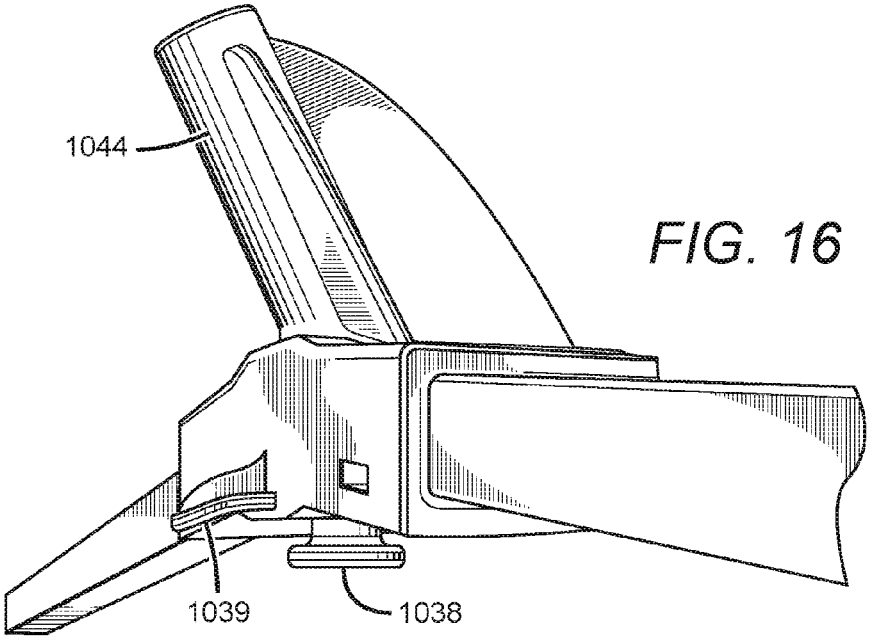
FIG. 16
FIG. 17
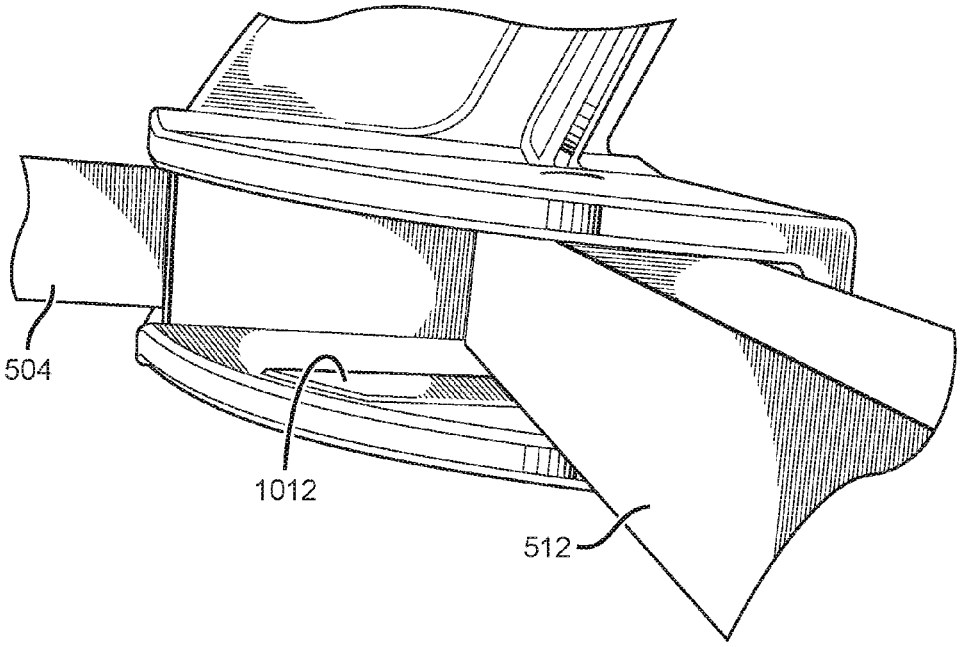

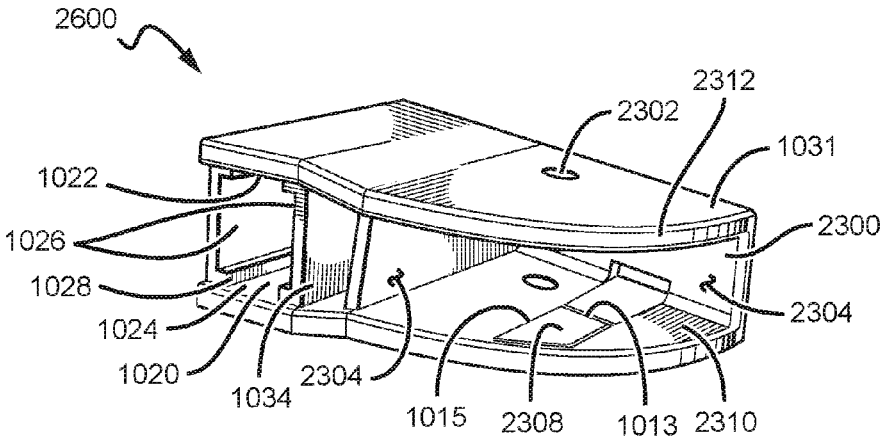
FIG. 26
FIG. 27
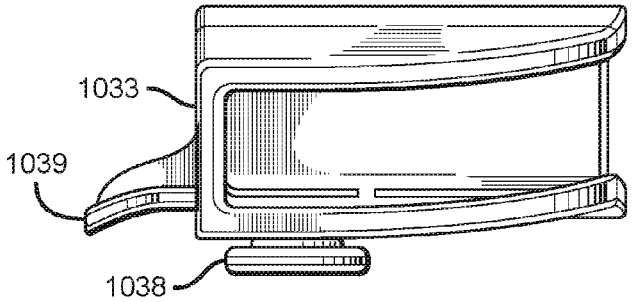
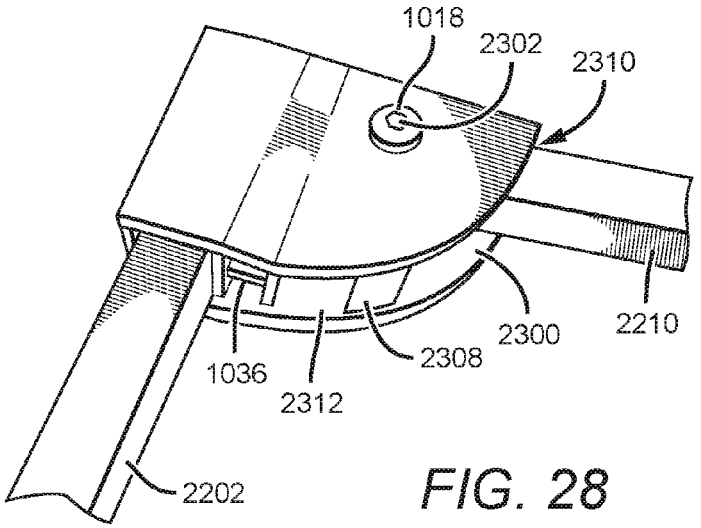
FIG. 28

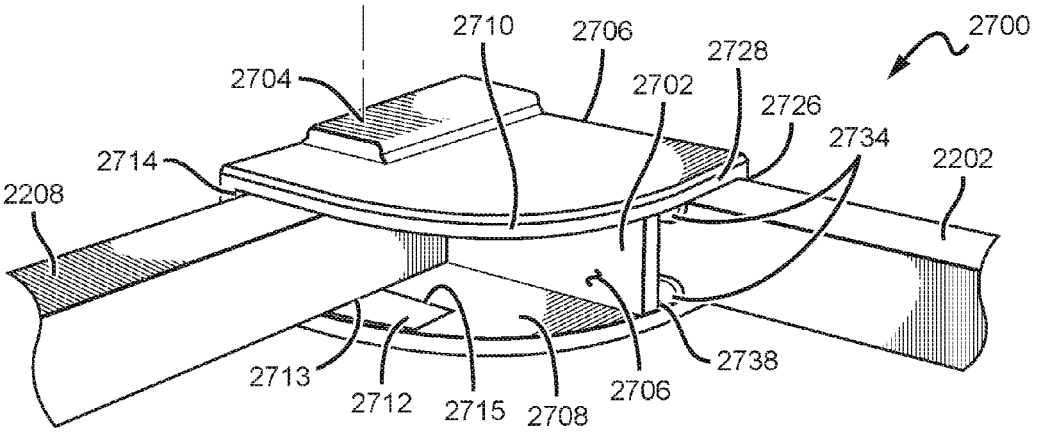
FIG. 29
FIG. 30
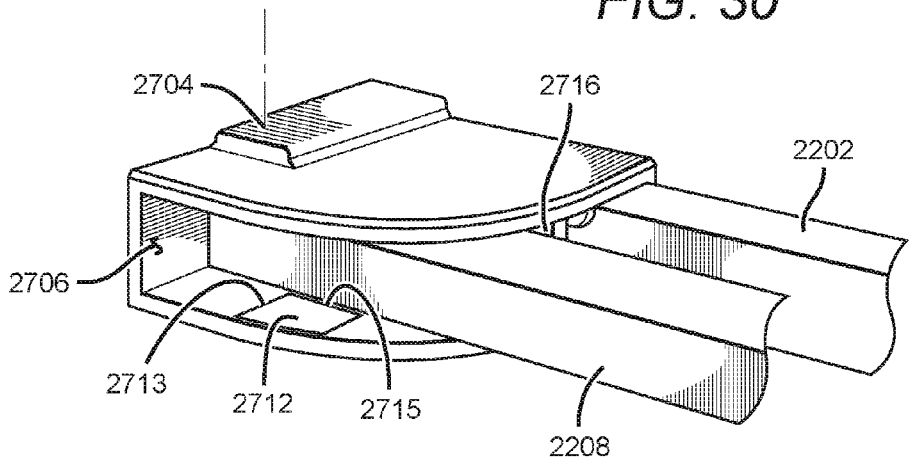
FIG. 31
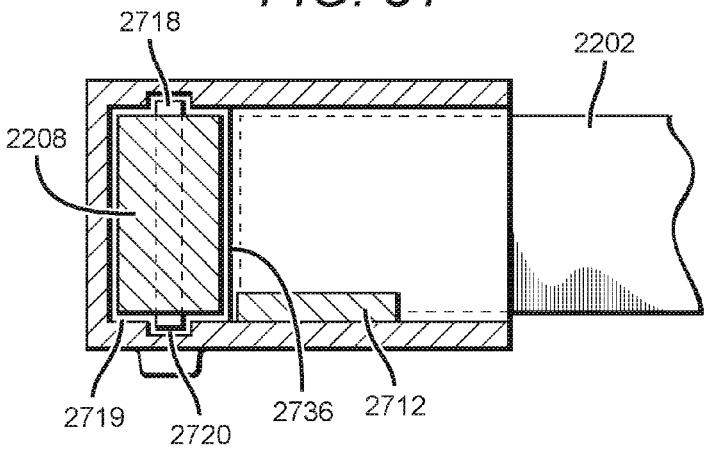

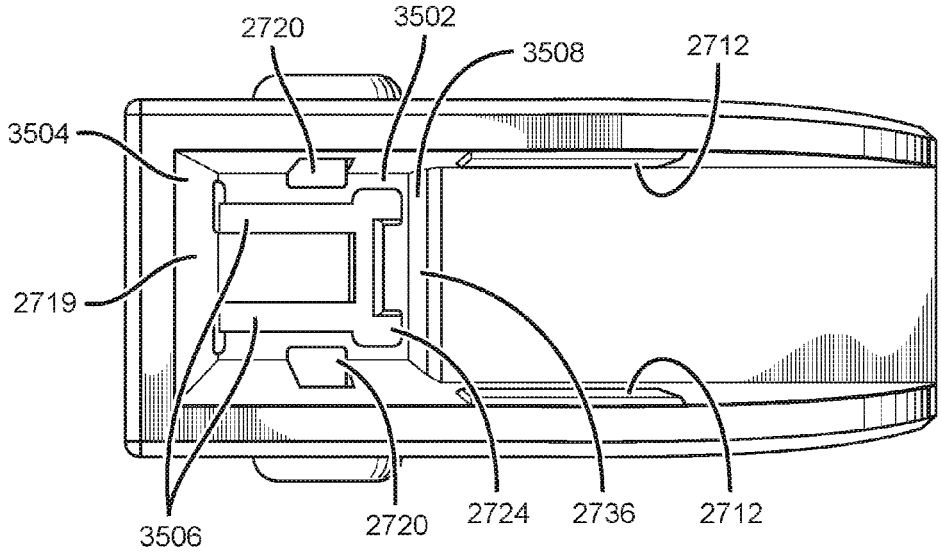
FIG. 35
FIG. 37
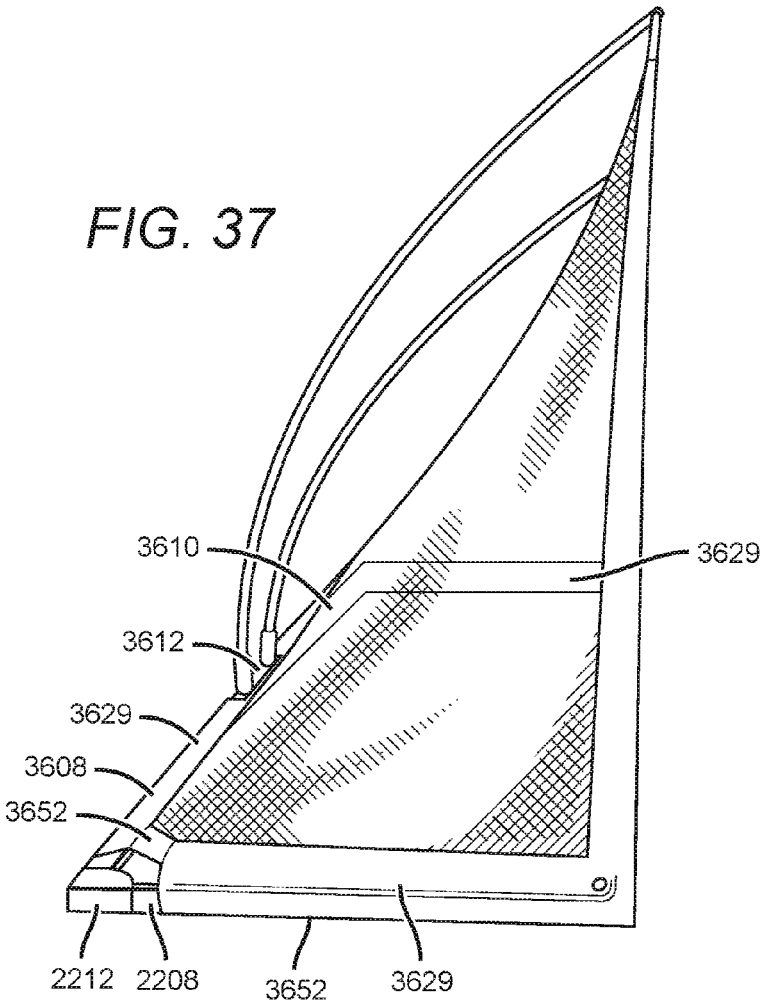

COLLAPSIBLE NET APPARATUS

RELATED APPLICATION

This application is a continuation in part application of Ser. No. 15/068,354 to David Nelson et al., filed on Mar. 11, 2016, which is a continuation application of Ser. No. 13/485,775 to David Nelson et al., filed on May 31, 2012, now U.S. Pat. No. 9,283,455, which claims the benefit of priority of U.S. Provisional Application Ser. No. 61/492,010, filed on Jun. 1, 2011. This application is also a continuation in part application of Ser. No. 15/230,210 to David Nelson et al., filed on Aug. 5, 2016, which claims the benefit of priority of U.S. Provisional Application Ser. No. 62/287,356, filed on Jan. 26, 2016. This application also claims the benefit of priority of U.S. Provisional Application Ser. No. 62/377,267, filed Aug. 19, 2016. The contents of Ser. Nos. 13/485,775, 15/068,354, 15/230,210, 61/492,010, 62/287,356, and 62/377,267 including their drawings, schematics, diagrams and written description, are hereby incorporated in their entirety by reference.

BACKGROUND

Field

This disclosure relates to a net apparatus adapted to be used in sports-related activities. More specifically, the disclosure is directed to a collapsible net apparatus that allows for ease of portability, transport, and assembly.

Description of the Related Art

Various sports such as soccer or baseball involve hitting or throwing projectiles such as soccer balls or baseballs toward a desired direction in a field. For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground.

A disadvantage of such structures is that they cannot be easily collapsed and efficiently stored. This is because both the support frame and the capturing frame must be properly folded and placed in a container. Further use of a capturing frame and a supporting frame makes such structures more expensive to manufacture and harder to carry due to increased weight.

There are portable net structures available, and they tend to have members that are formed of a single continuous piece or formed from numerous smaller pieces. A disadvantage of such structures formed of a single continuous piece is that they cannot be easily collapsed and efficiently stored due in part to its size. For example, a portable soccer goal can be formed of a single continuous frame wherein wheels are attached to a base to allow the soccer goal to be transported or wheeled out to a desired location. Although portable, transporting or positioning the soccer goal can be cumbersome, especially if the soccer goal is a regulation sized goal.

Portable goals formed of numerous pieces are more likely to be collapsible and easy transport, but have the distinct disadvantage of being difficult and slow to set up, and not made of robust materials. For instance, loose fasteners may require tools for driving or tightening, and may also become lost in transit or storage or during assembly of the goal on the playing surface. Additionally, collapsible goals or nets may have components that are attached using lockable hinges. The hinges on such goals or nets typically require a locking device to hold the frame of the goal or net in a stable and locked position. These locking devices can malfunction or break due to repeated strikes from a ball, bat, kicks from users while using the net, and the like. As such, the locking device would be inoperable and would not be able to lock the components at the hinge, such that the hinge would be ineffective at holding the support frame of the goal; thereby rendering the goal inoperable.

The above frame structures are typically configured for a single configuration and net, such that the frame is fixed and cannot be configured into a different arrangement for a different net and/or a different sports-related activity. For example, the portable soccer goal formed of a single continuous frame cannot be modified into a differently configured frame for a different net because the single continuous frame is permanently fixed and only designed to be used with a soccer goal net. In addition, frames formed of multiple pieces can only be assembled in the designed single configuration and is not customizable.

The disclosure is a net apparatus that is portable, collapsible, and able to be configured into different arrangement for different nets and/or different sports-related activities. For example, the net apparatus can be configured to receive nets of different sizes and/or configurations that are designed for different sports and/or different sports-related activities. The disclosure addresses these needs and provides further related advantages.

SUMMARY

The disclosure disclosed herein provides various aspects of a net apparatus that are cost effective, easy to assemble/disassemble, easily transportable and provide the required structural support to receive or capture a projectile, such as but not limited to a soccer ball or baseball. The different aspects comprise elements to allow the net apparatus to be configured into a different arrangement, such that the apparatus can be used with a different net and/or a different sports-related activity. The net apparatus is configured to be collapsible, easy to transport between locations and yet provide a sufficiently sized net to allow for sports practice or training, such as but not limited to soccer or baseball. The net apparatus can also be configured such that the net apparatus can be easily assembled or disassembled by a single individual.

In one aspect, as broadly described herein, a net apparatus comprises a support portion having a first end and a second end, first and second extensions, a first bracket pivotally coupling the first extension to the support portion, a second bracket pivotally coupling the second extension to the support portion, first and second flexible rods each having an upper end and a lower end, wherein the lower ends are removably coupled to the support portion, and a net received by the first and second extensions and received by at least the upper ends of the first and second flexible rods, the net being configured to bend the first flexible rod and the second flexible rod from a linear state to an arcuate state, such that a net tension pulls the first flexible rod into the arcuate state and the net tension simultaneously pulls the second flexible rod into the arcuate state.

In another aspect, the net apparatus comprises a support portion having a first and second support portions, first and second extensions, a first bracket coupled to the first support portion, wherein the first extension is received by the first bracket, such that the first extension rotates about a pivot of the first bracket, a second bracket coupled to the second support portion, wherein the second extension is received by the second bracket, such that the second extension rotates about a pivot of the second bracket, the support portion further comprising a third bracket adapted to receive the first support portion and the second support portion, such that the first support portion rotates about a first pivot of the third bracket and the second support portion rotates about a second pivot of the third bracket, first and second flexible rods each having an upper end and a lower end, wherein each of the lower ends of the first and second flexible rods are removably coupled to the support portion, wherein each of the lower ends of the first and second flexible rods are remote from the first and second brackets, and a net adapted to receive the first and second flexible rods and the first and second extensions, wherein the first and second flexible rods exert a force onto the third bracket to secure the first support portion and the second support portion in an open position within the third bracket, wherein the net bends the first and second flexible rods from a straight relaxed state into a bow-shaped flexed state.

These and other aspects and advantages of the disclosure will become apparent from the following detailed description and the accompanying drawings which illustrate by way of example the features of the disclosure.

BRIEF DESCRIPTION OF THE DRAWINGS

FIG. 2*c* is another side view of the hinge according to an aspect of the disclosure.

FIG. 3 is a perspective view of a base structure according to an aspect of the disclosure.

FIG. 16 is a side view of a base structure according to an aspect of the disclosure.

FIG. 17 is an enlarged side view of a base extension hinge according to an aspect of the disclosure.

FIG. 26 is a perspective view of a bracket according to an aspect of the disclosure.

FIG. 27 is a side view of a bracket according to an aspect of the disclosure.

FIG. 28 is an enlarged view of the ball net structure according to an aspect of the disclosure.

FIG. 29 is a perspective view of a bracket according to an aspect of the disclosure.

FIG. 30 is a perspective view of the bracket according to an aspect of the disclosure.

FIG. 31 is a side view of the bracket according to an aspect of the disclosure.

FIG. 35 is another side view of the bracket according to an aspect of the disclosure.

FIG. 37 is a side view of a ball net structure according to an aspect of the disclosure.

DETAILED DESCRIPTION

Figure 1:
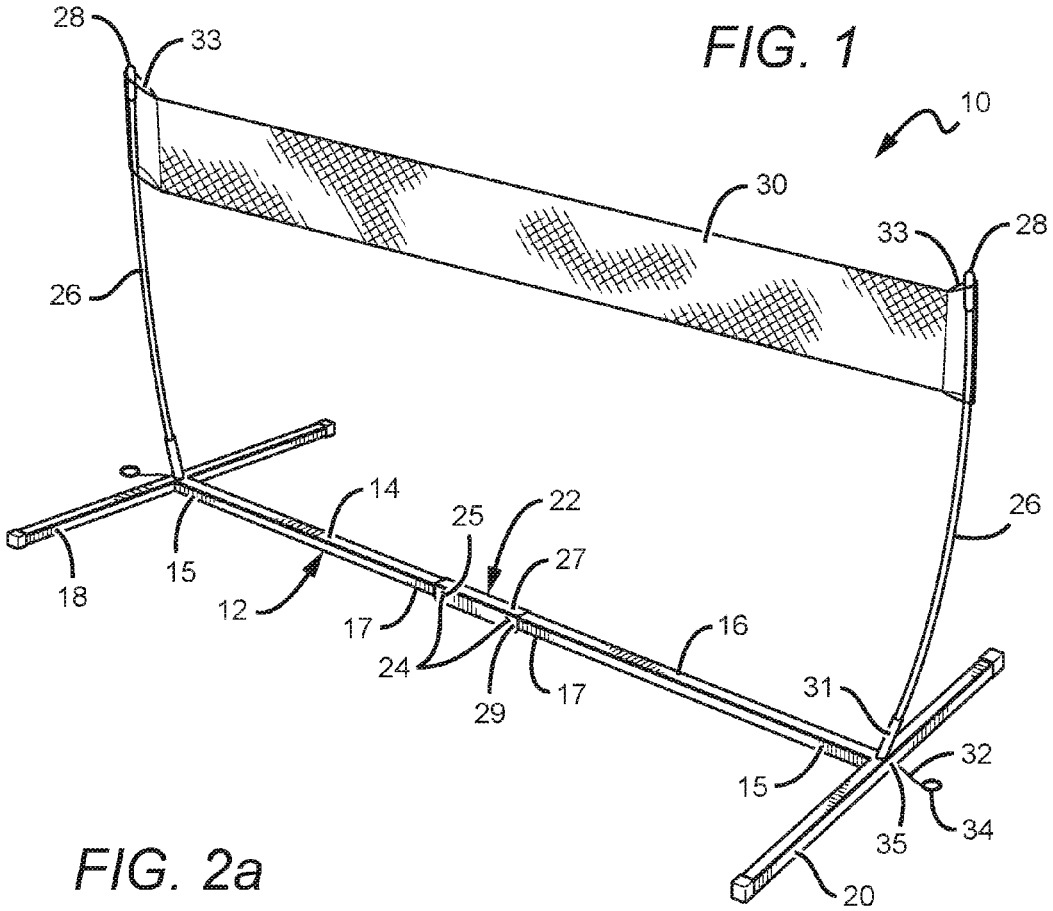
FIG. 1 is a perspective view of a ball net structure according to an aspect of the disclosure.

The disclosure described herein is directed to different aspects of a net apparatus that in some aspects provide a frame structure that is easy to setup and is collapsible such that the frame structure is easy to assemble by a single individual, store, is portable, and is customizable for different nets and/or sports-related activities. The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The net apparatus can comprise many different materials and can be used in many different applications such as, but not limited to, practicing soccer skills, throwing and/or hitting baseballs. The net apparatus according to the disclosure can be arranged in many different ways with many different components, and is generally arranged to provide a net structure to capture or catch a projectile. In one aspect, as broadly described herein, a net apparatus comprises a support portion having a first end and a second end, first and second extensions, a first bracket pivotally coupling the first extension to the support portion, a second bracket pivotally coupling the second extension to the support portion, first and second flexible rods each having an upper end and a lower end, wherein the lower ends are removably coupled to the support portion, and a net received by the first and second extensions and received by at least the upper ends of the first and second flexible rods, the net being configured to bend the first flexible rod and the second flexible rod from a linear state to an arcuate state, such that a net tension pulls the first flexible rod into the arcuate state and the net tension simultaneously pulls the second flexible rod into the arcuate state.

In another aspect, the net apparatus comprises a support portion having a first and second support portions, first and second extensions, a first bracket coupled to the first support portion, wherein the first extension is received by the first bracket, such that the first extension rotates about a pivot of the first bracket, a second bracket coupled to the second support portion, wherein the second extension is received by the second bracket, such that the second extension rotates about a pivot of the second bracket, the support portion further comprising a third bracket adapted to receive the first support portion and the second support portion, such that the first support portion rotates about a first pivot of the third bracket and the second support portion rotates about a second pivot of the third bracket, first and second flexible rods each having an upper end and a lower end, wherein each of the lower ends of the first and second flexible rods are removably coupled to the support portion, wherein each of the lower ends of the first and second flexible rods are remote from the first and second brackets, and a net adapted to receive the first and second flexible rods and the first and second extensions, wherein the first and second flexible rods exert a force onto the third bracket to secure the first support portion and the second support portion in an open position within the third bracket, wherein the net bends the first and second flexible rods from a straight relaxed state into a bow-shaped flexed state.

The net apparatus of the disclosure can provide a number of additional advantages beyond those mentioned above. For example, the first and second brackets allow for ease of assembly/disassembly and storage of the net apparatus because the first and second extensions can be pivoted toward the support portion such that the net apparatus is collapsible. The net apparatus can be folded upon itself and form a smaller package that can easily be transported and/or stored without taking up too much physical space. At least another advantage is that the third bracket further allows for the ease of assembly/disassembly and storage of the net apparatus, because the first and second support portions can be pivoted towards each other, thereby allowing the net apparatus to form a smaller package that can be easily transported and/or stored.

The net apparatus of the disclosure can be used to stop or capture a ball or the like when performing sports-related activities. However, the disclosure is not intended to be limited to such aspects. As further described below, the net apparatus can be arranged to allow an individual to easily deploy and disassemble the net apparatus in an outdoor or indoor setting.

The disclosure is described herein with reference to certain aspects, but it is understood that the disclosure can be embodied in many different forms and should not be construed as limited to the aspects set forth herein. In particular, the disclosure is described below in regards to a net apparatus to practice or perform sports-related activities in an outdoor setting, but it is understood that the disclosure can be used for many other applications in many different settings. The components of the net apparatus can have different shapes and sizes beyond those shown in the figures or discussed herein.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the disclosure can be arranged in many different ways with many more features and elements beyond what is shown in the figures.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the device in addition to the orientation depicted in the figures.

Aspects of the disclosure are described herein with reference to illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the disclosure.

Figure 2A:
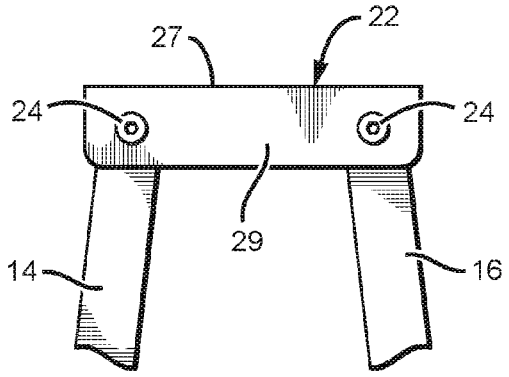
FIG. 2*a* is a side view of a hinge according to an aspect of the disclosure.
Figure 2B:
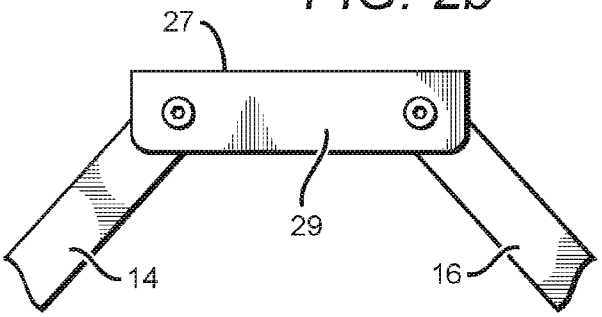
FIG. 2*b* is another side view of the hinge according to an aspect of the disclosure.

FIGS. 1-2*c* show one aspect of a ball net structure 10 according to an aspect of the disclosure. In some aspects, the ball net structure 10 is configured such that the ball net structure 10 can be deployed in an outdoor setting such as, but not limited to, a natural grass, synthetic field, dirt, concrete or the like. In other aspects, the ball net structure 10 can be deployed in an indoor setting such as but not limited to an indoor training facility, residential or commercial setting having a synthetic or natural surface, or the like. The ball net structure 10 can be used in sports-related activities, such as but not limited to baseball, softball, soccer, football and the like. The ball net structure 10 can also be used to allow users to practice kicking, hitting or throwing a ball or other projectile to the ball net structure 10, such that the ball net structure captures or catches the ball so that the user does not have to travel great distances to retrieve the ball. The ball net structure 10 comprises a base structure 12 comprising first and second support portions 14, 16 pivotally attached to a hinge 22, a plurality of rods 26 removably coupled to the base structure 12, and a net 30 adapted to receive the plurality of rods 26. The aspect shown in FIG. 1 has two rods 26, but other aspects can have more than two rods 26. The rods 26 are configured to exert a force on the hinge 22 in order to lock the first and second support portions 14, 16 in place and prevent rotation of the first and second portions 14, 16 about the hinge 22. The base structure 12, rods 26 and net 30, when fully assembled and deployed, are adapted to withstand the force of a ball or projectile so as to capture the ball while keeping the ball net structure 10 in an upright position.

For the same or similar elements or features, the reference numbers from FIGS. 1-2*c* may be used throughout the application herein. In one aspect of the disclosure, the base structure 12 can comprise a first base extension 18 coupled to the first support portion 14 and a second base extension 20 coupled to the second support portion 16. This arrangement allows the first and second base extensions 18, 20 to provide additional structural support to further stabilize the ball net structure 10 in an upright position. In some aspects, the first and second base extensions 18, 20 can be coupled to the respective support portions 14, 16 such that the first and second base extensions 18, 20 are perpendicular to the respective support portion 14, 16. In other aspects, the first and second base extensions 18, 20 can be angled in a V-shaped configuration and configured to raise the base structure 12 above the ground or surface or allow the base structure 12 to contact the ground or surface, wherein the angle of the V-shaped base extensions 18, 20 can be in the range of 90°-140° (degrees). In yet other aspects, as in FIG. 3, a base extension 55 comprises a base extension hinge 50 coupled to the support portions 16 and 14 (not shown), first and second base extension legs 52, 54 pivotally attached to the base extension hinge 50 about a respective pivot point 51, and can be locked into place by respective locking pins/buttons 53. In this arrangement, the legs 52, 54 can be released from their respective locking pins/buttons 53 and are able to rotate about pivot points 51 towards the support portions 16 and 14 such that the base structure 56 is further collapsible and easy to transport. In the aspect of FIG. 1, the base extensions 18, 20 are stationary and are not able to be rotated towards their respective support portion 14, 16. Additionally, the first and second legs 52, 54, in FIG. 3 can be arranged either bent, curved, or straight, such that the base structure 56 is elevated off the ground or surface. However, in other aspects, the legs 52, 54 can be arranged to allow the base structure 56 to contact the ground or surface. The legs 52, 54 can also comprise the attachment device 33, attachment cord 32 and ring 34 as discussed in the aspect of FIG. 1.

The first and second support portions 14, 16 each have a first end 15 and a second end 17, wherein the first end 15 of each of the support portions 14, 16 is coupled to the respective base extensions 18, 20. The first and second support portions 14, 16 extend from the respective base extensions 18, 20 towards a hinge 22 and are pivotally coupled to the hinge 22, such that the base extensions 18, 20 are opposite the hinge 22. The second ends 17 of support portions 14, 16 are coupled to the hinge 22 using hinge pins 24. The hinge 22 has openings 25 that receive the hinge pins 24 so as to couple the support portions 14, 16 to the hinge 22. In one aspect, the hinge pins 24 can be screws with a nut to hold the screw in place. However, in other aspects, the openings 25 of the hinge 22 can be threaded to receive the hinge pins 24, or the hinge pins can be nails, rivets or the like. The support portions 14, 16 can be coupled to the hinge 22 using various known means in the art and is not intended to be limited to the aspects disclosed herein. The first and second support portions 14, 16 can be made of many different materials known in the art, such as but not limited to wood, plastic, metal, a composition thereof or the like. The first and second support portions 14, 16 can be formed to have many different shapes, such as but not limited to circular, square, polygonal, a combination thereof or the like. The first and second portions 14, 16 of the aspect of FIGS. 1-2*c* are shown as having a square-like shape.

The hinge 22 is arranged to receive at least a portion of the first and second support portions 14, 16 such that the support portions 14, 16 are able to rotate about the respective hinge pin 24. In one aspect, the hinge 22 is configured to be a U-shaped channel having a hinge base 27, sidewalls 29 and openings 25 to allow respective hinge pins 24 to be received by the hinge 22 as well as the first and second support portions 14, 16, such that the first and second support portions 14, 16 are pivotally coupled to hinge 22. In the aspect of FIG. 1, the second ends 17 of each of the first and second support portions 14, 16 are pivotally coupled to the hinge 22. However, in other aspects, the first and second support portions 14, 16 can be pivotally coupled to the hinge 22 at different locations between the first and second ends 15, 17.

An advantage of the disclosure is that in some aspects the hinge 22 can be U-shaped which allows the hinge 22 to hold the first and second support portions 14, 16 in a stable and parallel position along the same axis and also provides a physical stop which prevents the first and second support portions 14, 16 from pivoting beyond the physical stop. However, in other aspects, the hinge 22 can be shaped in different forms such that the support portions 14, 16 are not aligned along the same axis, can be parallel or non-parallel, yet still provide a physical stop to prevent the portions 14, 16 from rotating beyond the physical stop.

As shown in FIGS. 1-2*c*, the first and second portions 14, 16 are coupled to the hinge 22, using hinge pins 24, such that they rotate about the respective hinge pin 24. Rotation of the first support portion 14, in a direction opposite the second support portion 16, about the hinge pin 24 will stop when the first support portion 14 comes into contact with the hinge base 27 of the hinge 22; FIG. 2*c* shows an example of the support portions 14, 16 in contact with the hinge base 27 and precluding further rotation. The hinge base 27 provides a physical stop and prevents the first support portion 14 from further rotation. The second support portion 16 is similarly configured as the first support portion 14 and will stop rotating about hinge pin 24 when the second support portion 16 contacts the hinge base 27. The physical stop provided by the hinge 22 properly aligns the first and second support portions 14, 16 when assembling the ball net structure 10. Yet another advantage of the disclosure is that the hinge 22 allows the base structure 12 to be folded onto itself so that the ball net structure 10 can be easily stored as well as easy to transport. This arrangement allows the base structure 12 to reduce its size and/or area, thereby allowing the ball net structure 10 to be stored in a small container.

When assembling the ball net structure 10, the first and second support portions 14, 16 of the base structure 12 are rotated away from the opposite support portion 16, 14 towards the hinge base 27. When the support portions 14, 16 are in contact with the hinge base 27, precluding further rotation, the base structure 12 is ready to be placed on the playing surface, such as but not limited to a natural grass, synthetic filed, cement, wood, asphalt, or the like. The base structure 12 is placed on the playing surface such that the hinge base 27 is opposite the playing surface. In other words, the hinge base 27 does not contact the surface upon which the base structure 12 is positioned on. The hinge 22 can be arranged in many different configurations and is not intended to be limited to the aspects presented herein. In some aspects, the hinge 22 can be configured such that the hinge base 27 is proximate the playing surface. At this point, the at least one rod 26 is ready to be installed.

The base structure 12 is further adapted to receive the at least one rod 26. In one aspect, the base structure 12 comprises at least one shaft 31 extending substantially vertically and configured to receive one of the at least one rod 26. In another aspect, the base structure 12 comprises a plurality of shafts 31, wherein each respective shaft 31 is adapted to receive a respective one of the at least one rod 26. In the aspect of FIG. 1, the base structure 12 comprises two shafts 31, with one shaft 31 coupled to the first base extension 18 and another shaft 31 coupled to the second base extension 20. As shown in FIG. 1, each of the shafts 31 are coupled to a respective base extension 18, 20 proximate the first end 15 of the first and second support portions 14, 16. However, in other aspects, the shaft 31 can be positioned at various other locations on the base extensions 18, 20 and/or the support portions 14, 16, or a combination thereof. In yet other aspects, the base structure 12 can comprise more than two shafts 31 for aspects that comprise more than two rods 26. The number of shafts 31 present will be equal to the number of rods 26.

The at least one rods 26 are configured to be securely held within the shaft 31, such that the shaft 31 maintains a stable structural connection between the shaft 31 and the at least one rods 26 and prevents the rod 26 from being removed from the shaft 31 when the ball net structure 10 is assembled. In one aspect of the disclosure, the shaft 31 is similarly shaped as the rod 26, such as but not limited to cylindrically shaped, and is slightly larger than the rod 26 such that the rod 26 can easily be received by the shaft 31. The shaft 31 can further comprise a sheath contacting the inner wall of the shaft 31 that receives the rod 26. The sheath is adapted to protect the rod 26 within the shaft 31 from forces exerted on the rod 26 when the ball net structure 10 is fully assembled. As will be discussed below, upon assembly of the ball net structure 10, the rods 26 experience a moment force at the point where the rod 26 is received by the shaft 31, and causes the rod 26 to exert a compression force upon the sheath. The sheath thereby protects the rod 26 from the forces exerted on and/or by the rod 26.

In other aspects, the shaft 31 can be shaped such that the radius of the shaft 31 decreases the further the rod 26 is inserted into the shaft 31. In this arrangement, the shaft 31 uses a compression force to form the structural connection between the shaft 31 and the rod 26. In other aspects, mechanical devices, such as but not limited to, screws, nuts, nails, rivets or the like, can be used to form the structural connection so as to securely attach the rod 26 to the shaft 31. In yet other aspects, the rods 26 can be configured to have an attachment means such that the rods 26 can be attached to the shaft 31; non-limiting examples of such attachment means are the rods 26 being threaded and screwed into the shaft 31 or the rod 26 and shaft 31 configured similarly like a bayonet-type locking device.

In the aspect of FIG. 1, the rods 26 are circularly shaped and the shaft 31 is also correspondingly circularly shaped to receive the rod 26. The shape of the rod 26 and shaft 31 is not intended to be limited to a circular shape, other shapes such as quadrilateral, triangular, or any other polygonal shape can be used. The shaft 31 can also be similarly shaped as the rod 26, but in some aspects, the shaft 31 can be shaped differently than the rod 26. The rods 26 can be made of many different materials known in the art, such as but not limited to fiberglass or carbon fiber, such that the rods 26 are flexible, elastic, capable of returning to an initial form or state after deformation, and able to withstand the impact forces applied by sports-related balls and/or other projectiles that can be captured or caught by the ball net structure 10, or thrown, kicked, and/or hit towards the ball net structure 10.

The rods 26, when received by the shaft 31 flare outwards, such that the rods 26 are in a relaxed state and are substantially straight. A net 30 comprising at least one sleeve 33 is arranged to receive the at least one rod 26 and is adapted to exert a force on the at least one rod 26 bending the at least one rod 26 into a flexed state. Inserting the at least one rod 26 into the sleeve 33 results in the at least one rod 26 being bent from the relaxed state into a flexed state. As shown in FIG. 1, when both rods 26 are received by the respective shaft 31 and the net 30, both rods 26 are bent inwards towards the opposing rod and into the flexed state. Removal of the net 30 allows the rods 26 to return to their original form of the relaxed state. Repeated use of the ball net structure 10 does not result in the rods 26 being permanently bent in a shape similar to that of the flexed state. The net 30 can be easily installed and removed by a single individual.

The net 30 imparts a pulling force on each of the rods 26 which causes each of the rods 26 to bend in a direction towards the hinge 22. Once bent towards the hinge 22, the rods 26 are in the flexed state and experience a moment force about its pivot point. The pivot point of each of the rods 26 corresponds to the point at which the rods 26 are received by the shaft 31. The moment force experienced by the rods 26 is imparted onto the hinge 22 and the first and second support portions 14, 16 of the base structure 12, with the transferred force being greatest at the hinge 22. This transferred force further assists in locking the hinge 22 and base structure 12, such that the first and second support portions 14, 16 are locked into place.

An advantage of the disclosure is that the force exerted onto the rods 26 by the net 30 results in a torque force experienced by the rods 26 and transferred to the hinge 22, which allows the hinge 22 to lock the first and second support portions 14, 16 into place without the need of a locking device such as a locking clip or button. The absence of such a locking device on the hinge 22 prolongs the lifetime of the ball net structure 10 due, in part, to the hinge 22 not deteriorating or breaking down due to failure or malfunctioning of the locking clip or button.

Figure 4:
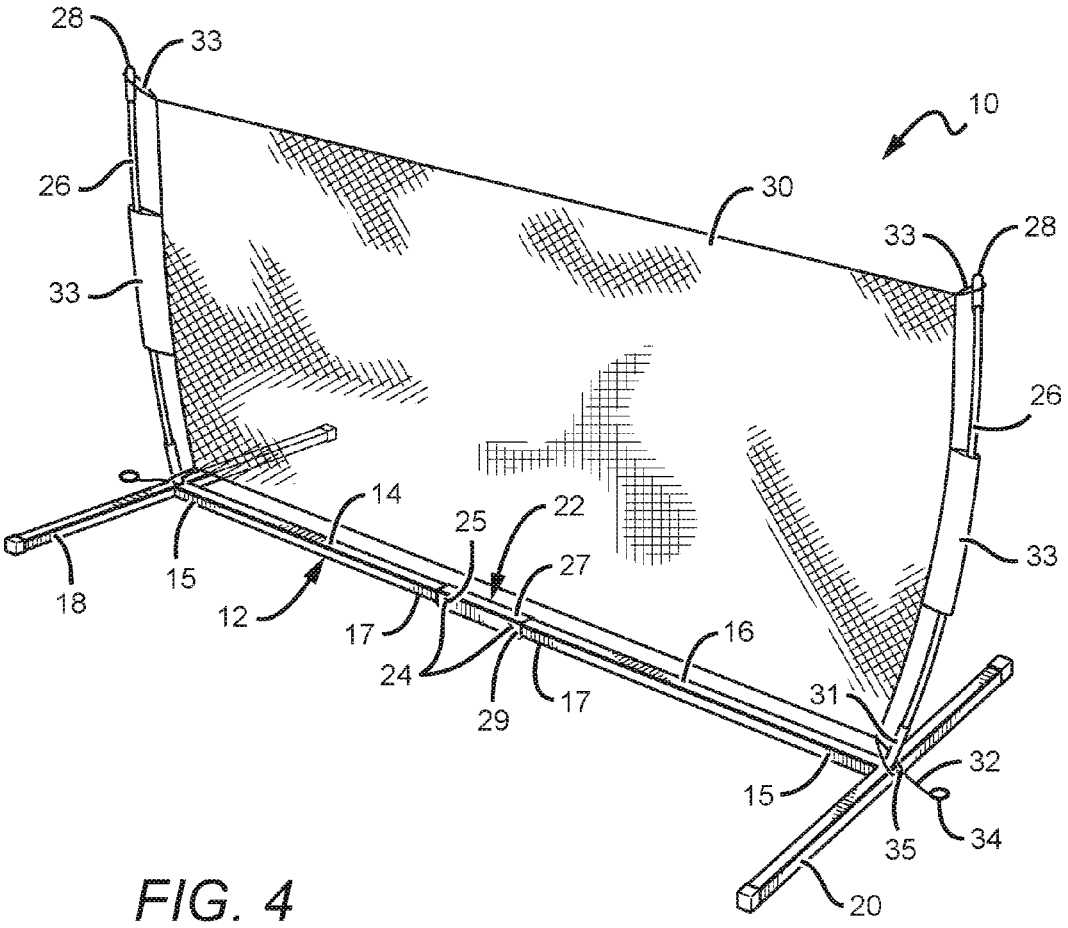
FIG. 4 is a perspective view of a ball net structure according to an aspect of the disclosure.

The net 30 can be a mesh surface or any typical net known in the art. The net comprises at least one sleeve 33 adapted to receive the rod 26 so as to mount the net 30 onto the rods 26. The aspect of FIG. 1 shows the net 30 having a sleeve 33 in the form of a plurality of loops that receive the rods 26. However, in other aspects, such as FIG. 4, the net 30 comprises a plurality of sleeves 33 wherein at least one of the plurality of sleeves 33 receives the base structure 12, in order to provide additional structural support for the ball net structure 10. The sleeve 33 can be configured in many different ways, such as but not limited to a sleeve that spans the length of the rod, a plurality of smaller sleeves that are spaced apart from each other and run along the length of the rods 26, or a sleeve that spans along a partial length of the rods 26. In some aspects, each rod 26 comprises an endcap 28 opposite the portion of the rod 26 that is received by the shaft 31 and is configured to receive at least a portion of the sleeve 33, such that the endcap 28 prevents the sleeve 33 from coming off the rods 26 while the ball net structure 10 is assembled and/or in use. In one aspect, the endcaps 28 can have a tab that extends outward beyond the external shape of the rod 26 that prevents the net 30 from coming off the rod 26. However, in other aspects, the endcaps 28 can have other means of preventing the net 30 from coming off the rod 26, such as but not limited to a hook, loop, locking clip, or the like.

The ball net structure 10 according to the disclosure is designed to withstand the force of a ball or other projectile so as to catch or capture the ball, such that the ball net structure 10 maintains an upright standing position. In some aspects of the disclosure, the ball net structure 10 can comprise at least one attachment device 35 that can receive an attachment cord 32 having a ring 34. The attachment cord 32 allows for the connection of a weight, stake or similar device to provide additional support for the ball net structure 10. In the aspect of FIG. 1, the attachment device 35 is a loop-like device that is coupled to the base structure 12 and allows the attachment cord 32 to be tied or coupled to the attachment device 35. The attachment cord 32 can be a bungee cord, rope, or the like. The ring 34 allows for a weighted or force-resistant device (not shown), such as but not limited to a sandbag or a suction cup, to be attached to the base structure 12 to provide additional support for the ball net structure 10 and prevent the ball net structure 10 from moving, falling over, or shifting. The ring 34 can also be used to receive a stake, staple, hook or similar device that is inserted into the ground or surface so as to attach the ball net structure 10 to the ground or surface.

The attachment device 35 is configured to extend laterally or horizontally from the base structure 12, such that the weight or similar device attached to the cord 32 provides a lateral support, which prevents the ball net structure 10 from lifting upwards or shifting its position. In some aspects, the net 30 can be received by the attachment device 35, such that the sleeve 33 of the net 30 is coupled to the attachment device 35. The attachment device 35 allows for both the sleeve 33 and the cord 32 to be coupled to the attachment device 35. An advantage of this arrangement is that the weight or similar device attached to the attachment device 35 can also act as a shock absorber when a ball or projectile is caught or captured by the ball net structure 10. The force of the ball is distributed throughout the ball net structure 10 and also partially transferred to the weight or device attached to the attachment device 35, which further provides additional support to the ball net structure 10 which increases the stability and/or the force the ball net structure 10 can withstand. In other aspects of the disclosure, the ball net structure 10 comprises a plurality of attachment devices 35 and can be disposed on the base structure 12 and/or on base extensions 18, 20.

Figure 5:
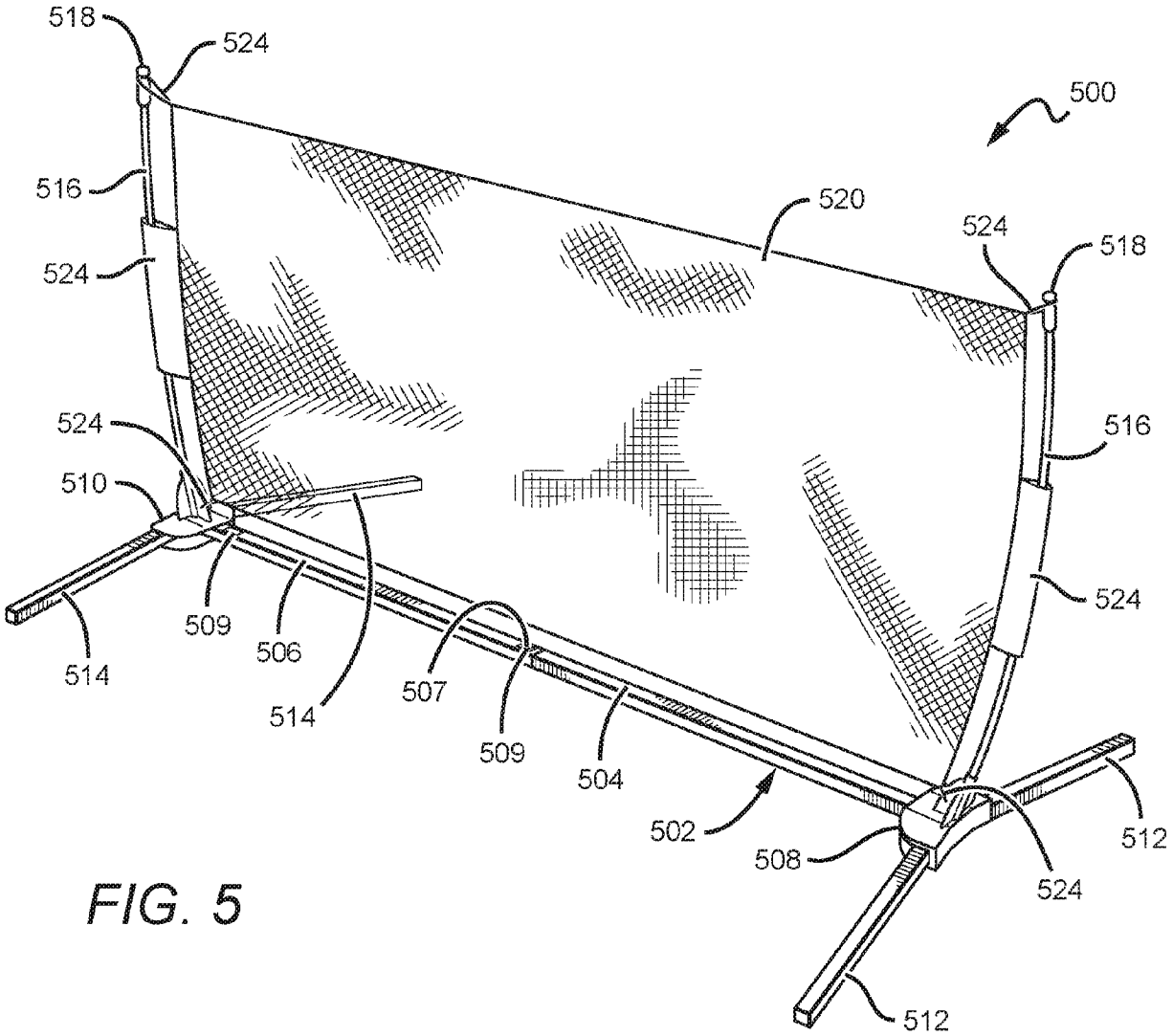
FIG. 5 is a perspective view of a ball net structure according to an aspect of the disclosure.
Figure 6:
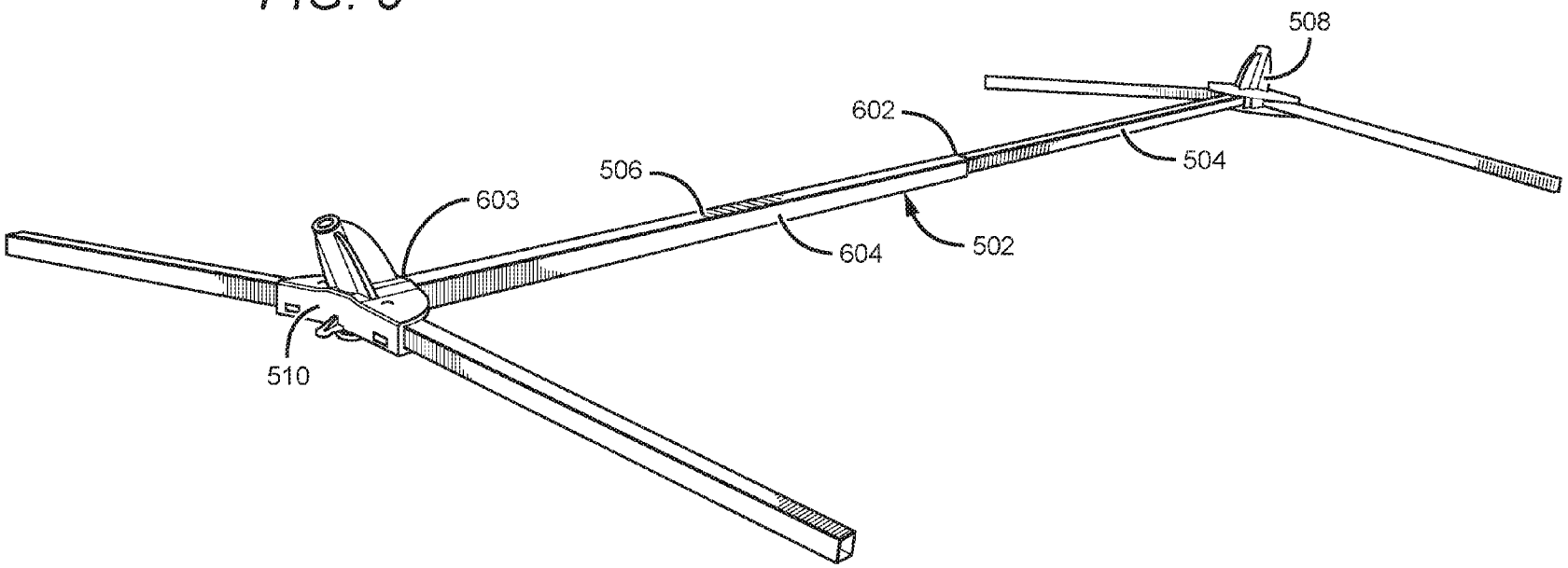
FIG. 6 is a perspective view of a base structure according to an aspect of the disclosure.

FIG. 5 shows one aspect of a ball net structure 500 according to the disclosure.

The ball net structure 500 comprises a base structure 502 comprising a first support portion 504, a first base extension 512, and a first base extension hinge 508, wherein the first support portion 504 and first base extension 512 are coupled to the first base extension hinge 508. The base structure 502 further comprises a second support portion 506, a second base extension 514, and a second base extension hinge 510, wherein the second support portion 506 and second base extension 514 are coupled to the second base extension hinge 510. The first support portion 504 is configured to receive the second support portion 506, such that the second support portion 506 is removably coupled to the first support portion 504. At least one rod 516 is removably coupled to the base structure 502 and is received by a net 520. The net 520 is adapted to exert a pulling force on the at least one rod 516 such that the at least one rod 516 is in a flexed state. The first and second base extensions 512, 514 are adapted to support the load of the ball net structure 500 and allow the ball net structure 500 to remain upright on a surface. The first and second base extensions 512, 514 absorb at least part of the load exerted onto the ball net structure 500 from a ball or other projectile when in use so as to maintain the ball net structure 500 in an upright position.

In one aspect, as shown in FIGS. 6-9, the first support portion 504 is configured to receive the second support portion 506, such that the second support portion 506 is removably coupled to the first support portion 504. In one aspect, the second support portion 506 can be hollow and comprise an open end 602 that allows part of the first support portion 504 to be at least partially inserted the open end 602 and at least partially received within the second support portion 506. In some aspects, the second support portion 506 can comprise a hollow cavity 604 extending from the open end 602 to an opposing end 603 of the second support portion 506 that is received by the second base extension hinge 510. In some aspects, the hollow cavity 604 can extend various lengths from the open end 602 and is not intended to be limited to the aspects disclosed herein. The second support portion 506 being hollow allows the positioning of the first support portion 504 within the second support portion 506 to be adjustable. In some aspects, the position of the first support portion 504 can be adjusted by sliding the first support portion 504 within the hollow cavity of the second support portion 506.

The position of the first support portion 504 within the second support portion 506 can be secured such that the first support portion 504 and second support portion 506 are coupled. In one aspect, the first support portion 504 comprises a locking pin 507 and the second support portion 506 comprises a plurality of openings 509, wherein the locking pin 507 engages one of the plurality of openings 509 to couple the first and second support portions 504, 506 together. The locking pin 507 securely fastens the first and second support portions 504, 506 and maintains the structural connection between the first and second support portions. In one aspect, the locking pin 507 can be a push button pin within the first support portion 504, wherein the push button pin is depressed to release the connection of the locking pin and the opening 509, allowing the first support portion 504 to be removably coupled to the second support portion 506. In other aspects, the locking pin 507 can be a pin that is external to the first support portion 504 that is inserted into one of the plurality of openings 509 to couple the first and second support portions 504, 506. In such aspect, the first and second support portion 504, 506 can comprise a plurality of openings 509 wherein the pin is inserted into aligned openings 509 of the first and second support portions 504, 506 to couple the first and second support portions 504, 506. In other aspects, the locking pin can be a screw, stake, or the like. The disclosure is not intended to be limited to a locking pin, and can be configured in many different ways, such that the second support portion and the first support portion are coupled.

The first and second support portions 504, 506 can be configured in many different ways and are not intended to be limited to the aspects disclosed herein. For example, in one aspect, the first support portion 504 can be coupled to an exterior surface of the second support portion 506, wherein the first support portion can be secured along different points of the outer surface of the second support portion. In yet other aspects, an intervening structure could be present to connect the first and second support portions 504, 506 together, such as but not limited to the hinge 22 of FIG. 1 discussed above, or a hinge similar to the base extension hinge 508 discussed herein. The first support portion 504 and/or the second support portion 506 can be permanently coupled to the intervening structure or removably coupled to the intervening structure, while yet being able to adjust the positioning of either first support portion or the second support portion with respect to the intervening structure and/or the opposing support portion. In some aspects, the first and/or second support portions can be telescopic support portions such that each can comprise one or more portions that can extend and/or retract such that the size of the first and/or second support portion can be adjusted.

Figure 7:
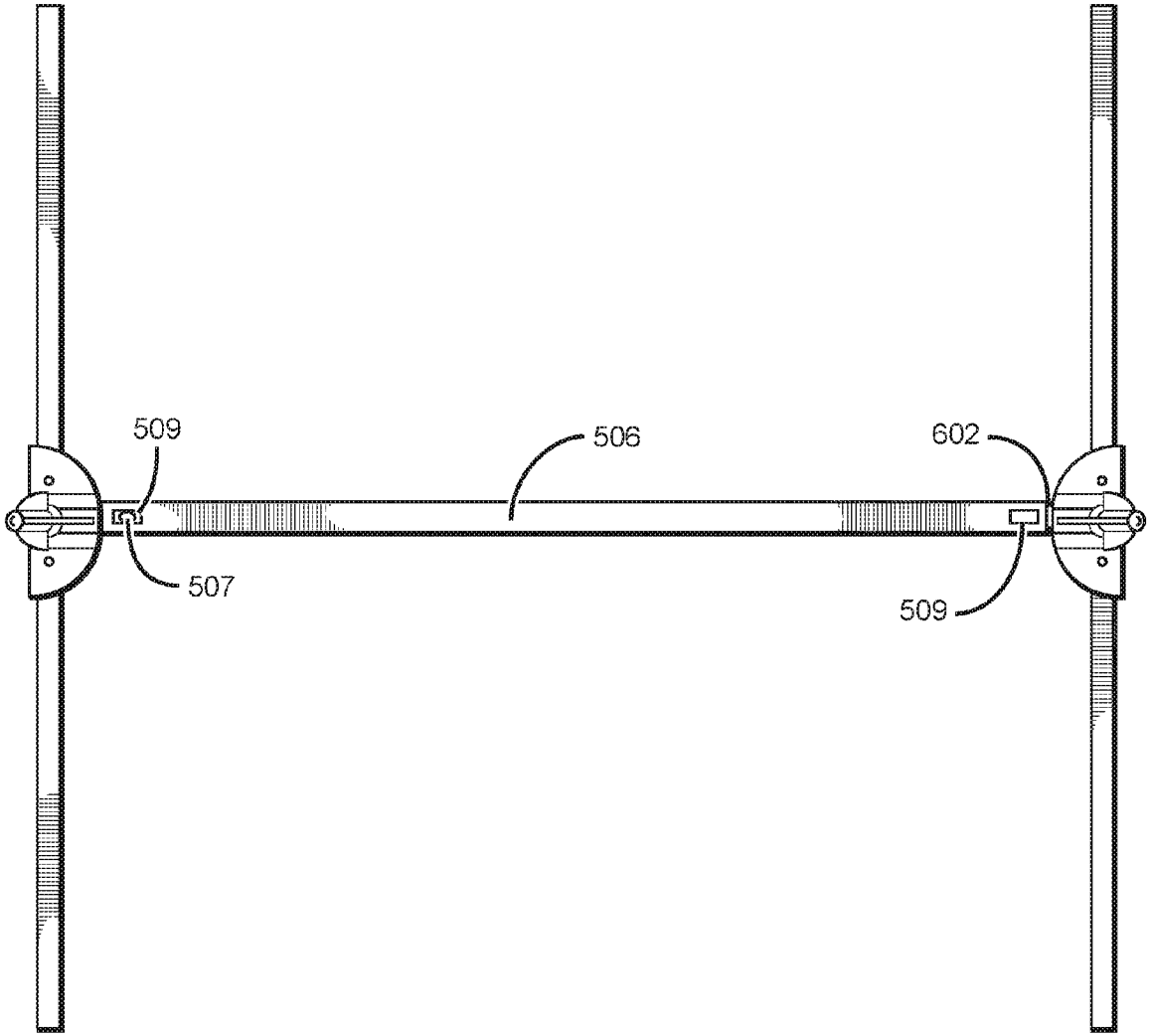
FIG. 7 is a top plan view of the base structure of FIG. 6.
Figure 8:
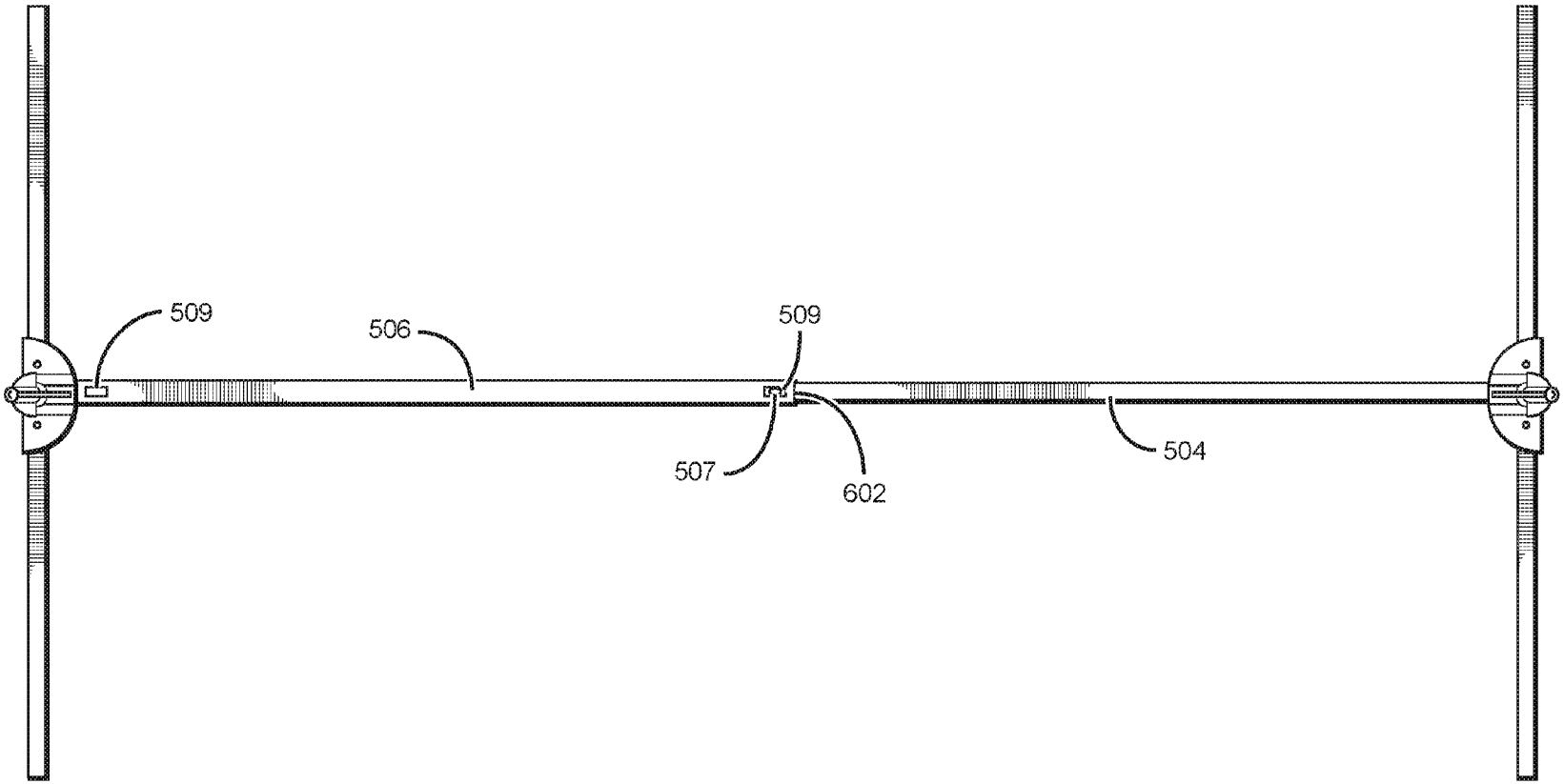
FIG. 8 is another top plan view of the base structure of FIG. 6.
Figure 9:
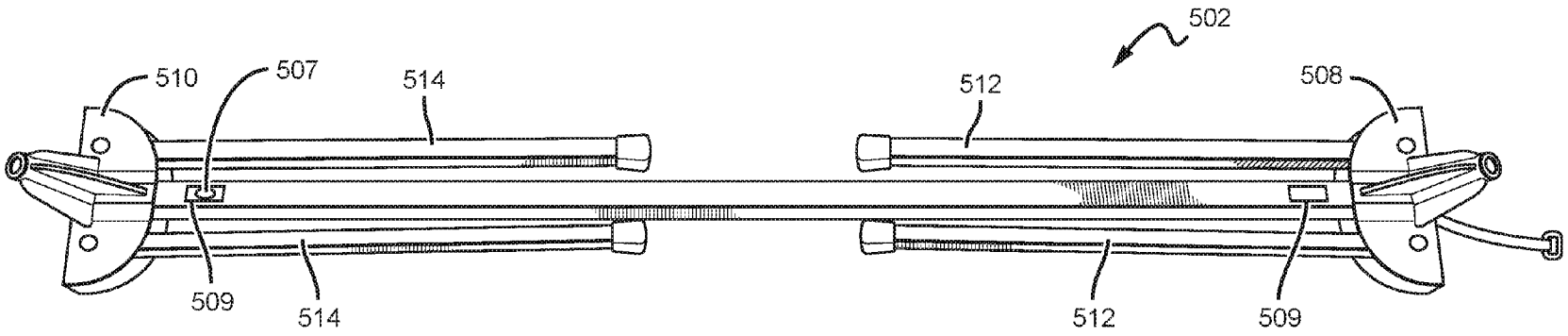
FIG. 9 is another top plan view of the base structure of FIG. 6.

In one aspect, the first and second support portions 504, 506 are axially aligned along the same axis, such that the first support portion 504 is received within the second support portion 506. The positioning of the first and second support portions can be adjusted by sliding at least one of the first and/or second support portions with respect to the other support portion. For example, in the aspect of FIG. 7, the first support portion 504 is received within the second support portion 506, wherein the locking pin 507 is engaged with the opening 509 that is opposite the open end 602 of the second support portion 506. Disengaging the locking pin 507 from the opening 509 allows the positioning of the first support portion 504 within the second support portion 506 to be adjusted. With reference to FIG. 8, the first support portion 504 can be adjusted to be removably coupled to the second support portion 506 at the opening 509 proximate the open end 602 of the second support portion 506. In the aspect of FIG. 7, the first and second support portions 504, 506 are locked in a first configuration. The configuration can be altered by adjusting the positioning of the first support portion within the second support portion, such that the first and second support portions are locked in a second configuration, as shown in FIG. 8. The positioning of the first support portion 504 within the second support portion 506 can be easily adjusted by disengaging the locking pin 507 from the at least one openings 509 and engaging the locking pin 507 in the desired at least one openings 509. The adjustability of the first and second support portions 504, 506 allows the base structure to be configured into different sizes, thereby allowing different nets to be used with the ball net structure. In the aspect of FIG. 7, the size of the base structure is smaller in comparison to the size of the base structure shown in FIG. 8. The first support portion 504 can be easily adjusted from the configuration disclosed in FIG. 8 back to the configuration disclosed in FIG. 7 by disengaging the locking pin 507 and sliding the first support portion 504 into the second support portion 506 and engaging the locking pin 507 with the opening 509 that is opposite the open end 602 of the second support portion 506.

The first and second support portions 504, 506 can be configured in many different ways and are not intended to be limited to the aspects disclosed herein. In the aspects of FIGS. 7 and 8, the second support portion 506 comprises two openings 509, but in other aspect, the second support portion 506 can comprise a plurality of openings 509 such that the first support portion 504 can be coupled to the second support portion at any one of the plurality of openings. In yet other aspects, the respective lengths of the first and second support portions can be the same and/or different. In yet other aspects, the first and second support portions are not axially aligned. The first and second support portion can be arranged in many different ways and are not intended to the aspects disclosed herein. For example, the first and second support portions can be parallel with respect to each other, while in other aspects, the first and second support portions could be arranged at an angle with respect to each other. In yet other aspects, the position of the first support portion can be adjusted with respect to the second support portion while not being received by the second support portion.

At least one advantage of the disclosure is the ability to alter the configuration of the base structure. The configuration of the base structure can be altered, in part, due to the positioning of the first and second support portions 504, 506 being adjustable. The adjustability of the positioning of the first and second support portions allows the first support portion to be secured along different openings of the second support portion, thereby allowing the base structure to be adjusted to different sizes. The base structure being adjustable to different sizes allows the ball net structure to be used with nets of different sizes and/or configurations. The base structure is compatible with various sized nets that can be used for different activities. In some aspects, the separation of the first and second base extension hinges can be determined, in part, by the length of the first and/or second support portions and/or by the positioning of the first support portion within the second support portion. In the aspects of FIGS. 7 and 8, the first and second support portions are similar in length and the separation of the first and second base extension hinges is altered by adjusting the positioning of the first support portion within the second support portion. In some aspects, the nets that are compatible with the disclosure are based, in part, by the separation of the first and second base extension hinges. However, in other aspects, the nets compatible with the disclosure do not depend on the separation of the first and second base extension hinges. Typically, nets are used with a dedicated frame structure that is only intended to be used with one type of net, and is not able to be adjusted so that a different net can be used on the dedicated structure. As such, users would have to purchase multiple dedicated net framing structures each using a different net for different sports-related activities and/or training, which can be costly. The disclosure allows different nets to be used on the same base structure by adjusting the base structure as needed, so that users would only have to purchase the nets and not multiple framing structures of the net.

The base structure 502 of the ball net structure 500 comprises a first base extension hinge 508 and a second base extension hinge 510. The first and second base extension hinges 508, 510 receive the respective first and second support portions 504, 506, as shown in FIG. 5. The first and second base extension hinges 508, 510 further receive the respective first and second base extensions 512, 514, as also shown in FIG. 5. In the aspect of at least FIG. 5, the base structure 502 comprises two first base extensions 512 and two second base extensions 514, but it is understood that the base structure can comprise one or more first base extensions and/or one or more second base extensions and is not intended to be limited to the aspects disclosed herein.

The first and second base extension hinges 508, 510 can be substantially similar. As such, a discussion of the first base extension hinge 508 will be presented herein with the understanding that such disclosure can be applicable to the second base extension hinge 510, in an effort to reduce duplicate descriptions. However, the disclosure does not require the first and second base extensions hinges to be identical. In some aspects, the first and/or second base extension hinge 508, 510 can comprise some of the same elements disclosed herein. While in other aspects, the first and/or second base extension hinges do not necessarily comprise some of the same elements of the other base extension hinge(s). Additionally, the first and second base extensions 512, 514 can be substantially similar, and the following discussion referring to the first base extension 512 is understood to be applicable to the second base extension 514. However, the first and second base extension do not have to be identical. In some aspects, the first and/or second base extensions 512, 514 can comprise some of the same elements disclosed herein, while in other aspects, the first and/or second base extensions do not comprise some of the same elements of the other base extension(s).

Figure 10:
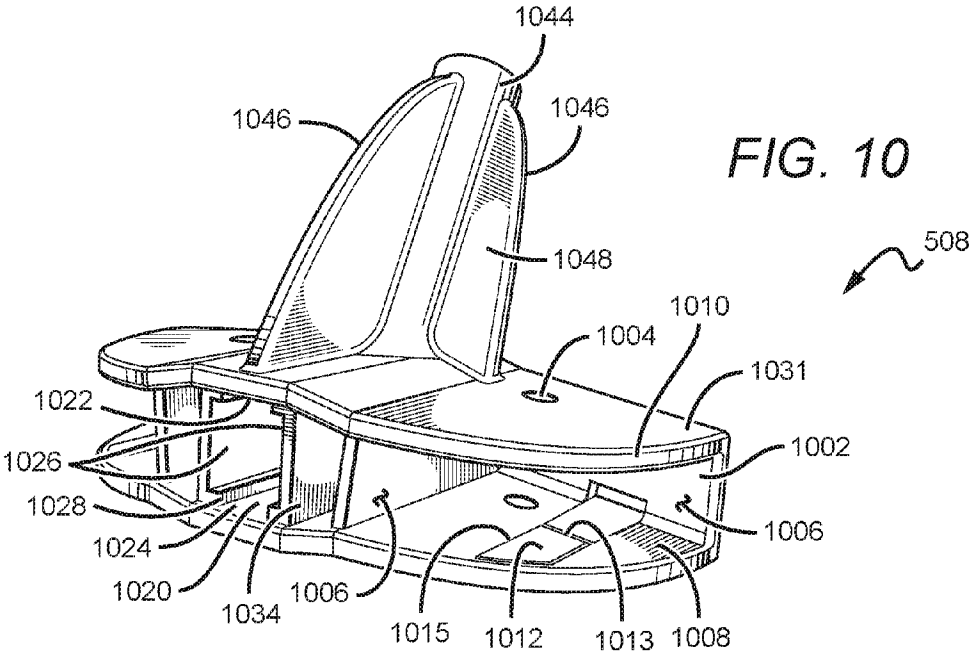
FIG. 10 is a perspective view of a base extension hinge according to an aspect of the disclosure.
Figure 12:
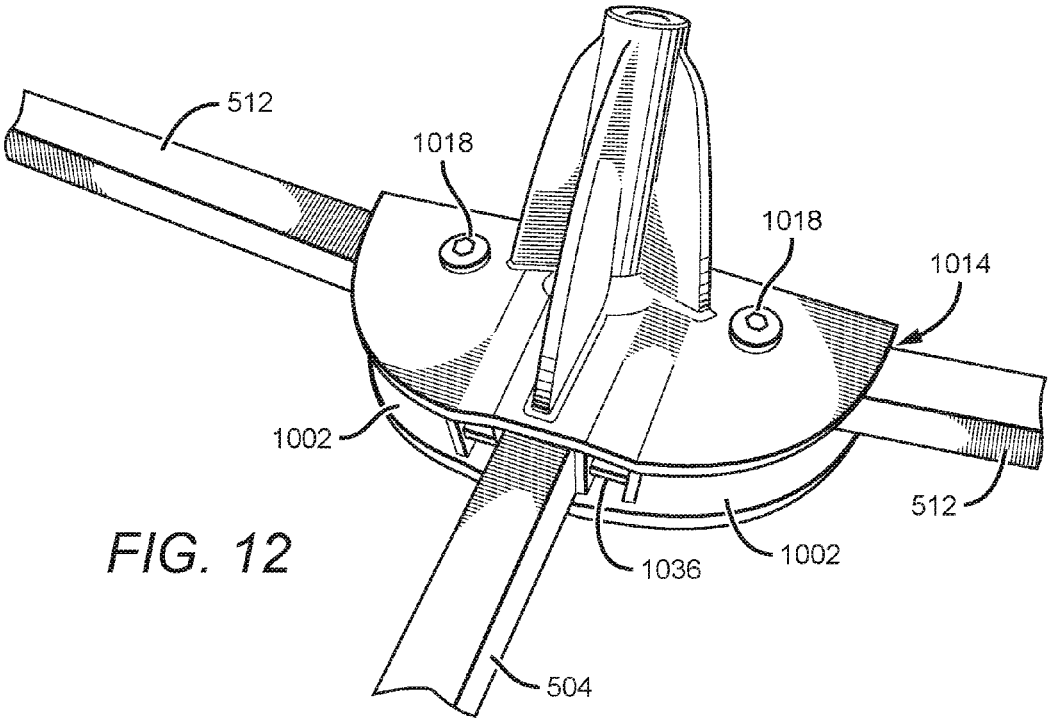
FIG. 12 is a perspective view of a base structure according to an aspect of the disclosure.
Figure 13:
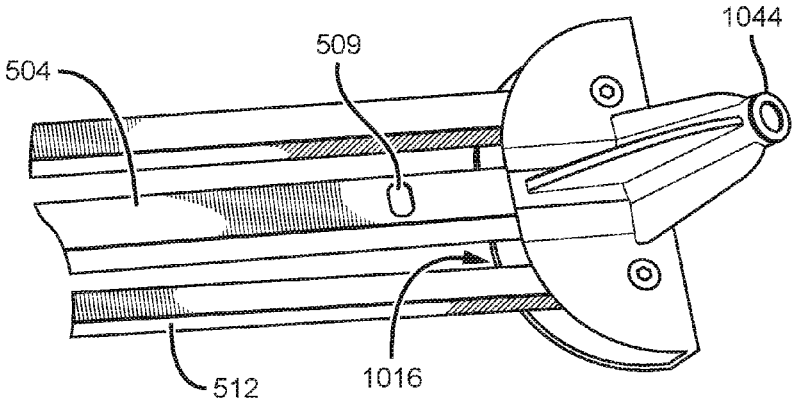
FIG. 13 is a perspective view of a base structure according to an aspect of the disclosure.

The first base extension hinge 508, as shown in FIG. 10, comprises at least one groove 1002 and a pivot 1004, wherein part of the first base extension 512 is received in the at least one groove 1002 and coupled to the first base extension hinge 508 such that the first base extension 512 can pivot about the pivot 1004 within the at least one groove 1002. The at least one groove 1002 comprises at least one groove sidewall 1006, a groove base 1008 and a groove top 1010, wherein the at least one sidewall 1006 at least partially defines the range of which the first base extension 512 can pivot within the at least one groove 1002. The first base extension hinge comprise a stop 1012 that assists in preventing substantial movement of the first base extension 512 within the at least one groove 1002. In some aspects, the stop 1012 maintains the positioning of the first base extension 512 while positioned at the ends of the range of pivot motion within the groove 1002, such that the first base extension 512 is secured and does not freely move. In one aspect, the range of pivot motion can comprise an opened end 1014 wherein the first base extension 512 is deployed, as shown in FIG. 12, and a closed end 1016 wherein the first base extension 512 is retracted and proximate the first support portion 504, as shown in FIG. 13. The stop 1012 provides an obstacle or physical structure to maintain the positioning of the first base extension 512 at either the opened end 1014 or the closed end 1016. The stop 1012 can be shaped to partially correspond to part of the first base extension 512 received within the groove 1002. In some aspects, the stop 1012 comprises a first edge 1013 that is proximate the first base extension 512 when positioned at the opened end 1014. In some aspects, the stop 1012 can comprise a second edge 1015 that is proximate the first base extension 512 when positioned at the closed end 1016. The stop 1012 comprises an elevated or raised surface with respect to the groove base 1008 such that the first and second edges 1013, 1015 provide a physical barrier that assists to maintain the first base extension 512 at either the opened end 1014 or the closed end 1016. The stop 1012 prevents the first base extension 512 from freely moving within the groove 1002, and assists in stabilizing the base structure 502. In some aspects, the first and second edges 1013, 1015 extend from the groove base 1008 to the same height. While in other aspects, the first and second edges 1013, 1015 extend from the groove base 1008 to different heights. In some aspects, at least part of the first and second edges 1013, 1015 can contact part of the first base extension 512 to maintain the position of the first base extension 512. The stop 1012 provides resistance to prevent slight movement of the first base extension 512, but does not prevent the first base extension 512 from moving between the opened end 1014 and the closed end 1016. The stop 1012 can be configured in many different ways and is not intended to be limited to the aspects disclosed herein. In the aspect of FIG. 10, each groove 1002 comprises one stop 1012 on the groove base 1008. However, in other aspects, each groove 1002 can comprise one or more stops 1012 on the groove base 1008. In some aspects, one or more stops 1012 can be on the at least one groove sidewall 1006, the groove base 1008, the groove top 1010, or a combination thereof.

When the first base extension 512 is positioned at the closed end 1016 of the groove 1002, the base structure 502 is in a closed state and in condition to be stored for later use. When the first base extension 512 is positioned at the opened end 1014 of the groove 1002, the base structure 502 is in a deployed condition and ready to be used. The range of pivot motion of the first base extension 512 is not intended to be limited to the aspects described herein. For example, the range of pivot motion of the first base extension 512 between the closed end 1016 and the opened end 1014 within the groove 1002 can range from about 0 to 90 degrees. However in some aspects, the range of pivot motion of each and/or some of the base extension from the closed end to the opened end of the respective groove can range from about 0 to 180 degrees. In some aspects the range of pivot motion of the base extensions can be the same, while in other aspects the range of pivot motion can be different for the base extensions.

The first base extension 512 is coupled to the first base extension hinge 508 by a pin 1018, such that the first base extension 512 is adapted to pivot within the groove 1002 about the pivot 1004. In the aspects of FIGS. 12 and 13, the first base extension hinge 508 comprises two grooves 1002, two pins 1018 and two first base extensions 512, wherein a respective first base extension 512 is partially received within a respective groove 1002 and coupled to the first base extension hinge 508 by a respective pin 1018. In the aspects of FIGS. 12 and 13, each pin and base extension are opposite each other. In other aspects, the base extension hinge can comprise any number of base extensions and/or grooves, and is not intended to be limited to the aspects disclosed herein.

Figure 15:
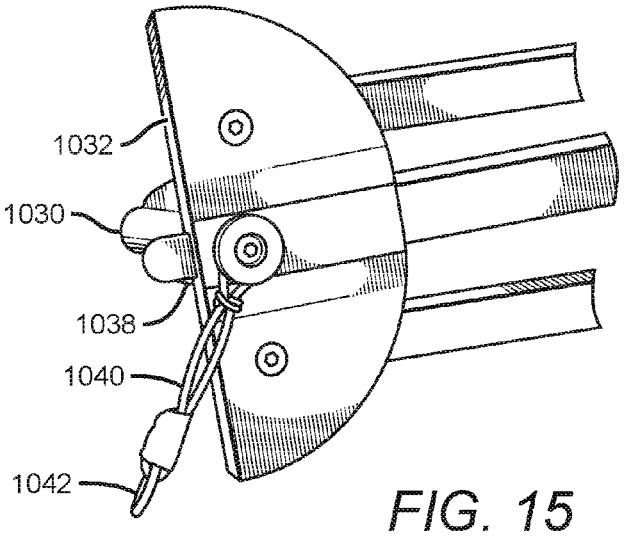
FIG. 15 is a bottom view of a base structure according to an aspect of the disclosure.
Figure 18:
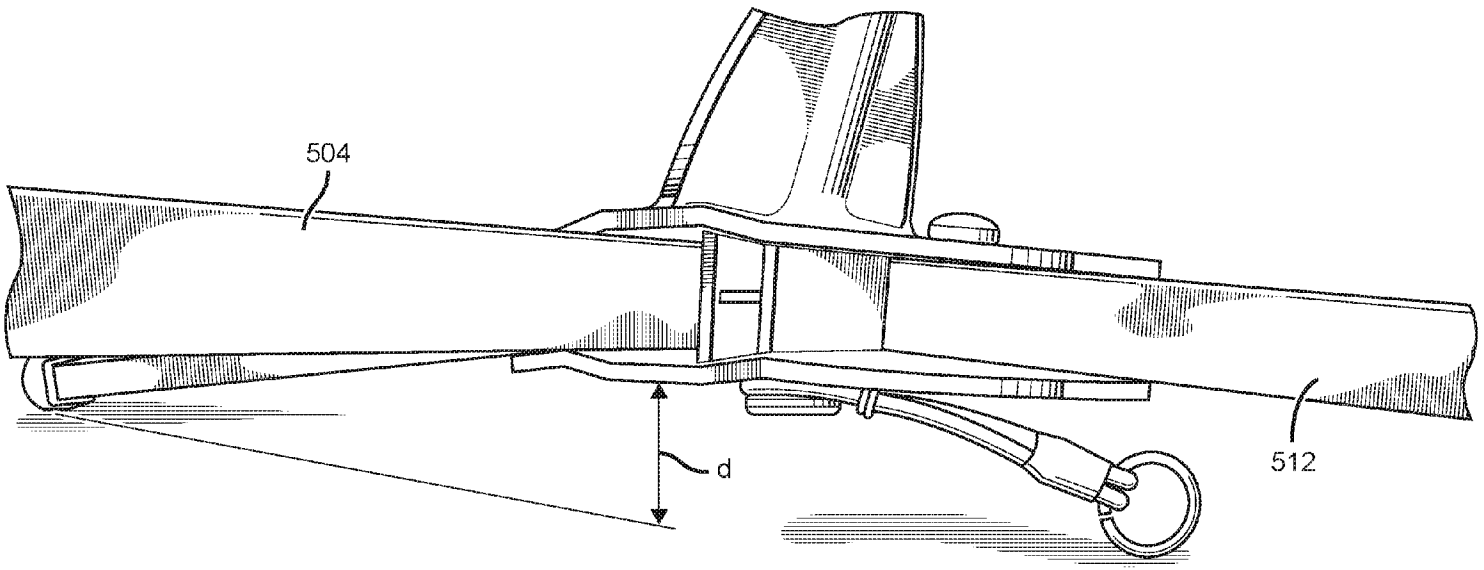
FIG. 18 is a side view of a base structure according to an aspect of the disclosure.

The first base extension hinge 508 further comprises a channel 1020 to receive the first support portion 504, as shown in FIG. 12. The channel 1020 comprises a top 1022, a base 1024, and sidewalls 1026 wherein the channel 1020 is proximate the at least one groove 1002 of the base extension hinge 508. In the aspect of FIG. 10, the first base extension hinge 508 comprises two grooves 1002 opposite each other with the channel 1020 interposed between the opposing grooves 1002. In some aspects, the channel 1020 can comprise at least one rib 1028 within the channel 1020 to assist in securing the first support portion 502 within the channel 1020. In some aspects, the at least one rib 1028 can be arranged within the channel 1020 such that the channel 1020 can accommodate the dimensions of the first support portion 504 that is received within the channel 1020, as shown in FIG. 18. In other aspects, the at least one rib 1028 can be arranged within the channel 1020 such that part of the first support portion 504 received within the channel 1020 at least partially contacts at least one of the top 1022, base 1024, sidewall 1026, and/or a combination thereof. The at least one rib 1028 at least partially extends along the length of the channel 1020. The at least one rib 1028 can be a continuous rib, while in other aspects, the at least one rib 1028 can comprise a plurality of ribs that are separated and aligned to form the at least one rib. In some aspects, the channel 1020 can comprise a plurality of ribs 1028 that contact part of the first support portion 504 that is received in the channel 1020 such that the plurality of ribs 1028 prevent the first support portion 504 from shifting and/or moving while in the channel 1020. In one aspect, the at least one rib 1028 can be at the intersection of the sidewall 1026 and the top 1022 and/or base 1024. However, the at least one rib 1028 can be arranged in many different locations within the channel 1020 and is not intended to be limited to the aspects described herein. In some aspects, the at least one rib 1028 can be on a sidewall 1026, the top 1022, the base 1024, or a combination thereof. In some aspects, the channel 1020 can comprise at least one rib 1028 at an intersection of the top 1022 and the sidewall 1026, the base 1024 and the sidewall 1026, the top 1022, the base 1024, the sidewalls 1026, or a combination thereof. The first base extension hinge 508 can further comprise a channel lock pin 1030 to couple the first support portion 504 within the channel 1020, as shown in FIG. 15. The channel lock pin 1030 in the aspect of FIG. 15 is disclosed as being at a bottom surface 1032 of the first base extension hinge 508. However, the channel lock pin 1030 is not intended to be limited to the aspects described herein. In some aspects, the channel lock pin 1030 can be at the top surface or any other surface of the first base extension hinge 508 in order to couple the first support portion 504 within the channel 1020.

Figure 14:
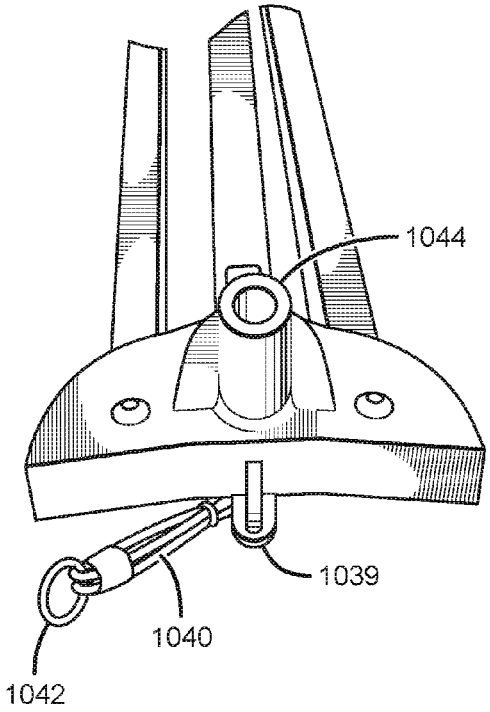
FIG. 14 is a side view of a base structure according to an aspect of the disclosure.

The first base extension hinge 508 can further comprise at least one cavity 1034, wherein the at least one cavity 1034 is interposed between the groove 1002 and the channel 1020. In the aspect of FIG. 10, the first base extension hinge 508 comprises two cavities 1034, wherein each cavity 1034 is interposed between the channel 1020 and a respective groove 1002. The cavity 1034 provides a separation between the channel 1020 and the groove 1002 to allow for the first support portion 504 to be separated from the first base extension 512 when the first base extension 512 is positioned in the closed end 1016 within the groove 1002. With reference to FIGS. 13-14, the separation between the first support portion 504 and the first base extension 512 prevents the first base extension 512 from hitting and/or striking the first support portion 504 when being positioned into and/or when positioned in the closed end 1016. The separation assists in preventing damage to either the first support portion 504 and/or the first base extension 512, which can prolong the durability of the ball net structure 500. In some aspects, the at least one cavity 1034 can comprise at least one bridge 1036, as shown in FIG. 12. The at least one bridge 1036 can extend between the channel 1020 and the groove 1002. The at least one bridge 1036 can provide further structural support to the first base extension hinge 508, and assist the first base extension hinge 508 in withstanding loads and/or forces exerted onto the ball net structure 500.

Figure 19:
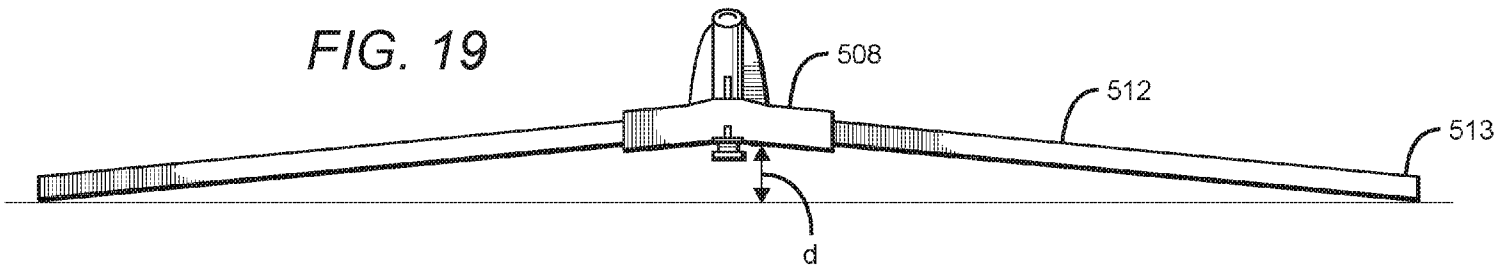
FIG. 19 is a side view of a base structure according to an aspect of the disclosure.

FIGS. 18 and 19 show an aspect of the first base extension hinge 508, wherein the first base extension hinge 508 is angled such that when the at least one first base extension 512 is deployed, at least the first base extension hinge 508 is raised off the ground or surface a distance "d" and part of the at least one first base extension 512 is on the ground or surface. In one aspect, the at least one groove 1002 of the first base extension hinge 508 is set at an angle towards the ground or surface. As a result, the first support portion 504 and the first base extension hinge 508 of the base structure 502 are raised off the ground or surface by at least the distance "d" while part of the at least one first base extension 512 is on the ground. In some aspects, a base extension end 513 of the first base extension 512 is opposite the first base extension hinge 508 and contacts the ground or surface when the first base extension 512 is deployed, as shown in FIG. 19. However, in some aspects, at least a portion of the first base extension 512 contacts the ground or surface when deployed. The angle of the at least one groove 1002 can be set at any degree towards the ground or surface, and in some aspects can be within a range of 0 to 90 degrees. In the aspects of FIGS. 18 and 19, the first base extension hinge 508 comprises two grooves 1002 and two first base extensions 512, wherein each groove 1002 is angled such that the first base extension hinge 508 and first support portion 504 are raised off the ground when the first base extensions 512 are deployed. The disclosure is not intended to be limited to the aspects disclosed herein. In other aspects, the first base extension hinge 508 can comprise one or more grooves 1002. In such aspects, the one or more grooves 1002 can be angled with respect to the surface, wherein the one or more grooves 1002 are set to the same or different angle. In yet other aspects, the one or more grooves 1002 are not angled with respect to the surface such that the one or more grooves 1002 are substantially parallel to the surface. While in other aspects, one groove 1002 can be angled with respect to the surface while another groove 1002 is not angled with respect to the surface.

The first base extension hinge 508 can further comprise at least one attachment device 1038 to assist in stabilizing the ball net structure 500 to the surface. With reference to FIGS. 11 and 14-16, the base extension hinge 508 can comprise an attachment device 1038 at the bottom surface 1032 of the first base extension hinge 508, wherein the attachment device 1038 is an extension that extends from the bottom surface 1032 of the first base extension hinge 512. The attachment device 1038 can receive an attachment cord 1040 comprising a ring 1042 which is adapted to provide additional structural support. The ring 1042 can receive a stake, weight, or similar device so as to attach the ball net structure to the ground or surface. The at least one attachment device 1038 is configured to further provide additional structural support to the ball net structure 500 which increases the stability and/or the force the ball net structure 500 can withstand. Furthermore, the at least one attachment device 1038 can also be used to maintain the positioning of the ball net structure 500 to prevent shifting of the ball net structure 500. In other aspects of the disclosure, the ball net structure 500 comprises a plurality of attachment devices 1038 and can be on the first support portion 504 and/or the first base extensions 512. In yet other aspects, the attachment device 1038 can be located on different locations on the first base extension hinge 508 and is not intended to be limited to being at the bottom surface 1032. In yet other aspects, an attachment device 1038 can be on at least one of the first support portion 504, first base extension hinge 508, first base extensions 512, and/or a combination thereof.

Figure 11:
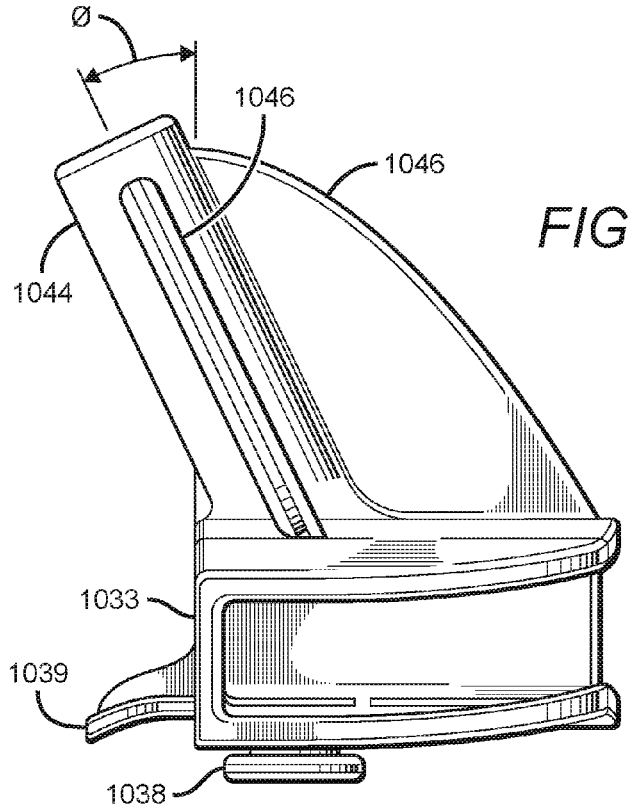
FIG. 11 is a side view of the base extension hinge of FIG. 10.

The first base extension hinge 508 further comprises a shaft 1044 extending from a top surface 1031 of the first base extension hinge 508. In some aspects, the shaft 1044 extends outward in a direction towards a back surface 1033 of the first base extension hinge 508. The shaft 1044 can be angled at an angle θ (theta) with respect to the back surface 1033 of the first base extension hinge 508, as further shown in FIG. 11. In one aspect, the shaft 1044 can be angled at an angle θ of approximately 26 degrees. However, the angle θ can be many different angles and is not intended to be limited to 26 degrees. In some aspects, the shaft 1044 can be angled at an angle θ within the range of 0 and 90 degrees. In some aspects, the shaft 1044 can comprise at least one fin 1046, wherein the at least one fin 1046 provides structural support to the first base extension hinge 508 and/or the shaft 1044. The at least one fin 1046 can comprise a planar body 1048 that is coupled to the shaft 1044 and to part of the top surface 1031 of the first base extension hinge 508. The at least one fin 1046 stabilizes the shaft 1044 and assists to withstand forces exerted onto the shaft 1044. The at least one fin 1046 can also assist in withstanding forces exerted onto any part of the ball net structure 500, such as but not limited to the base extension hinge, base extension, support portion, and/or any elements of the ball net structure 500. In the aspect of FIGS. 10-11, the shaft 1044 comprises three fins 1046. However, in other aspects, the shaft 1044 can comprise one or more fins 1046 and is not intended to be limited to the aspects disclosed herein. In some aspects, the at least one fin 1046 can comprise an attachment device 1038, similarly as disclosed above. The attachment device 1038 of the at least one fin 1046 can be configured to receive the attachment cord 1040 as discussed above to stabilize the ball net structure 500. While in other aspects, the attachment device 1038 of the at least one fin 1046 can receive part of a net 520, such as but not limited to a sleeve 524. The attachment device 1038 of the at least one fin 1046 can be configured in many different ways and is not intended to be limited to the aspects disclosed herein. In some aspects, the attachment device 1038 of the at least one fin 1046 can comprise at least one tab extending from the planar body 1048. In other aspects, the attachment device 1038 of the at least one fin 1046 comprises a notch formed within the planar body 1048. In yet other aspects, the attachment device 1038 of the at least one fin 1046 comprises an aperture in the planar body 1048 and a stud within the aperture extending from the planar body 1048.

The shaft 1044 is configured to receive a rod 516. The rod 516 is securely held within the shaft 1044, such that the shaft 1044 maintains a stable structural connection between the shaft 1044 and the rod 516 and prevents the rod 516 from being removed from the shaft 1044 when the ball net structure 500 is assembled. In one aspect of the disclosure, the shaft 1044 is similarly shaped as the rod 516, such as but not limited to cylindrically shaped, and can be larger than the rod 516 such that the rod 516 can be easily received by and/or removed from the shaft 1044. In some aspects, the shaft 1044 can comprise a sheath contacting at least part of an inner wall of the shaft 1044 that receives the rod 516. The sheath is adapted to protect the rod 516 within the shaft 1044 from forces exerted on the rod 516. As discussed above in the aspects of FIGS. 1-4, and discussed below, the rods 516 experience a moment force proximate where the rod 516 is received by the shaft 1044, and causes the rod 516 to exert a compression force upon the inner surface of the shaft 1044. The sheath, if present, protects the rod 516 from the forces exerted on and/or by the rod 516.

The shaft 1044 can be arranged in many different ways and is not intended to be limited to the aspects disclosed herein. In some aspects, the shaft 1044 can comprise a tapered inner surface such that the radius of the shaft 1044 decreases as the rod 516 is further inserted into the shaft 1044. Is such aspect, the shaft 1044 applies a compression force onto the rod 516 to form a structural connection with the rod 516. In other aspects, mechanical devices, such as but not limited to, screws, nuts, nails, rivets or the like, can be used to form the structural connection to securely attach the rod 516 to the shaft 1044. In yet other aspects, the rods 516 can comprise an attachment device such that the rods 516 can be attached to the shaft 1044; non-limiting examples of such attachment devices are the rods 516 being threaded and screwed into the shaft 1044 or the rod 516 and shaft 1044 configured similarly like a bayonet-type locking device.

In the aspect of FIG. 5, the rods 516 are circularly shaped and the shaft 1044 is also correspondingly circularly shaped to receive the rod 516. The shape of the rod 516 and shaft 1044 is not intended to be limited to a circular shape, other shapes such as quadrilateral, triangular, or any other polygonal shape can be used. The shaft 1044 can also be similarly shaped as the rod 516, but in some aspects, the shaft 1044 can be shaped differently than the rod 516. The rods 516 can be made of many different materials known in the art, such as but not limited to fiberglass or carbon fiber, such that the rods 516 are flexible, elastic, capable of returning to an initial form or state after deformation, and able to withstand the impact forces applied by sports-related balls and/or other projectiles that can be captured or caught by the ball net structure 500, or thrown, kicked, and/or hit towards the ball net structure 500.

The angle at which the shaft 1044 is angled with respect to the back surface 1033 of the first base extension 508 causes the rod 516 to extend outward at substantially the same angle as that of the shaft 1044. The rods 516, when received by the shaft 1044 flare outwards, such that the rods 516 are in a relaxed state and are substantially straight. A net 520 is arranged to receive the at least one rod 516 of the ball net structure. In some aspects, the net 520 comprises at least one sleeve 524 to receive part of at least one rod 516 of the ball net structure 500. The net 520 is adapted to exert a force on the at least one rod 516 bending the at least one rod 516 into a flexed state. The at least one rod 516 received by the at least one sleeve 524 results in the at least one rod 516 being bent from the relaxed state into a flexed state. In the aspect of FIG. 5, the ball net structure 500 comprises two rods 516, wherein each rods 516 is received by a respective shaft 1044 and at least one respective sleeve 524 of the net 520, such that both rods 516 are bent in a direction towards the base structure 502 and into the flexed state. Removal of the net 520 from at least one rod 516 allows the rods 516 to return to their original form of the relaxed state. When the at least one rod 516 is in the relaxed state, the at least one rod 516 can be easily removed from the shaft 1044 and allows the ball net structure 500 to be disassembled and stored for later use. Repeated use of the ball net structure 500 does not result in the rods 516 being permanently bent in a shape similar to that of the flexed state. In other aspects, when the at least one rod 516 is in the relaxed state, the base structure 502 can be configured into a different configuration to allow a different net to be used with the base structure 502.

The net 520 is similar to the net 30, discussed above, and imparts a pulling force on each of the rods 516 which causes the rods 516 to bend in a direction towards the base structure 502. Once bent towards the base structure 502, the rods 516 are in the flexed state and experience a moment force about its pivot point. The pivot point of each of the rods 516, in the aspect of FIG. 5, corresponds to the point at which the rods 516 are received by the shaft 1044. The moment force experienced by the rods 516 is imparted onto at least the base structure 502 and the first and second support portions 504, 506 of the base structure 502, with the transferred force being greatest at a central region of the base structure 502. This transferred force further assists in stabilizing the base structure 502 on the surface which the ball net structure 500 is on.

The net 520 can comprise a mesh surface and/or can be comprised of typical net materials known in the art. The net 520 comprises at least one sleeve 524 to receive a rod 516 and/or the base structure 502. The aspect of FIG. 5 shows the net 520 comprising a plurality of sleeves 524 that at least partially extend along opposing edges of the net 520, such that the sleeves 524 are opposite each other. The sleeves 524 of the aspect of FIG. 5 are in the form of sleeves of varying sizes on opposing edges of the net that are adapted to receive a respective rod 516. For example, on one edge the net comprises an elongated sleeve that extends along part of the edge of the net, and two smaller sleeves that are proximate a respective corner region of the net. The elongated sleeve is adapted to extend along part of the rod, and the smaller sleeves are adapted to be removably coupled to an end of the rod and/or base structure. The sleeves 524 of the net 520 can be configured in many different configurations and are not intended to be limited to the aspects disclosed herein. In some aspects, the sleeve can span the length of the rod. In other aspects, the sleeve can comprise a plurality of smaller sleeves or loops that are spaced apart from each other and run along part of the rods 516, or can comprise a sleeve that spans along a partial length of the rod 516, or can comprise a plurality of sleeves of various lengths. The at least one sleeve of the net can be arranged in many different shapes, such as but not limited to at least one sleeve that extends along a substantial portion of the rod 516, a plurality of sleeves 524 that extend along part of the rod 516, or a combination thereof. In some aspects, the sleeves are fixedly attached to the net. Whereas in other aspects, the sleeves comprise an attachment mechanism in order to removably couple the sleeves to the rod and/or base structure. In some aspects, the attachment mechanism can comprise a hook and loop system, such that the sleeves are removably coupled via the hook and loop system. In other aspects, the attachment mechanism can comprise a hook, latch, or the like in order to removably couple the sleeve to the rod and/or the base structure. The sleeves 524 receive the rods 516 and securely hold the net 520 on the rods 516 due in part to the sleeves 524 bending the rods 516.

In some aspects, the net can comprise at least one sleeve 524 adapted to be removably coupled to the rod 516. In some aspects, the net 520 can comprise at least one sleeve 524 received by an end portion of the rod 516, opposite the shaft 1044, and at least one sleeve 524 that extends along part of the rod. In some aspects, the net 520 can comprise at least one sleeve 524 that is removably coupled to the base structure 502, which assists in holding the net 520 onto the base structure 502. In some aspects, the base extension hinge 508 comprises an extension 1039 at the back surface 1033 of the base extension hinge 508 that allows for connection of the at least one sleeve 524 to the extension 1039. The extension 1039 can be at many different locations on the base extension hinge 508 and is not intended to be limited to the back surface 1033 of the base extension hinge 508. In some aspects, the extension 1039 can be on any part of the base structure 502, such as but not limited to the first and/or second support portions 504, 506, the first and/or second base extensions 512, 514, or a combination thereof. In yet other aspects, the base structure 502 can comprise a plurality of extensions 1039 to allow for the connection of at least one sleeve 524. In the aspect of FIG. 11, the extension 1039 is in the form of a tab that extends out from the base extension hinge. However, in other aspects, the extension 1039 can be arranged in many different configurations and is not intended to be limited to the aspects disclosed herein. In some aspects, the extension 1039 can be in the form of a loop coupled to the base structure. In some aspects, the at least one attachment device 1038 can also be configured to receive part of the net and/or at least one sleeve 524. In some aspects, the net 520 can comprise at least one sleeve 524 adapted to receive part of at least one of the first and second support portions 504, 506. While in other aspects, the net 520 can comprise a plurality of sleeves that receive a respective one of the first and second support portions 504, 506, first and second base extensions 512, 514, first and second base extension hinges 508, 510, or a combination thereof. The sleeves that receive the support portion and/or base extension can extend along the edge of the net that is proximate the base structure. The at least one sleeve 524 of the net can be comprised of many different materials, such as but not limited to fabric, plastic, elastic material, rope, cord, or the like.

Each rod 516 comprises an endcap 518 opposite the portion of the rod 516 that is received by the shaft 1044. The endcap 518 is configured to receive at least a portion of the sleeve and/or loop 524, such that the endcap 518 prevents the net 520 from coming off the rods 516 while the ball net structure 500 is assembled and/or in use. In some aspects, the endcaps 518 comprise a tab and a notch adapted to prevent the net 520 from coming off the rod 516. For example, the endcap 518 comprises a tab and a notch proximate the tab, such that the notch provides a depressed surface that receives the sleeve and/or loop 524 such that the sleeve and/or loop is securely held by the endcap 518 within the notch. In other aspects, the net 520 can comprise a keyhole clip configured to be removably coupled to the endcap 518. In one aspect, the keyhole clip comprises a housing comprising an opening, a groove, and a cover, wherein the keyhole clip is received by the endcap 518. In one aspect, the tab of the endcap 518 is received by the opening the keyhole clip and is slidably received with the groove, such that the notch of the endcap 518 is sized to fit and be removably coupled to the groove of the keyhole clip. The keyhole clip is thereby securely held by the endcap and is prevented from coming off the endcap while the ball net structure is assembled and/or in use. The cover of the housing covers the groove and opening, such that when the keyhole clip is received by the endcap, the cover covers the endcap and assists in maintaining the net on the rod. At least one advantage is that the keyhole clip provides for ease of installing and/or coupling the net 520 onto the rods 516. In addition, the keyhole clip being securely held by the endcap assists in keeping the net on the rods in the event that a ball and/or other projectile hits the net proximate the endcap. However, in other aspects, the endcaps 518 can have other means of preventing the net 502 from coming off the rods 516, such as but not limited to a hook, loop, locking clip, or the like.

At least one advantage of the disclosure is that the base structure 502 can compensate for forces exerted onto the base structure by the rods 516 while in the flexed state. When the net 520 is coupled and/or received by the rods that are within the respective shafts of the base extension hinge, the net exerts a pulling force onto the rods, such that the rods are in the flexed state. The rods in the flexed state exert a force onto at least the support portions 504, 506 of the base structure, and raising at least the support portions off the ground or surface allows the base structure to compensate for the force exerted onto the base structure by the rods in the flex state. The base structure can absorb the load exerted onto the support portions due to the rods being in the flexed state and distribute the load across the base structure. In one aspect, the raised support portions allows the base structure to at least partially oscillate and/or bow to dampen the load from the rods. If the support portions of the base structure were to remain on the ground, the force exerted onto the base structure by the rods in the flexed state could cause the base structure to bend and become deformed. Thus, the base extension hinges being angled such that the base extensions raise the base structure when the base extensions are deployed, seeks to counteract the force exerted onto the base structure from the rods. In other aspects, the first and/or second support portions can be bent to at least partially raise part of the first and/or second support portions in order to counteract the downward force exerted onto the base structure 502 by the rods 516 bent in the flexed state. In other aspects, the base extensions can be bent to raise the base structure when the base extensions are deployed.

The base extensions can be configured in many different configurations and are not intended to be limited to the aspects of the disclosure herein. The base extensions of at least FIGS. 18 and 19 are shown as being straight or linear. However, the base extensions are not intended to be limited to being straight or linear. In some aspects of the disclosure, the base extensions can be bent such that the bent base extensions raise the base structure off the ground or surface by the distance "d" when the base extensions are deployed. The bent base extension could be used with the angled base extension hinge to further assist in lifting the base structure from the ground or surface. In some aspects, the at least one grooves of the base extension hinge are not angled towards the ground, such that the base extension hinge is flat with respect to the ground or surface. In such aspects, the base extensions and/or the support portions can be bent such that the base structure is at least partially raised off the ground or surface. In yet other such aspects, the base extension hinge can further comprise feet that lift the base extension hinge off the ground or surface such that at least the support portions are raised off the ground or surface. In another aspect, the at least one groove of the base extension hinge can be angled away from the ground. In such aspects, the base extensions and/or support portions can be bent in order to at least partially lift the base structure off the ground or surface, or the hinge can also comprise feet that lift the base extension hinge off the ground, or a combination thereof.

The base extension hinge can be configured in many different configurations and is not intended to be limited to the aspects disclosed herein. For example, in some aspects, the base extension hinge has a general semi-circular shape, but in other aspects, the base extension hinge can comprise many different shapes and not limited to a semi-circular shape. In other aspects, the base extension hinge can comprise one groove or more than one groove. For example, in FIGS. 18 and 19, the base extension hinges comprise two grooves and a base extension pivotable within a respective groove. Additionally, the grooves are set at an angle such that the bottom surface of the base extension hinge is not substantially flat. As discussed above, the angled grooves of the base extension hinge causes the base extensions to lift the base structure when the base extensions are deployed or positioned at the opened end of the groove. Furthermore, the stop within the groove can be a raised surface that corresponds to the shape of the base extensions to prevent rotation of the base extension within the groove. In other aspects, the base extension hinge can further comprise a locking pin and/or other locking mechanism in addition to the stop to further assist in preventing the rotation of the base extension within the groove.

The base extension hinge can be formed of many different materials. In one aspect, the base extension hinge can be comprised of plastic materials, fabricated using an injection molding process. With reference to FIGS. 10, 14, 16 and 17, the base extension hinge can comprise a hole at the back surface that is aligned with the stop within the groove. The holes at the back surface are formed due to the injection molding process. The mold used to injection mold the base extension hinge comprises at least one tab wherein the material used to form the base extension hinge surrounds the at least one tab and forms the stop within the groove, such that when the mold is removed and the tab is extracted, the base extension hinge is formed and comprises the hole at the back surface of the base extension hinge. An advantage of the disclosure is that the base extension hinge is of solid construction and is not formed of separate components that are joined together. The unitary construction of the base extension hinge results in a stronger device and can bear the load of the rods exerted onto the base structure. The base extension hinge can further comprise support extensions extending from one or more surfaces of the shaft to further support the ball net structure when fully deployed and/or to withstand the force exerted by the rods onto the shaft when the net is coupled to the rod and/or when the rod is in the flexed state.

Figure 20:
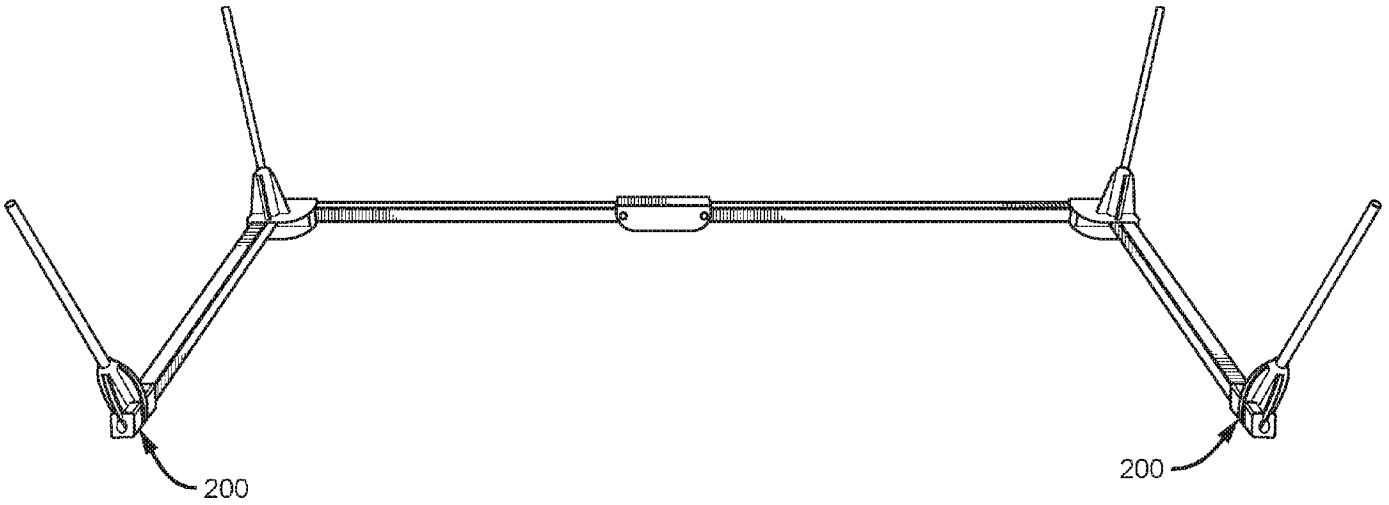
FIG. 20 is a perspective view of a base structure according to an aspect of the disclosure.
Figure 21:
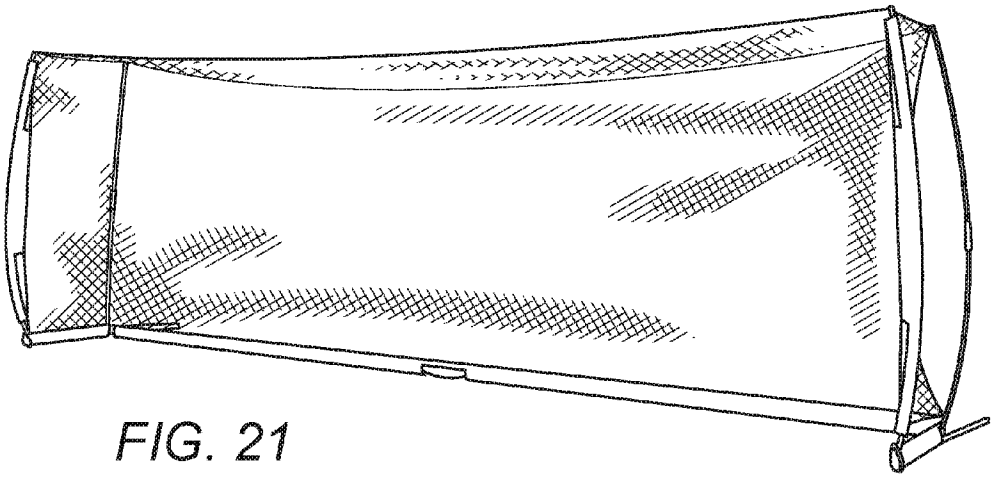
FIG. 21 is a perspective view of a ball net structure according to an aspect of the disclosure.

The base structure of the ball net structure can be configured in many different ways and is not intended to be limited to the aspects shown herein. The base structure of FIG. 5 is disclosed as having an "I" like shape, due to the base structure comprising two first base extensions and two second base extensions. In some aspects, the base structure can comprise one first and one second base extension. In other aspects, the base structure can be arranged to be shaped into many different shapes. For example, the base structure can be shaped similar to a soccer goal, lacrosse goal, baseball backstop, etc. The advantage of the disclosure is that the ball net structure can be configurable to many different arrangements to be used for many different sports, such as but not limited to, baseball, soccer, volleyball, tennis, lacrosse, football, and the like. For example, in aspects when the at least one rod 516 is in the relaxed state, the base structure 502 can be configured into a different configuration to allow a different net to be used with the base structure 502. The positioning of the first and second support portions can be altered to either increase or decrease the size of the base structure, while in some aspects, the first and/or second base extensions can receive an extension end bracket 200 configured to receive a rod to form a soccer-like goal structure, as shown in FIG. 20, wherein a soccer goal net can be used with the transformed base structure 502, as shown in FIG. 21, wherein the soccer goal net is received by the altered base structure 502, as disclosed herein and can also be adapted to be received by the extension end bracket 200, the base extensions, or a combination thereof. The extension end bracket 200 can comprise an attachment device and/or an extension similar to the attachment device 1038 and/or the extension 1039 described above. In the aspect of FIG. 20, the adjustable base structure 502 is shown with an intervening structure, such as the hinge 22, while at least one of the first and second support portions can be configured to be telescoping as discussed above such that the length of the at least one of the support portions can be adjusted. In other aspects, the adjustable base structure 502 does not comprise the intervening structure, and the base structure is adjustable by altering the position of the first support portion 504 with respect to the second support portion 506. In addition, once the base structure 502 is configured to receive a different net, such as but not limited to a soccer goal net, the base extensions that do not receive the extension end bracket can be moved to the closed end within the groove of the base extension hinge, or they can remain deployed.

Figure 22:
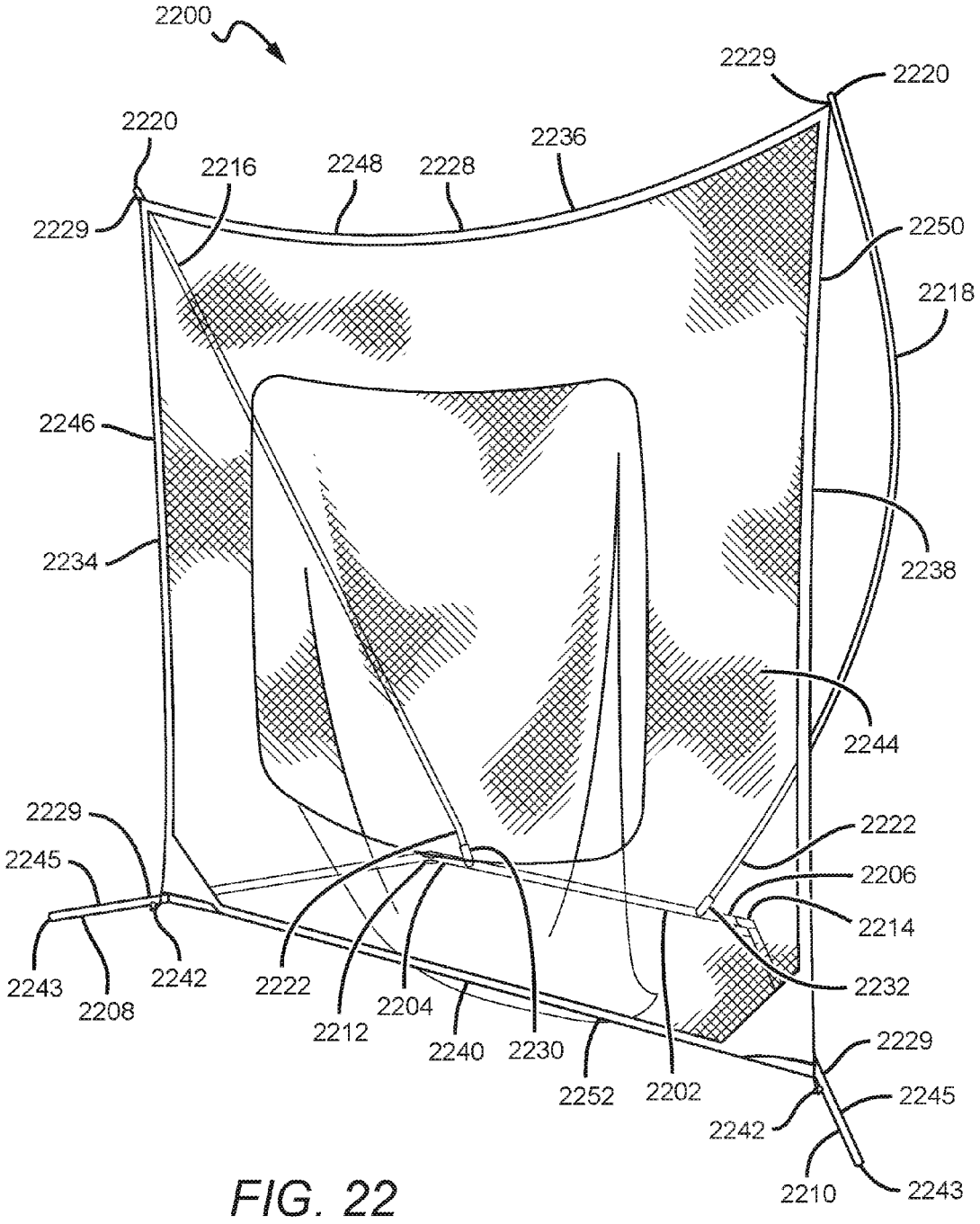
FIG. 22 is a perspective view of a ball net structure according to an aspect of the disclosure.

FIG. 22 shows one aspect of a ball net structure 2200 according to the disclosure.

The ball net structure 2200 comprises a support portion 2202 having a first end 2204 and a second end 2206, a first extension 2208 and a second extension 2210 coupled to the support portion 2202. A first bracket 2212 is coupled to the first end 2204 of the support portion 2202 and receives the first extension 2208, such that the first bracket 2212 pivotally couples the first extension 2208 to the support portion 2202. A second bracket 2214 is coupled to the second end 2206 of the support portion 2202 and receives the second extension 2210, such that the second bracket 2214 pivotally couples the second extension 2210 to the support portion 2202. The first and second extensions are adapted to pivot along a first plane. At least one flexible rod 2216 is coupled to support portion 2202, wherein the at least one flexible rod comprises an upper end 2220 and a lower end 2222, such that the lower end 2222 is removably coupled to the support portion 2202. A net 2228 is received by the first and second extensions 2208, 2210 and received by at least the upper end 2220 of the at least one flexible rod 2216. The net 2228 is configured to bend the at least one flexible rod 2216 from a linear state to an arcuate state, such that a net tension pulls the at least one flexible rod into the arcuate state. The aspect of FIG. 22 comprises a first flexible rod 2216 and a second flexible rod 2218, but other aspects can comprise more than two flexible rods and the disclosure is not intended to be limited to the aspects disclosed herein. At least the upper end 2220 of the first flexible rod 2216 is configured to receive the net 2228, and at least the upper end 2220 of the second flexible rod 2218 is configured to receive the net 2228, such that the net bends the first and second flexible rods 2216, 2218 from a relaxed linear state to an arcuate state or a bow shaped flexed state, wherein the first and second flexible rods are biased away from each other to hold the net upright. The net tension pulls the first flexible rod into the arcuate state and the net tension simultaneously pulls the second flexible rod into the arcuate state. The support portion 2202 and the first and second extensions 2208, 2210 support the load of the ball net structure 2200 and allow it to remain upright on a surface. The first and second extensions absorb at least part of a load exerted onto the ball net structure 2200 from a ball or other projectile when in use so as to maintain the ball net structure in an upright position.

The support portion 2202 extends longitudinally between the first end 2204 and the second end 2206. The first and second extensions 2208, 2210 are arranged to pivot with respect to the support portion. The first bracket 2212 is coupled to the first end 2204 of the support portion and receives the first extension, such that the first extension is pivotally coupled to the support portion proximate the first end 2204. The first bracket is configured to allow the first extension to pivot with respect to the support portion. The second bracket 2214 is coupled to the second end 2206 of the support portion and receives the second extension, such that the second extension is pivotally coupled to the support portion proximate the second end 2206. The second bracket is configured to allow the second extension to pivot with respect to the support portion. In the aspect of FIG. 22, the first and second extensions pivot with respect to the support portion proximate the first and second ends of the support portion. However, in some aspects, the first or second extensions can be arranged to pivot at different regions of the support portion and is not intended to be limited to the first or second ends. In the aspect of FIG. 22, the support portion is comprised of a single support portion. However, the support portion can be arranged in many different configurations and is not intended to be limited to the aspects disclosed herein. In some aspects, the support portion 2202 can comprise a plurality of support portions. In some aspects, the support portion can be similarly configured as the first and second support portions 14, 16, or the first and second support portions 504, 506, discussed above. The support portion can further comprise intervening structures, such as but not limited to a hinge 22 discussed above.

Figure 25:
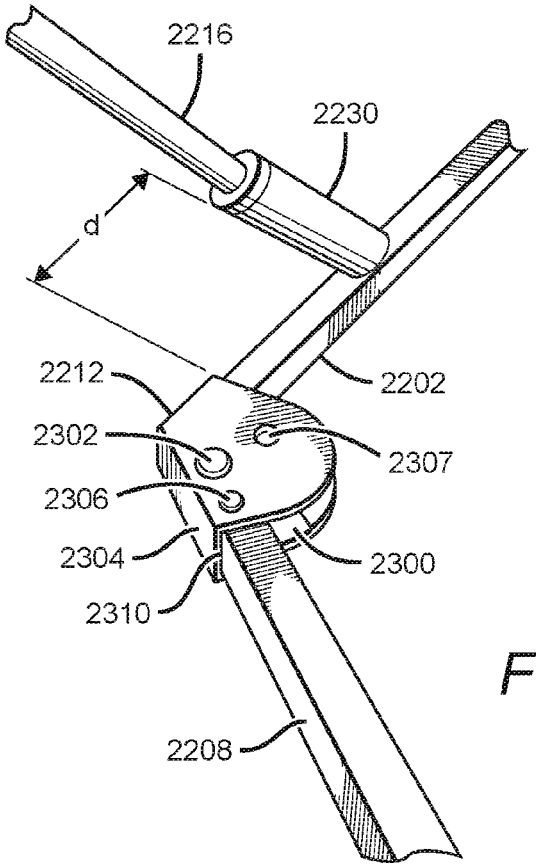
FIG. 25 is an enlarged view of the ball net structure according to an aspect of the disclosure.
Figure 32:
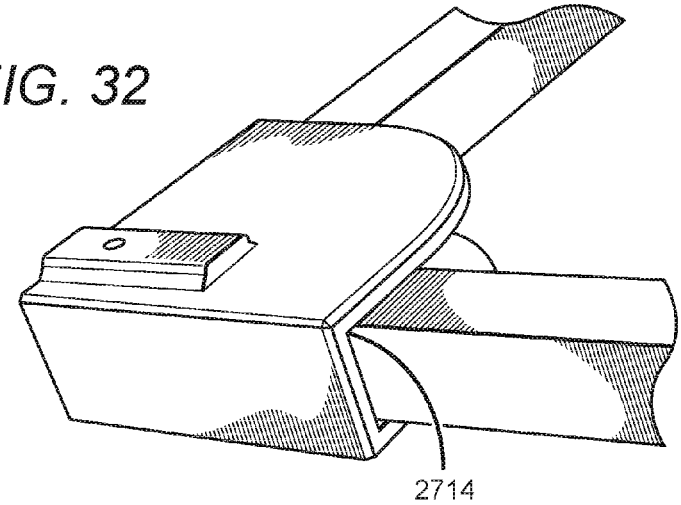
FIG. 32 is another perspective view of the bracket according to an aspect of the disclosure.
Figure 33:
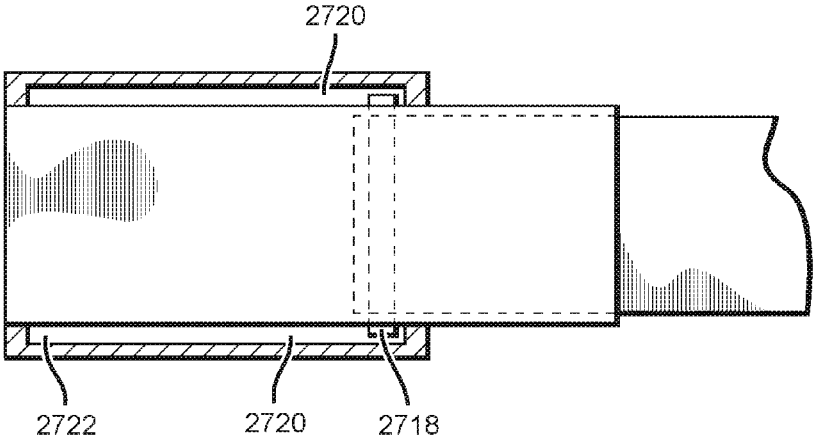
FIG. 33 is a side view of the bracket according to an aspect of the disclosure.
Figure 34:
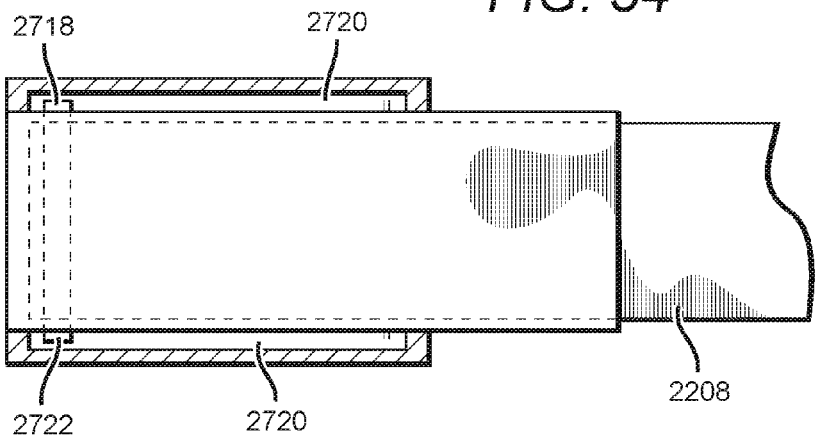
FIG. 34 is another side view of the bracket according to an aspect of the disclosure.

The first and second brackets are configured to allow the first and second extensions to pivot with respect to the support portion. In one aspect, as shown in FIG. 25, the first bracket comprises a groove 2300 and a pivot 2302, wherein part of the first extension is received within the groove 2300 and coupled to the first bracket, such that the first extension can pivot about the pivot 2302 within the groove 2300. The first bracket further comprises at least one sidewall 2304 that at least partially defines a range of pivot motion of the first extension 2208 within the groove 2300. The first bracket can further comprise a locking device that retains the positioning of the first extension within the groove. In the aspect of FIG. 25, the locking device can be a push button 2306 within the first extension that engages an opening 2307 in the first bracket. In some aspects, the locking device can be a lock pin that is inserted into aligned openings of the first bracket and the first extension. In some aspects, as shown in FIG. 26, the locking device can be a stop 2308 similar to the stop 1012 discussed above.

The range of pivot motion of the first extension within the groove of the first bracket can comprise an opened end 2310 wherein the first extension is in a deployed state when positioned at the opened end 2310, and a closed end 2312 wherein the first extension is pivoted towards the support portion 2202 and positioned proximate the support portion. While at the opened end 2310, the position of the first extension can be maintained by the locking device. In some aspects, the locking device can hold the positioning of the first extension when positioned at the closed end 2312. In some aspects, the first bracket can comprise one or more locking devices to hold the positioning of the first extension at either the opened end 2310 or the closed end 2312. For example, in the aspect of FIG. 25, the first bracket can comprise an opening 2307 proximate the open end 2310 and proximate the closed end 2312, such that the push button 2306 engages the opening 2307 when positioned at either the open end 2310 or the closed end 2312. The first bracket allows the first extension to pivot within the groove in order to deploy and/or disassemble the net structure 2200. The pivoting extensions allows the net structure to reduce its size and/or shape, thereby allowing the net structure 2200 to be stored in a small container.

FIG. 26 shows an aspect of a first bracket 2600.

The first bracket 2600 has features that are similar to the features of the base extension hinge 508 and 510. The first bracket 2600 comprises a groove 2300 and a pivot 2302, wherein part of the first extension 2208 is received in the groove 2300 and coupled to the first bracket 2600 such that the first extension can pivot about the pivot within the groove. The first bracket further comprises at least one sidewall 2304, a groove base 2310 and a groove top 2312, wherein the at least one sidewall 2304 at least partially defines the range of which the first extension can pivot within the groove. The first bracket comprises a stop 2308 that assists in preventing substantial movement of the first extension within the groove. In some aspects, the stop maintains the positioning of the first extension while positioned at the ends of the range of pivot motion within the groove, such that the first extension is secured and does not freely move. The range of pivot motion of the first extension within the groove of the first bracket 2600 can comprise the open end 2310 and the closed end 2312, wherein the first extension is deployed when positioned at the open end 2310, and wherein the first extension is retracted and proximate the support portion 2202 when positioned at the closed end 2312. The stop 2308 provides an obstacle or physical structure to maintain the positioning of the first extension at either the open end or the closed end. The stop can be shaped to partially correspond to part of the first extension received within the groove. In some aspects, the stop 2308 comprises a first edge 1013 that is proximate the first extension when positioned at the opened end. In some aspects, the stop can comprise a second edge 1015 that is proximate the first extension when positioned at the closed end. The stop comprises an elevated or raised surface with respect to the groove base 2310 such that the first and second edges 1013, 1015 provide a physical barrier that assists to maintain the first extension at either the open end or the closed end. The stop prevents the first extension from freely moving within the groove, and assists in stabilizing the net structure. In some aspects, the first and second edges 1013, 1015 extend from the groove base to the same height. While in other aspects, the first and second edges 1013, 1015 extend from the groove base to different heights. In some aspects, at least part of the first and second edges 1013, 1015 can contact part of the first extension to maintain the position of the first extension. The stop provides resistance to prevent slight movement of the first extension, but does not prevent the first extension from moving between the open end and the closed end. The stop can be configured in many different ways and is not intended to be limited to the aspects disclosed herein. In the aspect of FIG. 26, the groove comprises one stop on the groove base 2310. However, in other aspects, the groove can comprise one or more stops on the groove base. In some aspects, one or more stops can be on the at least one groove sidewall, the groove base, the groove top, or a combination thereof.

When the first and second extensions are positioned at the closed end of the respective grooves 2300 of the first and second brackets, the net structure is in a closed state and in condition to be stored for later use. When the first and second extension are positioned at the opened end of the respective grooves of the first and second brackets, the net structure is in a deployed condition and ready to be used. The range of pivot motion of the first and/or second extensions is not intended to be limited to the aspects described herein. For example, the range of pivot motion of the first and/or second extensions between the closed end and the opened end within the respective groove can range from about 0 to 160 degrees. However in some aspects, the range of pivot motion of each and/or both of the extensions from the closed end to the opened end of the respective grooves can range from about 0 to 180 degrees. In some aspects the range of pivot motion of the first and second extensions can be the same, while in other aspects the range of pivot motion can be different for the first and second extensions.

The first or second extensions 2208, 2210 can be coupled to the first or second bracket 2600 by a pin 1018, as shown in FIG. 28, such that the extension is adapted to pivot within the groove 2300 about the pivot 2302. The first bracket 2600 can further comprise a channel 1020 to receive part of the support portion 2202. The channel 1020 is configured similarly to the channel 1020 of the first base extension hinge 508. As discussed above, the first bracket 2600 is configured in a manner similar to the base extension hinges 508 and 510, but the first bracket 2600 does not comprise the shaft 1044 and the at least one fin 1046 as disclosed in FIG. 10, and the first bracket 2600 only comprises one groove 2300. However, in some aspects, the first bracket 2600 can comprise more than one groove 2300 and is not intended to be limited to the aspects disclosed herein. The first bracket 2600 and second bracket can be substantially similar and mirror images of each other. As such, the discussion of the first bracket 2600 is presented herein with the understanding that such disclosure can be applicable to the second bracket, in an effort to reduce duplicate descriptions. However, the disclosure does not require the first and second brackets to be identical. In some aspects, the first and/or second brackets can comprise some of the same features disclosed herein. While in some aspects, the first and/or second brackets do not necessarily comprise some of the same features of the other bracket. The first and second extensions 2208, 2210 can be substantially similar, and the discussion herein referring to the first extension 2208 is understood to be applicable to the second extension 2210. However, the first and second extensions do not have to be identical. In some aspects, the first and/or second extensions can comprise some of the same features disclosed herein, while in some aspects, the first and/or second extensions do not comprise some of the same features of the other extension. The first and second extensions 2208, 2210 can be configured in a manner similar to the extensions 18, 20, 52, 54, 512 or 514 discussed above.

With reference to FIG. 27, the first bracket 2600 can further comprise at least one extension 1039 or an attachment device 1038 to assist in stabilizing the net structure, similarly as disclosed in FIG. 11. The attachment device 1038 can receive an attachment cord 1040 comprising a ring 1042 which is adapted to provide additional structural support. The ring 1042 can receive a stake, weight, or similar device so as to attach the net structure to the ground or surface. The at least one attachment device 1038 is configured to further provide additional structural support to the net structure which increases the stability and/or the force the net structure can withstand. Furthermore, the at least one attachment device 1038 can also be used to maintain the positioning of the net structure to prevent shifting of the net structure on the surface. In some aspects of the disclosure, the net structure comprises a plurality of attachment devices 1038 and can be on the support portion, the first extension, and/or the second extension. In yet other aspects, the attachment device 1038 can be located on different locations on the first bracket and is not intended to be limited to being at the bottom surface 1032. In yet other aspects, an attachment device 1038 can be on the support portion, first bracket, first extension, second bracket, second extension and/or a combination thereof.

FIG. 29 shows an aspect of a first bracket 2700.

The first bracket 2700 comprises a groove 2702 and a pivot 2704, wherein part of the first extension 2208 is received by the first bracket and within the groove 2702 such that the first extension can pivot about the pivot 2704 within the groove 2702. The first bracket 2700 comprises at least one sidewall 2706, a groove base 2708, and a groove top 2710, wherein the at least one sidewall 2706 at least partially defines the range of pivot motion of the first extension within the groove 2702. The first bracket 2700 further comprises a stop 2712 within the groove 2702, wherein the stop 2712 assists in preventing substantial movement of the first extension within the groove 2702, similarly as discussed above. In some aspects, the stop 2712 assists in maintaining the position of the first extension at the ends of the range of pivot motion within the groove 2702, such that the first extension is secured and does not freely move. In some aspects, the range of pivot motion can comprise an open end 2714 wherein the first extension is deployed, as shown in FIG. 29, and a closed end 2716 wherein the first extension is retracted and proximate the support portion 2202, as shown in FIG. 30. The stop 2712 provides an obstacle to maintain the positioning of the first extension at either the open end 2714 or the closed end 2716. The stop 2712 can be shaped to partially correspond to part of the first extension received within the groove 2702. In some aspects the stop 2712 comprises a first edge 2713 that is proximate the first extension when positioned at the opened end. In some aspects, the stop 2712 can comprise a second edge 2715 that is proximate the first extension when positioned at the closed end 2716. The stop 2712 is elevated with respect to the groove base 2708 such that the first and second edges 2713, 2715 provide a physical barrier that assists to maintain the first extension at either the open end 2714 or the closed end 2716. The stop 2712 prevents the first extension from freely moving within the groove 2702, and thereby assists in stabilizing the net structure. In some aspects, the first and second edges 2713, 2715 extend from the groove base 2708 to the same height. While in other aspects, the first and second edges 2713, 2715 extend from the groove base 2708 to different heights. In some aspects, at least part of the first and second edges 2713, 2715 can contact part of the first extension to maintain the position of the first extension. The stop 2712 provides some resistance to prevent slight movement of the first extension, but does not prevent the first extension from moving between the open end 2714 and the closed end 2716. The stop 2712 can be configured in many different ways and is not intended to be limited to the aspects disclosed herein. In the aspect of FIGS. 29-31, the groove 2702 comprises one stop 2712 on the groove base 2708. However, in some aspects, the groove 2702 can comprise one or more stops 2712 on the groove base 2708. In yet some aspects, the one or more stops 2712 can be on the at least one groove sidewall 2706, the groove base 2708, the groove top 2710, and/or a combination thereof.

When the first and second extensions are positioned at their respective closed ends of the groove, the net structure is in a closed state and in condition to be stored for later use. When the first and second extensions are positioned at their respective open ends of the groove, the net structure is in a deployed condition and ready to be used. The range of pivot motion of the first and second extensions is not intended to be limited to the aspects described herein. For example, the range of pivot motion of the first and second extensions between the closed end and the open end within the groove can range from about 0 to 160 degrees. However in some aspects, the range of pivot motion of each and/or both of the extensions from the closed end to the opened end of a respective groove can range from about 0 to 180 degrees. In some aspects the range of pivot motion of the extensions can be the same, while in other aspects the range of pivot motion can be different for the extensions.

The first extension is coupled to the first bracket 2700 by a pin 2718, such that the first extension is adapted to pivot within the groove 2702 about the pivot 2704. When the first extension is positioned at the opened end 2714 of the groove, the first extension can be slidably received within a channel 2719 of the first bracket in order to lock the first extension within the first bracket. With reference to FIGS. 31-34, with the first extension positioned at the open end 2714 of the groove, the pin 2718 extends through the first extension and into at least one trench 2720 of the first bracket, such that the first extension is arranged to be inserted in the channel 2719 and locked within the first bracket. The pin 2718 is configured to travel within the at least one trench 2720 that extends from the pivot 2704 to a trench end 2722 within the channel 2719, wherein the first extension is locked and secured when the pin 2718 is at the trench end 2722. In some aspects, as shown in FIG. 35, the first bracket can comprise a tongue 2724 within the channel 2719, wherein the tongue 2724 is received by the first extension to assist in locking and/or preventing the first extension from substantially moving.

The first bracket 2700 and second bracket can be substantially similar and mirror images of each other. As such, the discussion of the first bracket 2700 is presented herein with the understanding that such disclosure can be applicable to the second bracket, in an effort to reduce duplicate descriptions. However, the disclosure does not require the first and second brackets to be identical. In some aspects, the first and/or second brackets can comprise some of the same features disclosed herein. While in some aspects, the first and/or second brackets do not necessarily comprise some of the same features of the other bracket.

The first bracket further comprises an opening 2726 to receive the support portion 2202, as shown in FIG. 29. The opening 2726 comprises a top 2728, a base 2730, a sidewall 2706, at least one rib 2734, and a back wall 2736, wherein the opening 2726 is proximate the groove 2706 of the first bracket. The support portion 2202 is inserted into the opening 2726 until the support portion reaches the back wall 2736 of the opening 2726. The at least one rib 2734 assists in securing the support portion within the opening 2726. In some aspects, the at least one rib 2734 can be arranged within the opening 2726 such that the opening 2726 can accommodate the dimensions of the support portion that is received within the opening 2726. In some aspects, the at least one rib 2734 can be arranged within the opening 2726 such that part of the support portion received within the opening 2726 at least partially contacts at least one of the top 2728, base 2730, sidewall 2706, and/or a combination thereof. The at least one rib 2734 at least partially extends along the length of the opening 2726. The at least one rib 2734 can be a continuous rib, while in other aspects, the at least one rib 2734 can comprise a plurality of ribs that are separated and aligned to form the at least one rib. In some aspects, the opening 2726 can comprise a plurality of ribs 2734 that contact part of the support portion that is received in the opening 2726 such that the plurality of ribs 2734 prevent the support portion from shifting and/or moving while in the opening 2726. In one aspect, the at least one rib 2734 can be on the top 2728 and/or base 2730. However, the at least one rib 2734 can be arranged in many different locations within the opening 2726 and is not intended to be limited to the aspects described herein. In some aspects, the at least one rib 2734 can be on a sidewall, or on the top 2728, or on the base 2730, and/or a combination thereof. The first bracket can further comprise a lock pin to couple the support portion within the opening 2726. The lock pin can be at a bottom surface of the first bracket. However, the lock pin is not intended to be limited to the aspects described herein. In some aspects, the lock pin can be at the top surface or any other surface of the first bracket in order to couple the support portion to the opening 2726.

The first bracket can further comprise a cavity 2738, wherein the cavity 2738 is interposed between the groove 2702 and the opening 2726. The cavity 2738 provides a separation between the opening 2726 and the groove 2702 to allow for the support portion to be separated from the first or second extension when the first or second extension is positioned at the closed end 2716 within the groove 2702. The separation between the support portion and the first extension prevents the first extension from hitting and/or striking the support portion when being positioned into and/or when positioned at the closed end. The separation assists in preventing damage to either the support portion and/or the first extension, which can prolong the durability of the net structure.

At least one advantage of the disclosure is that the back wall 2736 of the opening 2726 is arranged to assist in securing the first extension within the first bracket. The back wall 2736 extends from the sidewall of the opening 2726 towards the groove sidewall 2706, such that the back wall provides a physical barrier within the channel 2719 of the first bracket which assists in preventing the first extension from moving, pivoting, and/or becoming dislodged when fully received in the channel 2719. The back wall 2736 provides an extended surface within the channel 2719 that can abut part of the first extension within the channel, such that the back wall prevents the first extension from pivoting. In addition, the back wall can also withstand at least some of the forces and/or loads exerted onto at least the first bracket and/or first extension, due to repeated strikes from a ball, bat, kicks from users while using the net, and the like that could cause typical locking buttons/pins to malfunction and/or fail.

Furthermore, in aspects comprising the tongue 2724, the first extension comprises a hollow end, wherein the hollow end receives the tongue, such that part of the first extension is wedged between the tongue 2724 and the back wall 2736. The tongue and back wall configuration cooperate to prevent the first extension from moving and/or pivoting when wedged between the tongue and back wall. The tongue and back wall configuration provide further support against forces and/or loads exerted onto at least the first bracket and/or first extension. The tongue can extend from any surface within the cavity and is proximate the back wall, such that the first extension is interposed between the back wall and the tongue. In the aspect of FIG. 35, the tongue extends from a first channel wall 3502 adjacent the back wall 2736 in a direction parallel to the back wall. The tongue comprises at least one finger 3506 extending between the tongue and a second channel wall 3504 that is opposite the back wall 2736 and adjacent the first channel wall 3502. The at least one finger 3506 assist in providing structural support to the tongue 2724. The at least one finger can also extend from the first channel wall and the second channel wall to further assist in providing structural support to the tongue. In aspects wherein the tongue comprises at least one finger, the hollow end of the first extension received by the bracket 2700 is shaped to accommodate the at least one finger. The bracket 2700 of FIG. 35 discloses a tongue comprising two fingers, but the disclosure is not intended to be limited to the aspects disclosed herein. In some aspects, the tongue can comprise one or more fingers. In some aspects, the bracket The tongue provides a chamber 3508 between the back wall 2736 and the tongue 2724, wherein the chamber 3508 receives part of the hollow end of the first extension. In some aspects, the tongue is spaced apart from the back wall at a same distance. In some aspects, the spacing of the tongue and the back wall decreases from the pivot 2704 to the trench end 2722. As such, the chamber between the back wall and the tongue is tapered such that the hollow end of the first extension is wedged between the tongue and the back wall, when the pin 2718 is proximate the trench end 2722. At least one advantage of the disclosure is that the bracket 2700 comprises locking features internal to the bracket and are not exposed and/or external to the bracket. The internal locking features, such as but not limited to the trench, the pin, the back wall, tongue, and/or chamber, alone or in combination, operate to lock the extension within the bracket and are able to withstand forces exerted onto the net structure. Conventional locking features can be at least partially exposed and are susceptible to failing due to repeated strikes from balls, kicks from users, and/or mechanical failure. The bracket 2700 overcomes the issues of external locking features, and reduces the potential for damage due to usage, which can prolong the durability of the net structure.

The first bracket can further comprise at least one attachment 1038, 1039 device to assist in stabilizing the net structure to a surface. The attachment device can be an extension that extends from a bottom surface of the first bracket, wherein the attachment device is configured to receive an attachment cord to provide additional structural support. The attachment device can be similar to any of the attachment devices discussed above. The attachment device can be located on different locations on the first bracket and is not intended to be limited to being at the bottom surface. In some aspects, the attachment device can be arranged to receive part of the net.

The support portion 2202 further comprises at least one shaft integral to and extending from the support portion. In some aspects, the at least one shaft extends outward in a direction towards an adjacent end of the support portion 2202. In the aspect of FIG. 22, the support portion 2202 comprises a first shaft 2230 and a second shaft 2232, wherein the first shaft 2230 is proximate the first end 2204 of the support portion 2202 and the second shaft 2232 is proximate the second end 2206 of the support portion 2202, wherein the first and second shafts extend from a top surface of the support portion. The first shaft 2230 at least partially extends out in a direction towards the first end 2204, and the second shaft 2232 at least partially extends out in a direction towards the second end 2206. However, the first and second shafts do not extend beyond the respective first end and second end of the support portion. The first and second shafts are disclosed in FIG. 22 as extending from a top surface of the support portion, but the disclosure is not intended to be limited to the aspects disclosed herein. In some aspects, the first or second shafts can extend from any surface of the support portion, such as but not limited to the top surface, a bottom surface, side surface, or a combination thereof. In yet some aspects, as discussed below, the first and/or second shafts can extend from an intervening structure coupled to the support portion or that couples a plurality of support portions together, such as but not limited to a hinge 22 discussed above or a bracket 3612 discussed below. In some aspects, the first or second shafts can extend from the respective first or second extension instead of the support portion.

The first shaft and second shaft can be substantially similar and mirror images of each other. As such, the discussion of the first shaft 2230 is presented herein with the understanding that such disclosure can be applicable to the second shaft, in an effort to reduce duplicate descriptions. However, the disclosure does not require the first and second shafts to be substantially similar and mirror images of each other. In some aspects, the first and/or second shafts can comprise some of the same features disclosed herein. While in some aspects, the first and/or second shafts do not necessarily comprise some of the same features of the other shaft. The first and second shafts 2230, 2232 can be configured in a manner similar to the shafts discussed above.

The first shaft 2230 is proximate the first end 2204 of the support portion 2202. The first shaft 2230 is separated from the first bracket 2212, when the first end 2204 of the support portion is received by the first bracket 2212. As shown in FIG. 25, the first shaft 2230 is separated from the first bracket 2212 by a distance "d". The separation of the first shaft from the first bracket allows the first bracket to easily receive the first end of the support portion. In some aspects, the distance "d" can be within the range of 6-18 inches, while in other aspects the distance "d" can be less than or greater than the range of 6-18 inches. The shafts can be arranged to be separated from the first or second brackets in many different configurations and are not intended to be limited to the aspects disclosed herein. In some aspects, at least one shaft can be substantially centrally disposed on the support portion. In some aspects, at least one shaft can be substantially equidistant from the first or second bracket and a central region of the support portion. In some aspects, the distance separating the first shaft from the first bracket and the central region of the support portion can be the same or different.

The first shaft at least partially extends outward in at least a direction towards the first bracket. In some aspects, the first shaft at least partially extends in a direction towards the first bracket and at least partially in a direction opposite the first extension. The first shaft can be angled at an angle θ (theta) with respect to a vertical axis from the support portion. In some aspects, the first shaft can be angled at an angle θ of approximately 26 degrees. However, the angle θ can be many different angles and is not intended to be limited to 26 degrees. In some aspects, the first shaft can be angled at an angle θ within the range of 0 and 90 degrees. In some aspects, the shaft can comprise at least one fin 1046, wherein the at least one fin 1046 provides structural support to the shaft. The at least one fin 1046 can comprise a planar body 1048 that is coupled to the shaft 1044 and to part of the top surface of the support portion. The at least one fin 1046 stabilizes the shaft and assists to withstand forces exerted onto the shaft. The at least one fin 1046 can also assist in withstanding forces exerted onto any part of the net structure, such as but not limited to the extensions, support portion, brackets and/or any elements of the net structure. At least one advantage of the first shaft being separated from the first bracket is that the first shaft is less likely to be damaged while in use or stored, because the first shaft does not extend beyond the first bracket. For example, when the extensions are positioned in the respective closed ends and the net structure is prepared to be stored/transported, the transporting and/or storing of the net structure could result in the ends of the support portion and/or brackets being struck by other objects or have prolonged forces exerted upon the ends and/or brackets based on how the net structure is positioned when stored/transported. As such, positioning the shafts such that they are separate from the first and second brackets assists in protecting the shafts and extends the life of the net structure.

The first shaft is configured to receive a lower end 2222 of the first flexible rod 2216. As shown in FIG. 22, the first shaft receives the first flexible rod 2216, and the second shaft 2232 receives a second flexible rod 2218. The first and second flexible rods 2216, 2218 are similarly configured. As such, the discussion of the first flexible rod is presented herein with the understanding that such disclosure can be applicable to the second flexible rod, in an effort to reduce duplicate descriptions. In addition, the flexible rods 2216, 2218 can be configured in a manner similar to the rods 26 or rods 516 discussed above.

The flexible rod is securely held within the shaft such that the shaft maintains a stable structural connection between the shaft and the rod. The shaft prevents the rod from being removed from the shaft when the net structure is assembled. In some aspects, the shaft is similarly shaped as the rod, such as but not limited to cylindrically shaped, and can be larger than the rod such that the rod can be easily received during assembly and easily removed during disassembly. The shafts 2230, 2232 can be configured in a manner similar to the shaft 1044 discussed above.

In the aspect of FIG. 22, the rods are circularly shaped and the shafts are also correspondingly circularly shaped to receive the rods. The shape of the rod and shaft is not intended to be limited to a circular shape, other shapes such as quadrilateral, triangular, or any other polygonal shape can be used. The shaft can also be similarly shaped as the rod, but in some aspects, the shaft can be shaped differently than the rod. The rods can be made of many different materials known in the art, such as but not limited to fiberglass or carbon fiber, such that the rods are flexible, elastic, capable of returning to an initial form or state after deformation, and able to withstand the impact forces applied by sports-related balls and/or other projectiles that can be captured or caught by the net structure, or thrown, kicked, and/or hit towards the net structure.

Figure 23:
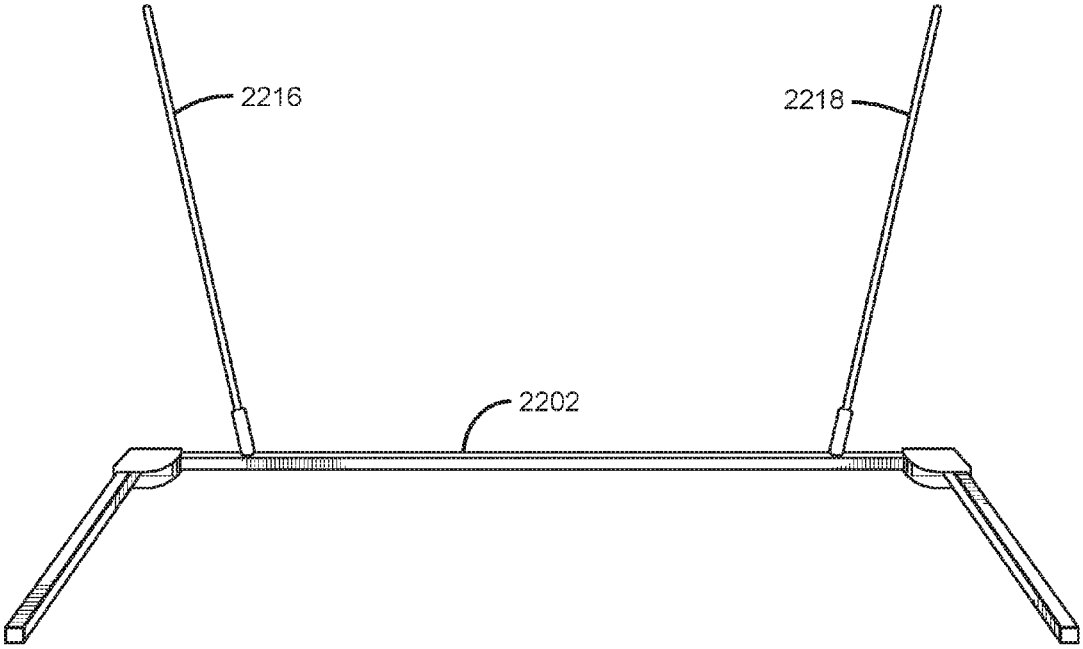
FIG. 23 is a perspective view of a frame structure according to an aspect of the disclosure.

The angle at which the shaft is angled with respect to the top surface of the support portion causes the rods to extend outward at substantially the same angle as that of the shaft. The rods, when received by the shafts flare outwards and are in a relaxed state and are substantially linear, as shown in FIG. 23. A net 2228 is arranged to be received by the first and second rods of the net structure and at least the first and second extensions. In some aspects, the net 2228 comprises at least one sleeve 2229 to receive part of the first rod, part of the second rod, part of the first extension 2208, and part of the second extension 2210. The net 2228 is adapted to exert a force on the first and second rods bending the first and second rods into a flexed or arcuate state. The first and second rods received by a respective sleeve 2229 results in the first and second rods being bent from the relaxed or linear state into the flexed or arcuate state. The net tension exerted by the net onto the rods simultaneously pulls the rods into the arcuate state, such that the rods are maintained in the arcuate state when the net structure is fully assembled.

The net 2228 can be configured in a manner similar to the net 30 or net 520 discussed above. The net 2228 imparts a pulling force on each of the rods which causes the rods to bend into the arcuate state, such that the rods are bent in opposing directions and away from each other. The rods, while in the arcuate state and biased away from each other, experience a moment force about a respective pivot point. The pivot point of each of the rods corresponds to the point at which the rods are received by the shaft. The moment force experienced by the rods is imparted and/or transferred onto at least the support portion and the first and second extensions. This transferred force further assists in stabilizing the net structure on a surface. In aspects wherein the support portion comprises an intervening structure, such as but not limited to the hinge 22 or bracket 3612, the rods can also exert a force onto at least the hinge or bracket to lock the support portion, and prevent rotation of the support portion about the hinge or bracket. The moment force experienced by the rods can also be transferred onto at least the hinge or bracket to lock the hinge or bracket. The net structure, when fully assembled and deployed, is adapted to withstand the force of a ball or projectile so as to capture the ball while keeping the hinge or bracket locked and the net structure upright. The net structure 2200, in aspects comprising the hinge or bracket, is similar to the aspect of at least FIGS. 1-4, in that the hinge or bracket does not comprise a locking device and is locked due to the forces exerted by the net and/or rods when the net structure 2200 is fully assembled. In such aspects, the support portion does not pivot with respect to the hinge or bracket due to the forces exerted by the net and/or rods.

In the aspect of FIG. 22, the net 2228 is received by at least a respective upper end 2220 of the first and second rods and is further received by at least the first and second extensions 2208, 2210, such that the rods at least partially bend in a direction towards the support portion and into the arcuate state. The first and second rods also at least partially bend in a direction towards the respective first and second extensions, such that at least an upper end 2220 of the first rod is over the first extension and at least an upper end 2220 of the second rod is over the second extension. In some aspects, the upper ends of the first and second rods are substantially aligned with the position of where the net is received by the first and second extensions when the net is received by the rods and the extensions. The shape of the net 2228 can also determine the positioning of the upper ends of the rods when coupled to the net. For example, in the aspect of FIG. 22, the net 2228 has a substantially square-like shape which results in the respective upper ends of the rods being substantially axially aligned with the respective tabs 2242 of the extensions that receive the net. The net can comprise many different shapes and is not intended to be limited to a square shape. In some aspects, the net can have any shape, such as but not limited to triangular, rectangular, trapezoidal, quadrilateral, or the like. In some aspects, the upper ends are not substantially aligned with the tabs, while in some aspects, at least one upper end is substantially aligned with at least one tab. In some aspects, the net can comprise at least one substantially linear edge. In some aspects, the net can comprise at least one non-linear edge, such as but not limited to, rounded, curved, arcuate, the like, or a combination thereof. In some aspects, the net can comprise at least one substantially linear edge and at least one non-linear edge. Removal of the net 2228 from at least the first or second rods, allows the rods to return to their original form of the linear or relaxed state. When the rods are in the linear state, the rods can be easily removed from the shafts and allows the net structure to be disassembled and stored for later use. Repeated use of the net structure does not result in the rods being permanently bent in a shape similar to the arcuate state.

Figure 24A:
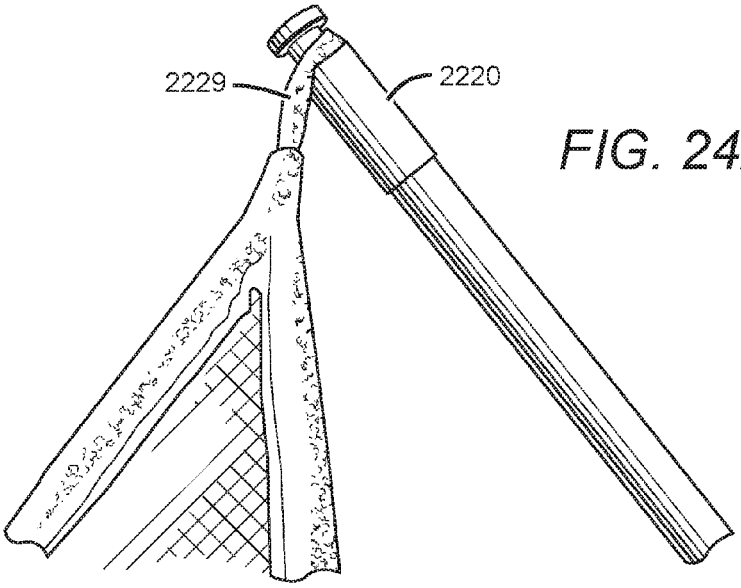
FIG. 24A is an enlarged view of the ball net structure according to an aspect of the disclosure.
Figure 24B:
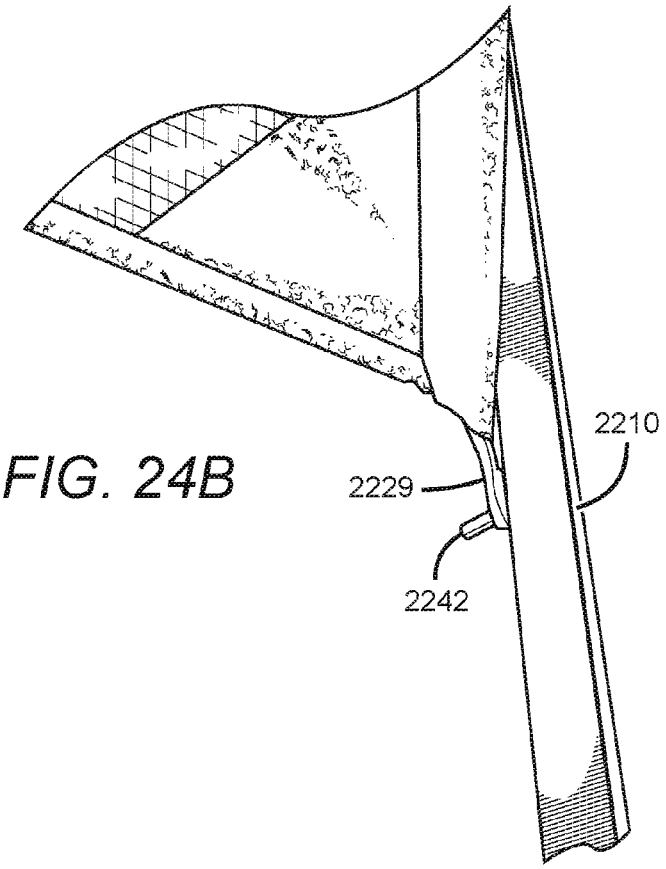
FIG. 24B is an enlarged view of the ball net structure according to an aspect of the disclosure.

The first and second extensions comprise at least one tab 2242 configured to receive the net, such that a respective sleeve 2229 of the net is received by a respective tab 2242 of the first and second extensions, as shown in FIG. 24B. In the aspect of FIG. 22, the tab 2242 is on an inner surface of the extensions and is disposed at a location between the ends of the extensions, such that the tab 2242 is remote from a respective front end 2243 of the first and second extensions. The tab 2242 is disposed between the ends of the extensions such that a respective front portion 2245 of the first and second extensions extends beyond the tab and the net when the net structure is deployed. The front portions of the first and second extensions that extend beyond the tab and net assist in stabilizing the net structure on the surface. The front portions of the first and second extensions increase the area of the base of the net structure, which in turn increases the load that the net structure is able to withstand that is exerted by a ball and/or projectile so as to capture the ball while keeping the net structure in an upright position. At least one advantage of disposing the tabs between the ends of the extensions is that the tab is less likely to be damaged while in use or stored, due in part to the tab not extending beyond the front end of the respective extensions and/or not being disposed at the front end of the respective extensions. For example, when the extensions are positioned in the respective closed ends and the net structure is prepared to be stored/transported, the transporting and/or storing of the net structure could result in the ends of the extensions being struck by other objects or have prolonged forces exerted upon the extensions based on how the net structure is positioned when stored/transported. As such, positioning the tabs such that they are between the ends of the extensions assists in protecting the tabs and extends the life of the net structure. The tabs can be located on any part of the extensions and are not intended to be limited to the inner surface of the extensions. In some aspects, the tabs 2242, can be on a bottom surface, outer surface, top surface or a combination thereof. The tab 2242 can be configured similar to the attachment device 1038 or extension 1039 discussed above.

The net structure is fully deployed and ready for use when the net 2228 is received by the rods and extensions. As shown in FIG. 22, the net 2228 comprises four corners with a sleeve 2229 at each corner, wherein a respective sleeve 2229 is coupled to respective upper ends 2220 of the first and second rods, and respective tabs 2242 of the first and second extensions. The net further comprises a first edge 2234, a top edge 2236, a second edge 2338, and a bottom edge 2240. The first edge 2234 extends between the first extension and the upper end of the first rod. The top edge extends between the upper end of the first rod and the upper end of the second rod. The second edge extends between the upper end of the second rod and the second extension. The bottom edge at least partially extends between the first and second extensions. The net can comprise a mesh surface with respective borders along the edges of the net, wherein the mesh surface is coupled to the borders. A first border 2246 extends between the first extension and the upper end of the first rod. A top border 2248 extends between the upper end of the first rod and the upper end of the second rod. A second border 2250 extends between the upper end of the second rod and the second extension. A bottom border 2252 at least partially extends between the first and second extensions. The borders can comprise graphics and/or printed matter to assist in proper alignment of the net during assembly. The borders can provide a visual indication of the profile of the net such that users can identify the boundary of the net that is intended to capture the ball and/or other projectile. The net is held onto the rods and extensions by tension. The tension holds the net substantially taut, such that the net can capture a ball and/or other projectile. The net being substantially taut allows the borders to be easily visible.

The net 2228 imparts a pulling force on each of the rods which causes the rods to bend at least partially in a direction towards the respective extensions. The mesh surface 2244 and borders can be comprised of woven materials and/or can be comprised of typical net materials known in the art. The sleeves 2229 extend from the corners of the net, as shown in FIGS. 22 and 24A-B. In some aspects, the sleeves are coupled to the mesh surface of the net about the corners. In some aspects, the sleeves are coupled to the borders of the net about the corners. In some aspects, the sleeves are coupled to both the mesh surface and borders at the corners. The sleeves can be arranged in many different configurations and are not intended to be limited to the aspects disclosed herein. The sleeves can be located at any part of the net and is not intended to be limited to the corners. In the aspect of FIG. 22, the sleeves are in the form of loops fixedly attached to the net at the corners, wherein each loop wraps around the tab or upper end. However, in other aspects, the sleeve can comprise an attachment mechanism in order to removably couple the sleeves to the rods and extensions. For example, the attachment mechanism can comprise a hook and loop system, wherein part of the sleeve wraps around part of the rod and/or extension whereby the hook and loop portions are engaged in order to couple the sleeve to the rods and/or extension. In some aspects, the attachment mechanism can comprise a keyhole clip, as discussed above, configured to be received by the endcap of the rods. In other aspects, the attachment mechanism can comprise a hook, latch, or the like in order to removably couple the sleeve to the rod and/or the extensions. The sleeves receive the rods and extensions and securely hold the net on the rods and extensions.

In some aspects, the net can comprise at least one sleeve received by the upper end of a rod and at least one sleeve that extends along part of an extension. In some aspects, the net can comprise at least one sleeve that receives part of the support portion. The net can comprise a plurality of sleeves that receive a respective one of the support portion, first and second extensions, or a combination thereof. The sleeves that receive the support portion and/or extensions can extend along the bottom edge of the net. The at least one sleeve of the net can be comprised of many different materials, such as but not limited to fabric, plastic, elastic material, rope, cord, or the like. In some aspects, the net can comprise an attachment cord 1040 comprising a ring 1042 which is adapted to provide additional structural support. The ring 1042 can receive a stake, weight, or similar device so as to attach the net structure to the ground or surface. The first and/or second extensions can comprise one or more tabs to receive the net, such that the net can be adjusted as desired by the user.

At least one advantage of the disclosure is that the support portion and first and second extensions can compensate for forces exerted onto the net structure by the rods while in the flexed state. When the net is coupled and/or received by the rods that are within the respective shafts, the net exerts a pulling force onto the rods, such that the rods are in the flexed state. The rods in the flexed state exert a force onto at least the support portion and the extensions. The support portion and extensions can absorb the load exerted onto the support portions and extensions due to the rods being in the flexed state and distribute the load across the support portion and extensions. In some aspects, part of the support portion can be bent to at least partially raise part of the support portion in order to counteract the downward force exerted onto at least the support portion and/or extensions by the rods bent in the flexed state. In some aspects, one or more of the extensions can be bent to at least partially raise the net structure when the extensions are deployed.

The extensions can be configured in many different configurations and are not intended to be limited to the aspects of the disclosure herein. The extensions of at least FIG. 22 are shown as being straight or linear. However, the extensions are not intended to be limited to being straight or linear. In some aspects of the disclosure, the extensions can be bent such that the bent extensions raise the net structure off the ground or surface by the distance "d" when the extensions are deployed. The bent extensions could be used with an angled first and/or second bracket to further assist in lifting the net structure from the ground or surface. In some aspects, the extensions and/or the support portion can be bent such that the net structure is at least partially raised off the ground or surface. In some aspects, the first and/or second brackets can further comprise feet that lift the first and/or second brackets off the ground or surface such that at least the support portion is raised off the ground or surface.

The first and/or second brackets can be configured in many different configurations and are not intended to be limited to the aspects disclosed herein. In some aspects, the brackets have a circular shape, but in other aspects, the brackets can comprise many different shapes and not limited to a circular shape. In some aspects, the brackets can comprise one groove or more than one groove. For example, the first bracket can comprise two grooves and a plurality of first extensions, wherein a respective one of the plurality of first extensions is pivotable within a respective groove. Additionally, the grooves can be set at an angle such that the bottom surface of the bracket is not substantially flat. The angled grooves of the bracket can cause the extensions to lift the net structure when the extensions are deployed or positioned at the opened end of the groove. Furthermore, the stop within the groove can be a raised surface that corresponds to the shape of the extensions to prevent rotation of the base extension within the groove. The brackets can be formed of many different materials. In some aspects, the brackets can be comprised of plastic materials, fabricated using an injection molding process. An advantage of the disclosure is that the brackets are of solid construction and are not formed of separate components that are joined together. The unitary construction of the brackets results in a stronger device and can bear the load of the rods exerted onto the net structure.

Figure 36:
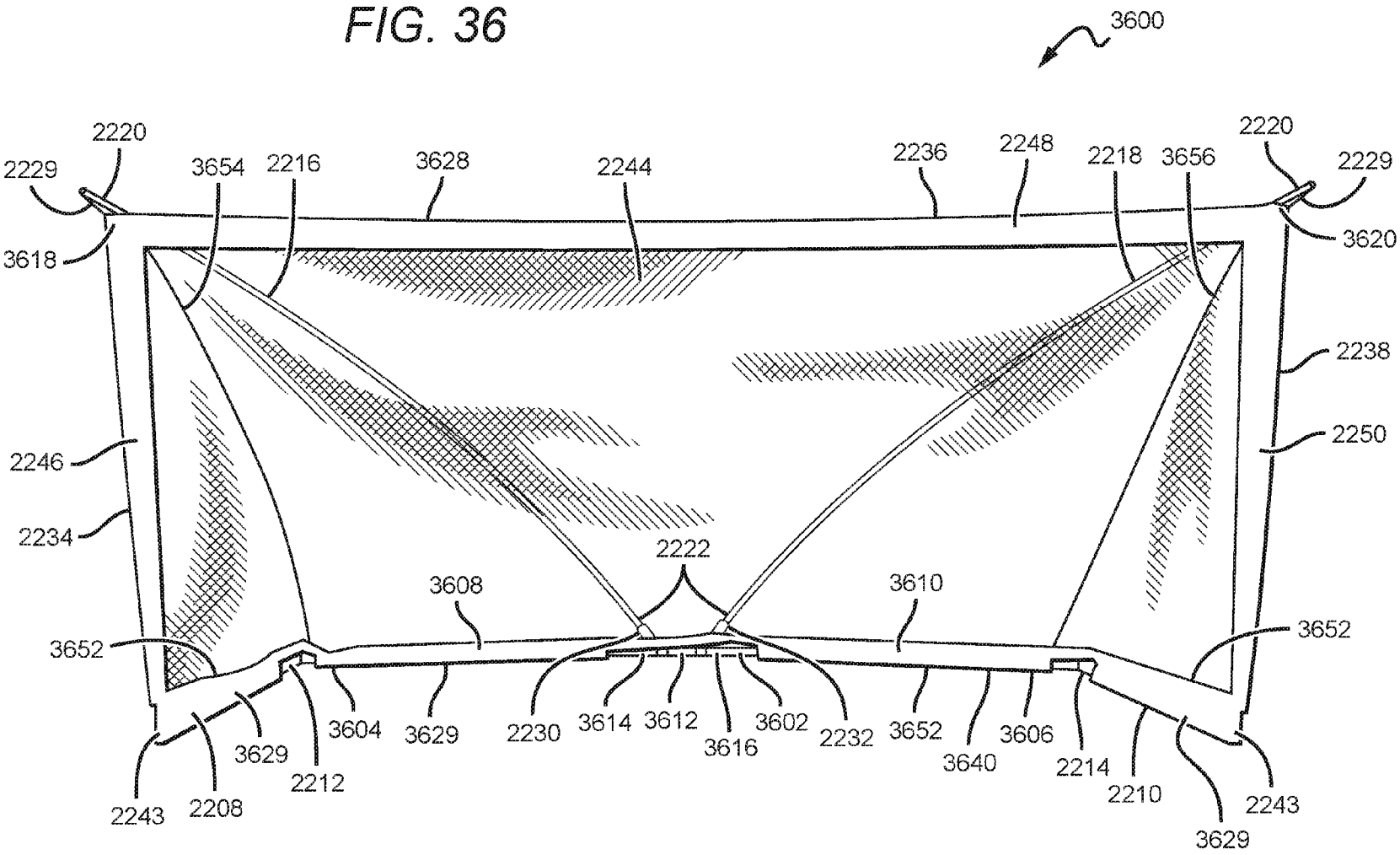
FIG. 36 is a perspective view of a ball net structure according to an aspect of the disclosure.

FIG. 36 shows one aspect of a ball net structure 3600 according to the disclosure.

The ball net structure 3600 comprises features similar to the features of the ball net structure 2200. As such, a discussion of the similar features and/or aspects of the similar features will not be presented in an effort to reduce duplicate descriptions, with the understanding that such disclosure is applicable to any ball net structure comprising the similar features. The ball net structure 3600 comprises a support portion 3602 having a first end 3604 and a second end 3606, first and second extensions 2208, 2210 coupled to the support portion 3602. A first bracket 2212 is coupled to the first end 3604 of the support portion 3602 and receives the first extension 2208, such that the first bracket 2212 pivotally couples the first extension 2208 to the support portion 3602. A second bracket 2214 is coupled to the second end 3606 of the support portion 3602 and receives the second extension 2210, such that the second bracket 2214 pivotally couples the second extension 2210 to the support portion 3602. The first and second extensions are adapted to pivot along a first plane. At least one flexible rod 2216 is coupled to support portion 3602, wherein the at least one flexible rod comprises an upper end 2220 and a lower end 2222, such that the lower end 2222 is removably coupled to the support portion 3602. A net 3628 is received by at least the first and second extensions 2208, 2210 and received by at least the upper end 2220 of the at least one flexible rod 2216. The net 3628 is configured to bend the at least one flexible rod 2216 from a linear state to an arcuate state, such that a net tension pulls the at least one flexible rod into the arcuate state. The aspect of FIG. 36 comprises a first flexible rod 2216 and a second flexible rod 2218, but other aspects can comprise more than two flexible rods and the disclosure is not intended to be limited to the aspects disclosed herein. At least the upper end 2220 of the first flexible rod 2216 is configured to receive the net 3628, and at least the upper end 2220 of the second flexible rod 2218 is configured to receive the net 3628, such that the net bends the first and second flexible rods 2216, 2218 from a relaxed linear state to an arcuate state or a bow shaped flexed state, wherein the first and second flexible rods are biased away from each other to hold the net upright. The net tension pulls the first flexible rod into the arcuate state and the net tension simultaneously pulls the second flexible rod into the arcuate state. The support portion 3602 and the first and second extensions 2208, 2210 support the load of the ball net structure 2200 and allow it to remain upright on a surface. The first and second extensions absorb at least part of a load exerted onto the ball net structure 3600 from a ball or other projectile when in use so as to maintain the ball net structure in an upright position.

The support portion 3602 extends longitudinally between the first end 3604 and the second end 3606. The support portion 3602 comprises a plurality of support portions and at least one intervening structure adapted to receive at least two of the plurality of support portions. In the aspect of FIG. 36, the support portion 3602 comprises a first support portion 3608 and a second support portion 3610, wherein the first support portion is coupled to the first bracket 2212 and the second support portion is coupled to the second bracket 2214. The at least one intervening structure of the support portion 3602 can comprise at least one third bracket 3612 adapted to receive the first support portion and the second support portion, wherein the first support portion rotates about a third pivot 3614 of the third bracket and the second support portion rotates about a fourth pivot 3616 of the third bracket. The at least one third bracket 3612 can be configured in a manner similar to the hinge 22 discussed above. In some aspects, the at least one third bracket can comprise one or more shafts, while in other aspects, the at least one third bracket does not comprise a shaft. The first and second support portions are adapted to pivot along a second plane. In some aspects, the first plane and the second plane are substantially perpendicular, such that the extensions pivot in a direction within the first plane that is substantially perpendicular to a direction that the support portions pivot within the second plane. In some aspects, the first plane and the second plane are substantially parallel. In some aspects, at least one of the first plane or second plane is parallel to the surface that the net structure is disposed on.

Figure 40:
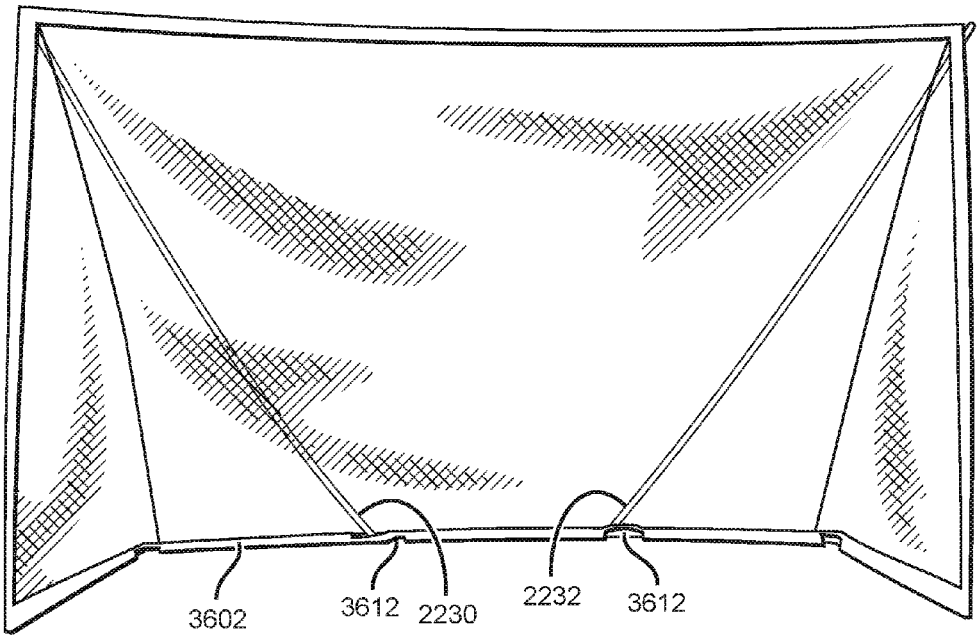
FIG. 40 is a perspective view of a ball net structure according to an aspect of the disclosure.
Figure 42:
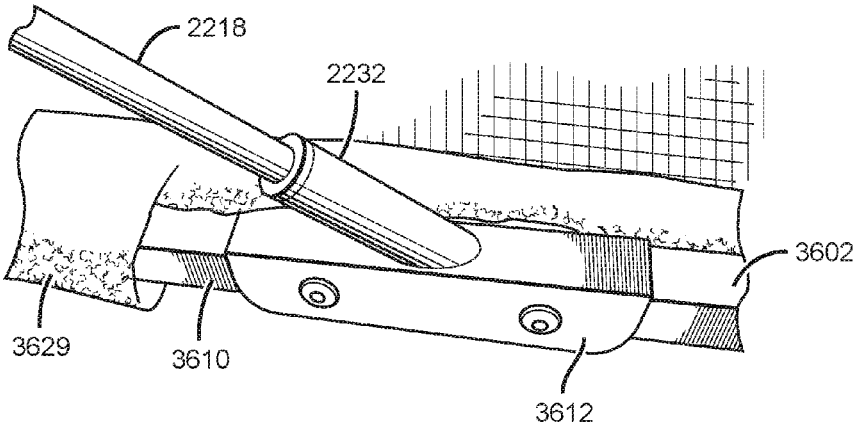
FIG. 42 is an enlarged view of a bracket according to an aspect of the disclosure.
Figure 41:
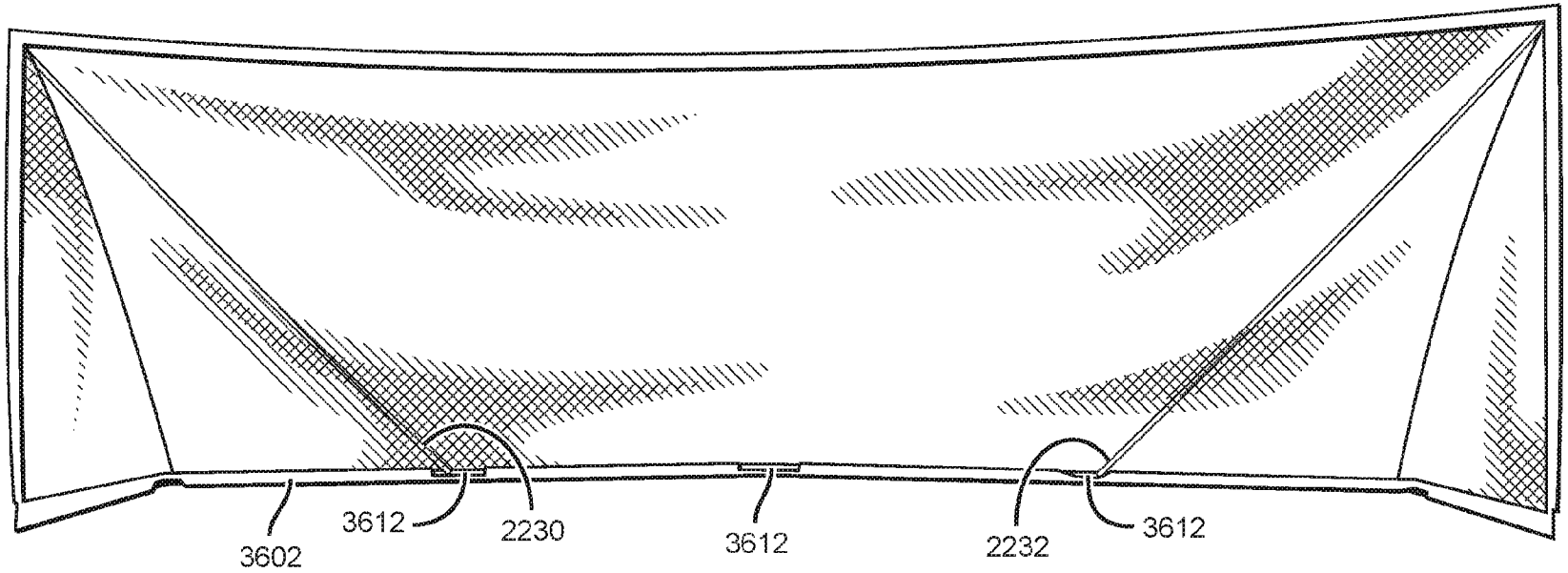
FIG. 41 is a perspective view of a ball net structure according to an aspect of the disclosure.

The support portion 3602 comprises at least one shaft integral to and extending from the support portion. In the aspect of FIG. 36, the support portion 3602 comprises a first shaft 2230 and a second shaft 2232, wherein the first shaft 2230 and the second shaft 2232 are on the third bracket 3612 such that the first and second shafts are substantially centrally disposed with respect to the support portion 3602. The shafts can be arranged in many different configurations and are not intended to be limited to being centrally disposed with respect to the support portion 3602. In some aspects, as shown in FIG. 40, the support portion 3602 can comprise a plurality of support portions and a plurality of third brackets 3612, wherein a first shaft is on a first third bracket and at least partially extends towards the first bracket, and wherein a second shaft is on a second third bracket and at least partially extends towards the second bracket. The first and second third brackets receive at least one of the plurality of support portions such that each of the at least one of the plurality of support portions is pivotally coupled to at least one of the first or second third brackets. FIG. 42 shows a partial view of the second third bracket, the second shaft and the second flexible rod. The first third bracket is a mirror image of the second third bracket shown in FIG. 42. In some aspects, as shown in FIG. 41, the support portion 3602 comprises a plurality of support portions and three third brackets 3612, wherein a first shaft is on a first third bracket and at least partially extends towards the first bracket, wherein a second shaft is on a second third bracket and at least partially extends towards the second bracket, and wherein a central third bracket is interposed between the first and second third brackets on the support portion, in a manner similar to the aspect of FIGS. 41-42. Each of the first, second, and central third brackets receives at least one of the plurality of support portions such that each of the at least one of the plurality of support portions is pivotally coupled to at least one of the first, second, or central third brackets. The central third bracket can be configured in a manner similar to hinge 22, disclosed above. In yet other aspects, at least one shaft can be on at least one of the plurality of support portions instead of a third bracket. The shafts can be arranged in many different ways and is not intended to be limited to the aspects disclosed herein. The aspects of FIGS. 40 and 41 provide net structures of larger sizes than the aspect of FIG. 36, due in part to the increase of size of the support portion, but are otherwise similarly configured as the net structure 3600.

Referring back to FIG. 36, the first shaft 2230 at least partially extends out in a direction towards the first end 3604 of the support portion, and the second shaft 2232 at least partially extends out in a direction towards the second end 3606 of the support portion. The first shaft is configured to receive the lower end 2222 of the first flexible rod 2216, and the second shaft 2232 is configured to receive the lower end 2222 of the second flexible rod 2218. The angle at which the shaft is angled with respect to the support portion and/or the third bracket causes the rods to extend outward at substantially the same angle as that of the shaft. The rods, when received by the shafts flare outwards and are in a relaxed state and are substantially linear.

A net 3628 is arranged to be received by at least the first and second rods and at least the first and second extensions. The net 3628 comprises at least one sleeve to receive part of the first rod, part of the second rod, part of the first extension, part of the second extension, and at least part of the support portion 3602. The net 3628 is adapted to exert a pulling force on the first and second rods bending the first and second rods into a flexed or arcuate state, such that the rods are bent in opposing directions and away from each other. The first and second rods received by a respective sleeve 2229 results in the first and second rods being bent from the relaxed or linear state into the flexed or arcuate state and are biased away from each other. The net tension exerted by the net onto the rods simultaneously pulls the rods into the arcuate state, such that the rods are maintained in the arcuate state when the net structure is fully assembled. The net 3628 imparts a pulling force on each of the rods which causes the rods to bend into the arcuate state. The rods, while in the arcuate state, experience a moment force about a respective pivot point. The pivot point of each of the rods corresponds to the point at which the rods are received by the shaft. The moment force experienced by the rods is imparted and/or transferred onto at least the support portion 3602 and the first and second extensions. This transferred force further assists in stabilizing the net structure on a surface. The rods exert a force onto at least the at least one third bracket 3612 to lock the support portions, and prevent rotation of the support portions about the at least one bracket 3612. The moment force experienced by the rods is transferred onto at least the at least one bracket to lock the at least one bracket, such that the at least one support portion does not pivot with respect to the at least one bracket. The net structure 3600, when fully assembled and deployed, is adapted to withstand the force of a ball or projectile so as to capture the ball while keeping the at least one bracket locked and the net structure upright. The net structure 3600 is similar to the aspect of at least FIGS.

1-4 or net structure 2200 that comprises a hinge or a bracket, in that the at least one third bracket does not comprise a locking device and is locked due to the forces exerted by the net and/or the rods when the net structure 2200 is fully assembled.

The net 3628 comprises a sleeve received by at least a respective upper end 2220 of the first and second rods and is further received by at least the first and second extensions 2208, 2210, such that the rods at least partially bend in a direction towards the support portion and into the arcuate state. The first and second rods also at least partially bend in a direction towards the respective first and second extensions, such that at least an upper end 2220 of the first rod is over the first extension and at least an upper end 2220 of the second rod is over the second extension. In the aspect of FIG. 36, the upper ends of the first and second rods are substantially aligned with the front ends 2243 of the first and second extensions when the net is received by the rods, extensions and support portion. The shape of the net 3628 can also determine the positioning of the upper ends of the rods when coupled to the net. The net 3628 is shaped like a soccer goal which results in the respective upper ends of the rods being substantially axially aligned with the front ends 2243 of the respective extensions. The net can comprise many different shapes, as discussed above, and is not intended to be limited to a soccer goal. Removal of the net 3628 from at least the first or second rods, allows the rods to return to their original form of the linear or relaxed state. When the rods are in the linear state, the rods can be easily removed from the shafts and allows the net structure to be disassembled and stored for later use. Repeated use of the net structure does not result in the rods being permanently bent in a shape similar to the arcuate state.

Figure 39:
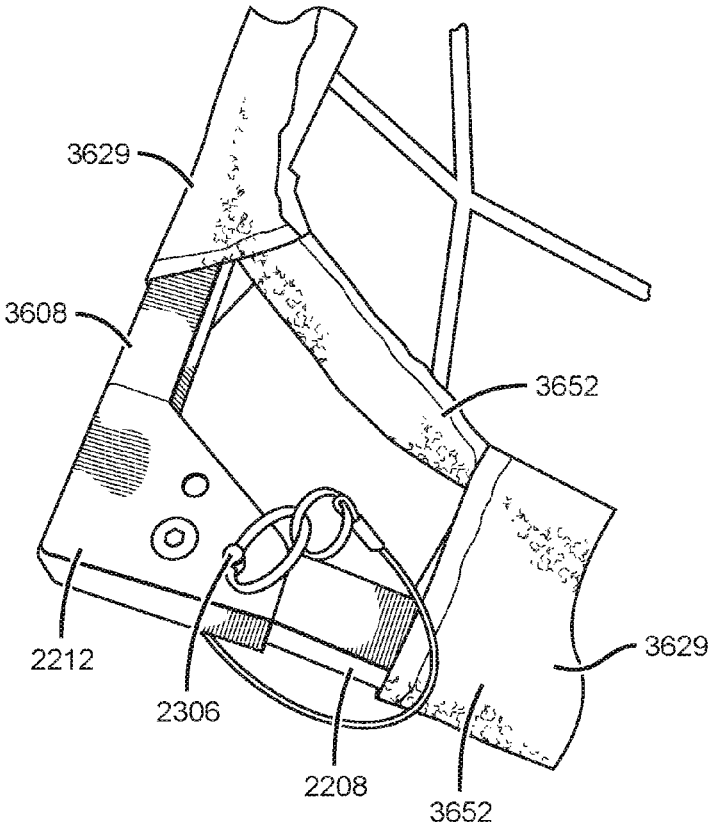
FIG. 39 is a partial side view of the ball net structure according to an aspect of the disclosure.

The net structure 3600 is fully deployed and ready for use when the net 3628 is received by the rods, extensions, and support portion. The net 3628 comprises a first corner 3618 with a sleeve 2229 and a second corner 3620 with a sleeve 2229, wherein the upper end of the first rod receives the sleeve at the first corner 3618, and the upper end of the second rod receives the sleeve at the second corner 3620. The net further comprises at least one sleeve 3629 to receive the extensions and the support portion. The sleeve 2229 is similar as discussed above, while the at least one sleeve 3629 is an elongated sleeve configured to substantially receive and cover the extensions and support portion. As shown in FIG. 36, the net 3628 comprises a plurality of sleeves 3629 wherein a first sleeve 3629 receives the first extension, a second sleeve 3629 receives the second extension, and a third sleeve 3629 receives the support portion 3602. FIG. 37 shows a side view of the net structure 3600 and FIG. 39 shows a partial side view of the net structure 3600, and disclose that the first sleeve 3629 substantially covers the first extension 2208 but does not cover the first bracket 2212. The second sleeve 3629 is similarly configured as the first sleeve shown in FIG. 37. The third sleeve substantially covers the first support portion 3608 and the second support portion 3610 and does not cover the third bracket 3612. The third sleeve also does not cover the first and second brackets. The first, second, and third brackets are at least partially exposed and are not substantially covered by any of the sleeves 3629 to allow for the extensions and/or support portions to pivot about the first, second, or third brackets, which also assists to prevent damaging the sleeves and/or net. The sleeves can be configured to accommodate for the dimensions of the first and second extensions, first and second brackets, the support portion, including the shafts and any intervening structures such as but not limited to the hinge or at least one third bracket, such that the sleeves can be easily installed or removed, thereby allowing the net 3628 to be removable. The net 3628 can be removed when disassembling and storing the net structure. However, the net 3628 can remain on the support portion and first and second brackets while the net structure is disassembled and in storage.

The net 3628 further comprises a first edge 2234, a top edge 2236, a second edge 2238, and a bottom edge 3640. The first edge 2234 extends between the first extension and the upper end of the first rod. The top edge extends between the upper end of the first rod and the upper end of the second rod. The second edge extends between the upper end of the second rod and the second extension. The bottom edge at least partially extends between the first and second extensions and the support portion 3602. The net 3628 can comprise a mesh surface with respective borders along the edges of the net, wherein the mesh surface is coupled to the borders. A first border 2246 extends between the front end 2243 of the first extension and the upper end of the first rod. A top border 2248 extends between the upper end of the first rod and the upper end of the second rod. A second border 2250 extends between the upper end of the second rod and the front end 2243 of the second extension. A bottom border 3652 at least partially extends along the first and second extensions and the support portion 3602. The borders can comprise graphics and/or printed matter to assist in proper alignment of the net during assembly. The borders can provide a visual indication of the profile of the net such that users can identify the boundary of the net that is intended to capture the ball and/or other projectile. As shown in FIGS. 36 and 37, the sleeves 3629 cover the first and second extensions and the support portion 3602, but also partially define the bottom border 3652. As discussed above, the sleeves 3629 do not substantially cover the first, second or third brackets such that they are exposed, but the sleeves extend between first extension and first support portion, extend between the second extension and the second support portion, and further extend between the plurality of support portions in order to form a continuous bottom border 3652. The net is held onto at least the rods by tension. The tension holds the net substantially taut, such that the net can capture a ball and/or other projectile. The net being substantially taut allows the borders to be easily visible. In the aspect of FIG. 36, the sleeves 2229 at the corners of the net are at an outer part of the border, such that when the upper end of the rods receives the respective sleeve, at least the upper end of the rods partially extends above the top edge or beyond the first or second edges to tension the net. The sleeves 2229 can be located at any part on the net and are not intended to be limited to the aspects disclosed herein. In some aspects, the sleeves 2229 can be disposed on a rear surface of the border proximate the corners and configured to receive the upper end of the rods. In some aspects, the sleeves 2229 can comprise an attachment mechanism as discussed above.

The net 3628 further comprises at least one seam extending between at least one rod and the bottom edge 3640. In the aspect of FIG. 36, the net 3628 comprises a first seam 3654 and a second seam 3656, wherein the first seam extends between the upper end of the first rod and the bottom edge proximate the first bracket, and the second seam extends from upper end of the second rod and the bottom edge proximate the second bracket. The first seam is coupled to the bottom border proximate the first bracket and coupled to at least one of the top border or first border proximate the first corner 3618. The second seam is coupled to the bottom border proximate the second bracket and coupled to at least one of the top border or second border proximate the second corner 3620. The seams assist the net 3628 in forming a soccer like goal with distinct net sides and/or net surfaces that are substantially taut and do not substantially sag when the net structure 3600 is fully assembled.

Figure 38:
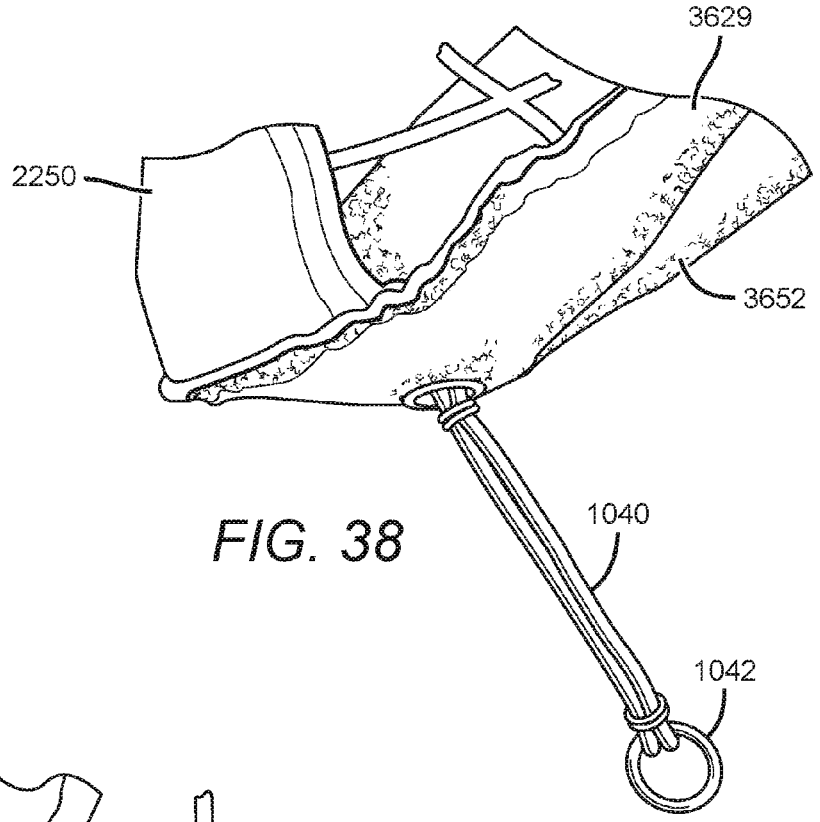
FIG. 38 is an enlarged view of the ball net structure according to an aspect of the disclosure.

The net 3628 imparts a pulling force on each of the rods which causes the rods to bend at least partially in a direction towards the respective extensions. The mesh surface 2244 and borders can be comprised of woven materials and/or can be comprised of typical net materials known in the art. In some aspects, the net can comprise an attachment cord 1040 comprising a ring 1042 which is adapted to provide additional structural support, as shown in at least FIG. 38. In some aspects, the first or second extensions comprise an attachment cord 1040 and ring 1042 to provide additional structural support. In some aspects, the attachment cord 1040 can extend from the first or second extensions and through the sleeve exposing the ring and at least part of the attachment cord.

The net structure 3600 can comprise any of the first and/or second brackets 2212, 2600, or 2700 disclosed above. In some aspects, the first and second extensions of the net structure 3600 are arranged to be substantially perpendicular to the support portion 3602 because the net structure 3600 is in the form of a soccer goal. However, the first and second extensions are not intended to be limited to being substantially perpendicular to the support portion 3602. In some aspects, the first or second extensions can be arranged at greater than or less than 90 degrees with respect to the support portion, as disclosed above.

At least one advantage of the disclosure is that at least the first and/or second edges of the net 2228 and 3628 do not comprise a pole and/or rigid structure to maintain the net 2228, 3628 in an upright position. Some conventional nets utilize a pole and/or rigid structure to support the net at the side edges, which could cause damage or injury to a user in the event a user contacts or strikes the side edges of the net. The net tension holds the net upright such that a pole and/or rigid structure is not required to hold up the side edges of the net. The first and second rods of the net structure are arranged behind the net 2228 and 3628, which reduces the potential for injury for users. The nets 2228 and 3628 are shown as being received by the upper ends of the rods. However, in some aspects, the net 2228 or 3628 can be arranged to be coupled to the rods at many different locations of the rods and is not intended to be limited to only being received at the upper ends of the rods. In some aspects, the net 2228 or 3628 can comprise a plurality of sleeves that are removably coupled to the rod, as disclosed in any of the above aspects herein.

Although the disclosure has been described in considerable detail with reference to certain configurations thereof, other versions are possible. Ball net structures according to the disclosure can be many different sizes and can be used for many different applications, other than for sports-related activities. The ball net structure can comprise first and second extensions of similar length or of varied lengths. In some aspects, the first and second extensions and the support portion have substantially the same length. In some aspects, the support portion could be longer in length than the first or second extensions. The ball net structure can comprise net sidewalls to form an enclosure, similar to a soccer goal, lacrosse goal or the like and can also include a plurality of hinges coupled to the support portions and/or the base extensions of base structure and support the force exerted onto the base structure of the ball net structure. In other aspects, the support portions can be adjustable to make a smaller or bigger base structure, while the size of the rods can also be adjusted to make a smaller or bigger ball net structures. In other aspects, the rods can be made of a single piece of material, whereas in other aspects, the rods can be comprised of a plurality of rod pieces that are joined together to form the rod. Therefore, the spirit and scope of the disclosure should not be limited to the versions described above.

We claim:

1. A net apparatus, comprising:

a support portion comprising at least a first support portion and at least a second support portion;

first and second extensions;

a first bracket coupled to the first support portion, wherein the first extension is received by the first bracket, such that the first extension rotates about a first pivot of the first bracket;

a second bracket coupled to the second support portion, wherein the second extension is received by the second bracket, such that the second extension rotates about a second pivot of the second bracket;

the support portion further comprising a third bracket adapted to receive the first support portion and the second support portion, such that the first support portion rotates about a third pivot of the third bracket and the second support portion rotates about a fourth pivot of the third bracket;

first and second flexible rods each having an upper end and a lower end, wherein each of the lower ends of the first and second flexible rods are removably coupled to the support portion, wherein each of the lower ends of the first and second flexible rods are remote from the first and second brackets, wherein the support portion comprises a first shaft and a second shaft, wherein the first and second flexible rods are received by the first and second shafts, respectively, wherein the first shaft is on the third bracket; and a net adapted to receive at least the first and second flexible rods and at least the first and second extensions, wherein the net bends the first and second flexible rods from a straight relaxed state into a bow-shaped flexed state such that the first and second flexible rods are biased away from each other to hold the net upright.

2. A net apparatus, comprising:

a support portion comprising at least a first support portion and at least a second support portion;

first and second extensions;

a first bracket coupled to the first support portion, wherein the first extension is received by the first bracket, such that the first extension rotates about a first pivot of the first bracket;

a second bracket coupled to the second support portion, wherein the second extension is received by the second bracket, such that the second extension rotates about a second pivot of the second bracket;

the support portion further comprising a third bracket adapted to receive the first support portion and the second support portion, such that the first support portion rotates about a third pivot of the third bracket and the second support portion rotates about a fourth pivot of the third bracket;

first and second flexible rods each having an upper end and a lower end, wherein each of the lower ends of the first and second flexible rods are removably coupled to the support portion, wherein each of the lower ends of the first and second flexible rods are remote from the first and second brackets; and a net adapted to receive at least the first and second flexible rods and at least the first and second extensions, wherein the net bends the first and second flexible rods from a straight relaxed state into a bow-shaped flexed state such that the first and second flexible rods are biased away from each other to hold the net upright;

wherein the third bracket is locked solely by a net tension pulling the first and second flexible rods into the bow-shaped flexed state, such that the third bracket is unlocked when the first flexible rod is in the straight relaxed state and the second flexible rod is in the straight relaxed state.

* * * * *